US006758797B2

(12) United States Patent
Akami et al.

(10) Patent No.: US 6,758,797 B2
(45) Date of Patent: Jul. 6, 2004

(54) BENDING PRESS SYSTEM

(75) Inventors: Ichio Akami, Kanagawa (JP); Takahiro Ogawa, Kanagawa (JP); Masaaki Sato, Kanagawa (JP); Goujyu Umemoto, Kanagawa (JP); Toshiyuki Kondo, Kanagawa (JP)

(73) Assignee: Amada Company, Ltd. (JP)

( * ) Notice: Subject to any disclaimer, the term of this patent is extended or adjusted under 35 U.S.C. 154(b) by 0 days.

(21) Appl. No.: 10/288,456

(22) Filed: Nov. 6, 2002

(65) Prior Publication Data

US 2003/0064871 A1 Apr. 3, 2003

Related U.S. Application Data

(62) Division of application No. 09/889,318, filed as application No. PCT/JP00/00134 on Jan. 13, 2000, now Pat. No. 6,656,099.

(30) Foreign Application Priority Data

Jan. 13, 1999 (JP) ..... 11-6914

(51) Int. Cl.[7] ..... B23Q 3/155

(52) U.S. Cl. ..... 483/1; 483/29; 72/478; 72/31.01; 700/165; 700/179

(58) Field of Search ..... 483/1, 28–29, 483/4–5, 7–8, 10–11; 72/446, 447, 448, 31.01, 31.1, 31.11, 478; 700/179, 165

(56) References Cited

U.S. PATENT DOCUMENTS

| | | | | |
|---|---|---|---|---|
| 4,930,332 A | * | 6/1990 | Hongo | 72/446 |
| 5,168,745 A | * | 12/1992 | Miyagawa et al. | 72/446 |
| 5,828,575 A | * | 10/1998 | Sakai | 700/182 |
| 5,983,688 A | * | 11/1999 | Anzai et al. | 72/31.1 |
| 6,151,947 A | * | 11/2000 | Arduino et al. | 72/335 |

FOREIGN PATENT DOCUMENTS

| | | | |
|---|---|---|---|
| EP | 0 392 795 | | 10/1990 |
| JP | 55-045288 | | 3/1980 |
| JP | 57-037408 | | 8/1982 |
| JP | 59-88273 | | 5/1984 |
| JP | 5-7936 | | 1/1993 |
| JP | 05-187815 | | 7/1993 |
| JP | 6-304660 | | 11/1994 |
| JP | 63-21932 | | 11/1994 |
| JP | 07-275941 | | 10/1995 |
| JP | 8-318317 A | * | 12/1996 |
| JP | 09-108738 | | 4/1997 |
| JP | 10-225724 | | 8/1998 |
| JP | 11-000718 | | 1/1999 |
| WO | WO98/01243 A1 | * | 1/1998 |

OTHER PUBLICATIONS

PCT/JP00/00134, International Search Report.

* cited by examiner

*Primary Examiner*—A. L. Wellington
*Assistant Examiner*—Erica E Cadugan
(74) *Attorney, Agent, or Firm*—Blank Rome LLP

(57) ABSTRACT

A bending press system provided with a bending press (1) with at least one bending station to mount a plurality of divided tools and, tool housing devices (65, 123) to house divided metals to be used on the bending press and, tool exchange devices (61, 143) which mount the divided tools on the bending station, in which are provided a first memory (403) which stores housed positions of each divided tool housed in the housing devices and a second memory (405) which stores the bending line length of the bent part, the flange length and the bending angle of the bent product and, a first computation device (407) which, based on the bending line length, flange length, bending angle, computes the tool (cross section shape) type and the length of the bending station, and a second computation device (409) which, based on the tool type and length of the bending station computes the arrangement of each divided tool on the bending station, and an NC control (411) which controls the tool exchange device so that each divided tool is moved from the housed position in the housing device to the determined arrangement position.

3 Claims, 48 Drawing Sheets

FIG.39
STANDARD SIZE
| TYPE (403a) | STATES (403b) | POSITIONS (403c) |
|---|---|---|
| $D_1$ | $A_1$ | -50 |
| $D_2$ | $A_2$ | +50 |
| $D_3$ | ..... | ..... |
| $D_4$ | ..... | ..... |
| ⋮ | ⋮ | ⋮ |
| $D_{11}$ | B | 1 |
| $D_{12}$ | B | 2 |
| $D_{13}$ | B | 3 |
| $D_{14}$ | B | 4 |
| $D_{15}$ | B | 5 |
FIG.40
(a)
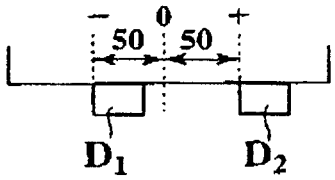
(b)
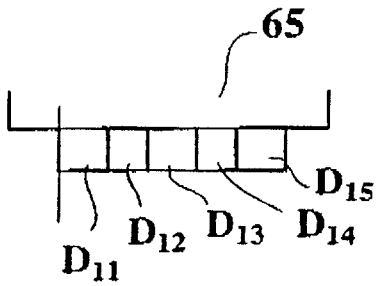

BENDING PRESS SYSTEM

This application is a Division of application Ser. No. 09/889,318 filed on Jul. 13, 2001, now U.S. Pat. No. 6,656,099, which is 371 of PCT/JP00/00134 filed Jan. 13, 2000.

FIELD OF TECHNOLOGY

The present invention relates to a bending press for bending a sheet material, partitioned tools for use in the bending press and methods and apparatus for exchanging the tools used in bending press.

BACKGROUND TECHNOLOGY

Press brakes for bending sheet materials are provided with upper and lower tables opposed to each other that are supported by side frames, where the upper table or the lower table is made free to move upwards or downwards. The lower part of the upper table is provided with an upper tool holder for removably holding the upper tool, and the upper part of the lower table is provided with a lower tool holder for removably holding the lower tool, which cooperates with the upper tool. A bending process is then performed by inserting a sheet work material in between the upper tool mounted on the upper tool holder of the upper table and the lower tool mounted on the lower tool holder of the lower table.

Conventionally, the exchange of the upper and lower tools by dismounting and mounting the upper and lower tools of the upper and lower tables were carried out manually. The upper and lower tools includes divided tools divided into a plurality of elements and long tools, but the upper and lower tools are in general are heavy, and the dismounting and mounting in exchanging the upper and lower tools onto the table was a burdensome work.

Thus techniques to exchange the upper and lower tools by dismounting and mounting the tools relative to the upper and lower tables automatically have been developed. Related prior art references are JP55-45288, JP57-37408 and JPU63-21932. Also prior art references related to the tool of the present invention includes for example JP2771064 and the like.

Now in performing a bending process on a work by a press brake, there are cases where, for example, tools of different lengths are mounted separately at a plurality of locations on the tool holders of the upper and lower tables, and the bending process is performed on a workpiece successively by the each processing station. The prior art references, however, all apply only to the case where there is only a single tool mounting location for the upper and lower tables and not for the case with a plurality of processing stations, and therefore the exchange of tools for the upper and lower tables with plural number of processing stations are still made manually.

DISCLOSURE OF THE INVENTION

The present invention was made in view of the heretofore-aforementioned problems. That is, the first press brake is a press brake where the upper table provided with the upper tool holder and the lower table provided with the lower tool holder face each other in the vertical direction, and one of them is freely movable upwards and downwards. In the rear of the upper table, there are provided an exchange upper tool support for removably supporting a plurality of divided upper tools and an upper tool exchange device to exchange the divided upper tool between the exchange upper tool support and the upper table. In the rear of the lower table there are provided an exchange lower tool support for removably supporting a plurality of divided lower tools and a lower tool exchange device to exchange the divided lower tool between the lower table and the exchange lower tool support.

The second press brake is structured so that each upper and lower exchange tool supports are made to move upwards and downwards freely so that by providing a tool support which may move upwards and downwards freely to the upper and lower tool exchange device, the upper and lower divided tools may be supported freely.

The $3^{rd}$ press brake is a press brake where the upper table provided with an upper tool holder and the lower table provided with a lower tool face each other downwards and upwards and where either the upper table or the lower table to made free to move upwards and downwards and where the left-right direction upper guide provided in the rear part of the upper table is made to protrude largely from the sides of the upper table in the left and right directions, and in order to exchange a plural number of divided upper tools on the upper table, an exchange upper tool support part which supports and allows attachment and detachment of a plural number of divided upper tools is provided on the protruded side part at a position which may be changed freely, and in order to exchange the divided upper tools between the exchange upper tool support part and the upper table, an upper tool exchange device free to move in the left-right directions is provided on the upper guide part, and the lower guide part which is provided in the rear of the lower table and is made to protrude largely from the lower table sides in the left-right directions and in order to exchange a plural number of divided lower tools on the lower table, an exchange lower tool support part is provided on the protruded side part at a position which may be changed freely, and in order to exchange the divided lower tools between the exchange lower tool support and the lower table, a lower tool exchange device free to move in the left-right directions is provided on the lower guide part.

In the $4^{th}$ press brake, in the rear of the part of the upper guide protruding from the sides of the press brake described above, an upper tool housing section is furnished which houses a plurality of exchange upper tool support parts which support a plurality of divided upper tools which may be freely attached or detached and a tool support exchange device made free to move forward and backward to exchange the exchange upper tool support between the housing and the protruded part of the upper guide.

The $5^{th}$ press brake is provided with a rotating part to turn round the front and rear sides of the exchange upper tool support part of the tool support exchange device in the press brake described above.

In the $6^{th}$ press brake, below the protruded side part of the of the lower guide part in the press brake described above, a lower tool housing is provided which houses a plurality of exchange lower tool supports which support plurality of divided lower tools which may be attached or detached freely, the lower tool housing being made free to move back and forth and to thrust the exchange lower support positioned below the lower guide part on the protruded side part upwards, an exchange lower tool support lift is provided.

The $7^{th}$ press brake is equipped with a temporary work holding device that may hold the work and a bending robot that supplies the work in between the upper and lower tools.

The divided tool of the present invention is arranged so that, in the divided tool freely exchangeable by mounting and dismounting from the tool holder of the press brake, the divided tool is provided with a shank part which may be engaged and disengaged from the mounting groove of the tool holder and, together with a work processing part to process the work and a concave engage part to which a lock piece, provided on the wall of the mounting groove and made free to appear or disappear, may be engaged freely is provided on the shank part and an engagement piece which may be made to turn up or hidden freely is provided on the shank part on the engage groove of the wall of the mounting groove and also an insertion hole for the tool hold to hold the divided tool and also to turn up and hide the engagement piece are provided near the shank part.

The first tool exchange device of the present invention is structured so that, in the tool exchange device for exchanging the divided tools between the tool holder device provided on the bending press and the exchange tool support which supports a plurality of divided tools free to attach and detach, on one side of the ends of the divided tool, a hook support with an abutted protuberance which may be abutted freely and a hook part with a curved point which may be abutted free to move in the long direction of the hook support and also to the other sides in front or rear of the divided tool, and are provided so that the divided tool may be held between the front and rear part by the abutted protuberance and the front edge part of the hook material.

In the second exchange device, in the tool exchange device described above, together with providing an insertion hole in the front to rear direction formed on the divided tool in which the hook support material and the hook material may be inserted freely, the hook material is made free to move in the direction crossing the long direction of the hook material and part of the hook support material is made in a wedge form so that the hook support material and the hook material may be engaged with little play in the insertion hole.

In the third tool exchange device, in the aforementioned tool exchange device, to at least one of the curved points provided on the abut protuberance or the hook material, an operation part is provided to turn up and down the engagement piece provided on the divided tool.

Also other characteristic features of the present invention are a bending press with at least one bending station to mount a plurality of divided tools (1) and, a bending press system provided with a tool housing device (65, 123) to house the divided tools of the bending press, a tool exchange device (61, 143) to move the divided tools between the tool housing device and the bending station and to mount the divided tools onto the bending station, and a system provided with a first memory means (403) which stores the housing position of each divided tools housed in the housing device, a second memory means (405) to store the bending line length, flange length and the bending angle, and a first calculation means (407) to calculate, based on the bending line length, flange length and the bending angle, the types of tools (cross section shape) of the divided tools to be positioned on the bending station and the bending station length, and a second calculation means (409) to calculate, based on the bending station tool types and length, the arrangement of each divided tool on the bending station, and a NC control device (411) to control the tool exchange device so that each divided tool is moved from the housing device to the determined arrangement position.

By this system, the divided bending tool may be installed automatically on the bending press based on CAD data that specifies the bending product.

In the second calculation means, in calculating the arrangement of each divided tool on the bending station, it is preferable to make reference to the tool data which describes the divided tools housed in the bending station, tool housing, tool magazine.

By this means, the tool arrangement may be determined quickly by use of divided tools that are usable in practice.

Further features of the invention are, in a bending press system where a bending press (1) with at least one bending station for attaching a plural number of divided tools, and a tool housing (123, 129) which houses the divided tools for the bending press, a tool exchange device (61, 143) to move the divided tools between the tool housing and the bending station and to attach the divided tools to the bending station, are provided as a method to attach the divided tools to the bending station, a stage to memorize the housing position of each divided tools housed in the housing device and, a stage to determine, based on the bent length of the bending part of the bent product, flange length and the bending angle, the types of the tools (cross section shape) of the divided tools arranged on the bending station and the length of the bending station and, a stage to determine the arrangement of each divided tool on the bending station based on the tool types of the divided tools to be arranged on the bending station and the length of the station and, a stage to move each divided tool from the housing position of the housing device to the determined arrangement position by the tool exchange device.

By this method, on basis of the CAD information and the like which specify the shape of the bent product, the divided tools may be installed on the bending station automatically.

In the method, in determining the arrangement of each divided tool on the bending station, it is desirable to use long tools.

This will expedite installment of the divided tools on the bending section.

In using long tools preferentially, it is desirable to use the quotient of the total length of the tool station divided by the length of the tool (for instance 100 mm) as the number of long tools to be used and fill the remaining length with short tools (for instance 10, 15, 20, 25, 30 mm long).

Also in determining the arrangement of each divided tool on the each bending station, it is desirable to arrange the long divided tools on both edges of the station and arrange the short divided tools in between the long divided tools arranged on the both edges.

By the arrangement, a bending section with a clean bending line form may be made.

Also when there is only one long tool on one station, the short tool is positioned on the side of the long tool.

In the stage in arranging the divided tools on the bending station, it is desirable to take into consideration the tool database that shows the divided tools mounted on the bending station and the divided tools housed in the tool housing device or the tool magazine.

This allows the arranging of the tool station using only usable divided tools that are arranged on the bending station or housed in the tool housing device or the tool magazine.

In more detail, in determining the arrangement of each divided tool on the each bending station, after determining the arrangement of the divided tools tentatively, it is desirable to make reference to the memory device which stores the types and number of divided tools mounted on the bending station and the type and number of divided tools stored in the tool housing device and the number and type of divided tools stored in the tool magazine outside the bending press in order to confirm whether all divided tools to be arranged on the tool station exist or not. And, for instance if, there is shortage in the number of long tools necessary, it is desirable to cover the shortage with short tools. That is, for instance, if the divided tool to be placed on the tool stage includes a tool that is not housed in the housing device or the magazine, the arrangement of the divided tools on the each station may be changed. For instance, if there is shortage of long tools of certain types but a large number of short tools of the same type exist in the housing device or the magazine, a plural number of short tools of the same type may be used at the station position where long tools should have been used.

Or if it is found that the designated divided tool does not exist in the tool housing device or the tool magazine after the arrangement of the divided metal has been determined, the lacking tool may be moved from a neighboring tool station.

There is also a case where the order of bending on bending sections to determined according to the bending line length, flange length, bending angle, and the determination of the tool types, bending station length of each station may be made based on these data. In this case, when the problem (including the case where the divided tool to be arranged on the tool station is not housed in the housing device or the magazine) arises, the bending order may also be changed.

The tool housing device is desirably provided with a first housing section (65) positioned on the bending axis of the bending station and a second housing section (123) which is provided with a tool support member (129) for supporting a plural number of divided tools with the same cross section shape. In moving the each divided tool from the housing device to the tool arrangement position on the bending station, it is desirable to house tools of each type (for instance each length or shape) in the second housing section and move a plural number of tools of the same type altogether from the second housing section to the first housing section and, in the first housing section provided at the tool insertion position of the bending station, divide the plural number of divided tools and insert the designated number of divided tools onto the bending station.

By the organization, the mounting time of the divided tools to the bending station may be shortened.

Also in inserting the divided tool from the first housing section to the bending station, after sliding a plurality of long tools collectively from the first housing section (standby station) to the bending station and positioning them at the designated position, make space for short tools at a designated position in between the long tools where the short tools may be inserted and arranged.

Another feature of this invention is a method to determine the order of processing when manufacturing a plurality of bent products. This method may be applied to a bending press system with a bending press provided with at least one bending station for attaching a plurality of divided tools and, a tool housing device (123, 129) for housing divided tools for the bending press and, a tool exchange device (61, 143) by which the divided tools may be moved between the tool housing device and the bending station.

Also the method is provided with.

a stage to store in the first memory means each divided tool housed in the bending station and the housing device and the divided tools housed in the tool magazine outside the bending press and, a stage to determine the tool type (cross section shape) to be arranged on the bending station and the length of the bending station and, a stage to produce the order of manufacturing data in order to produce the bent product that uses the tool holder mounted on the bending station or the tool housed in the tool housing device before producing the bent product that uses tools housed in the tool magazine outside the bonding station.

By this method, a plurality of products may be produced by the bending system quickly.

Another tool exchange mounting method of the present invention where in a press brake where the upper table provided with an upper tool holder and the lower table provided with a lower tool holder are made to oppose each other upwards and downwards and where one of the tables is made to move up and down freely, the case where the exchange of divided tools between the upper and lower tables and the exchange upper tool support which support a plurality of divided upper tools free to attach or detach and the exchange lower tool support which support a plurality of divided lower tools free to attach or detach are made automatically by use of the tool exchange device and a tool exchange and mounting method where divided tools with the smallest tool width are arranged in between a plurality of divided tools.

In the method, it is desirable to move sideward the plural number of divided tools adjacent to each other from the exchange tool support positioned at the side of the tool holder and separate the divided tools from each other on the tool holder and arrange the divided tools with small tool widths in between the separated divided tools.

Another tool exchange method of the present invention is, in the divided tool exchange on the press brake where, by use of the divided tools mounted on the tool holder of the press brake and a plural number of divided tools housed in the tool housing section, divided tools with desired lengths are mounted on the tool holders of the upper and lower table, where the divided tools which compose the entire length of the tool station are selected according to the bending length information, the selected tool station is displayed on the screen together with the work, a divided tool exchange method where the selected divided tools are mounted after moving the divided tools which interfere with the work to a position where it does not interfere.

This tool exchange device of the present invention is a divided tool exchange device in the press brake where, by use of the divided tools and a plural number of divided tools housed in the tool housing which are mounted on the tool holder of the press brake, divided tools with desired lengths are mounted on the tool holders of the upper and lower tables, and is a divided tool exchange device provided with a tool selection means to select from the divided tools mounted on the tool holder and divided tools housed in the housing section, divided tools which constitute the entire length of the tool station in correspondence with the bending line length of the product shape information, and an interference detection means to detect interference between the tools and the work by displaying the tool station selected by the tool selection means together with the work on a screen, and a tool transfer means to transfer the tool detected by the interference detection to be interfering to a non-interfering position.

In the apparatus, it is desirable to take the quotient of the total length of the tool station divided by the length of the longest divided tool as the number of the longest divided tool and to compose the difference in length between the total length and the total length of the longest divided tools by other divided tools.

In the apparatus, when the quotient of the total length of the tool station divided by the length of the longest divided tool is taken as the number of the longest divided tools but when the difference in length between the total length and the total length of the longest divided tools cannot be composed by a combination of other tools, it is desirable to use as the number of longest tools a value equal to 1 subtracted from the number and compose the difference in length between the total length and the total length of the longest divided tools by a combination of other divided tools.

Definitions

The meanings of terminologies used in this description are as follows.

"Flange length": The size of the flange in the direction perpendicular to the bending line.

"(Divided) tool type": The type of the (divided) tool specified by the cross-sectional shape of the bending tool.

"Size of the divided tool": The width of the divided tool when mounted on the bending station.

"Usable (divided) tool": (Divided) tools that are held by the factory where the bending press is installed and which are usable by the factory installations and the like.

BRIEF DESCRIPTION OF THE DRAWINGS

FIG. 39 shows the contents of the tool data stored in the first memory means of the management device.

FIG. 40 illustrates the meaning of the tool data shown in FIG. 39.

THE BEST MODE FOR CARRYING OUT THE INVENTION

Figure 1:
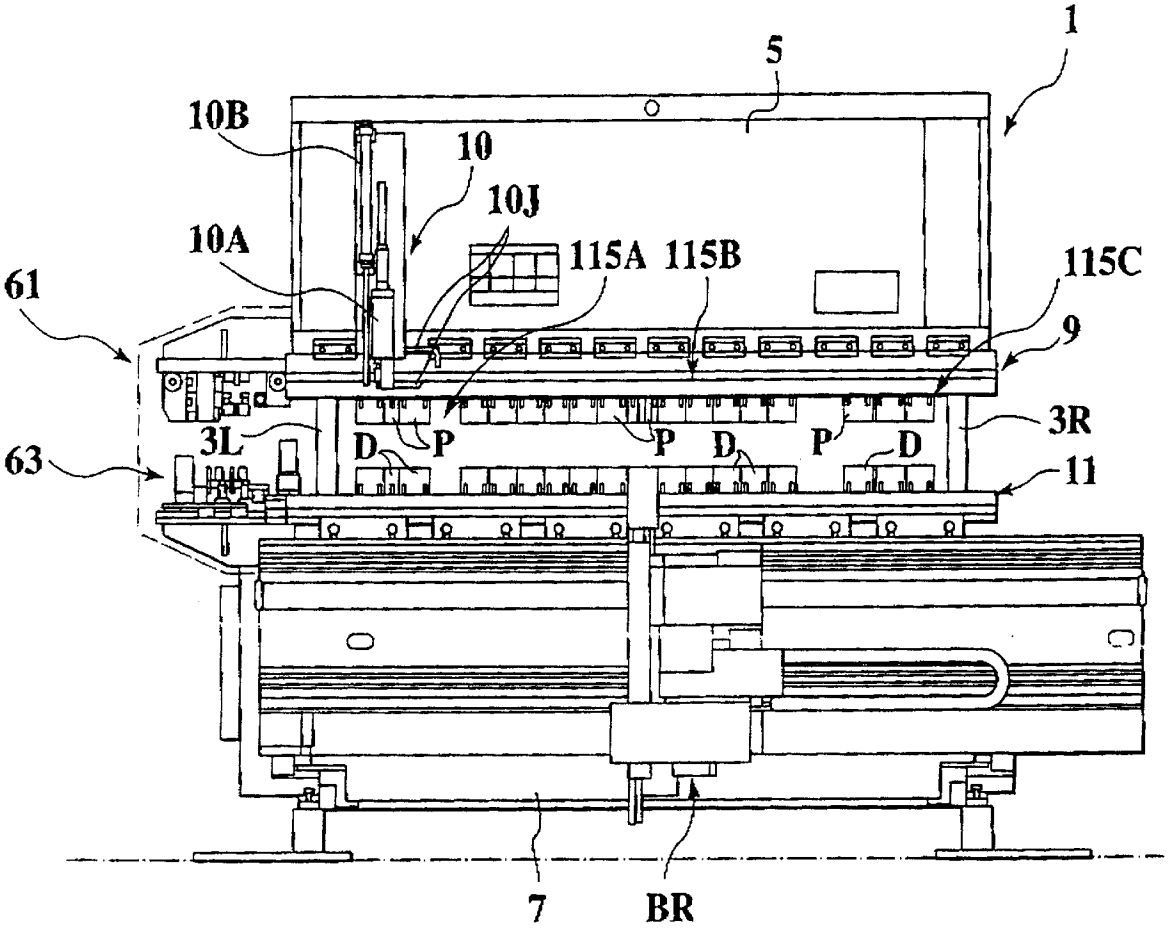
FIG. 1 illustrates the front view of the press brake of the first embodiment.

With reference to FIG. 1, in common with ordinary press brakes, press brake 1 of the first embodiment of the present invention is provided with an upper table 5 and a lower table 7 opposed to each other downwards and upwards and supported by left and right side frames 3L, 3R where, in the present example, the lower table is made free to move upwards and downwards.

On the lower part of the upper table 5, an upper tool holding section (tool holders) 9 for removably holding divided upper tools (divided tools) P is provided, and on the upper part of the lower table 7, a lower tool holding section (tool holders) for removably holding divided lower tools (divided tools) D is provided.

Figure 2:
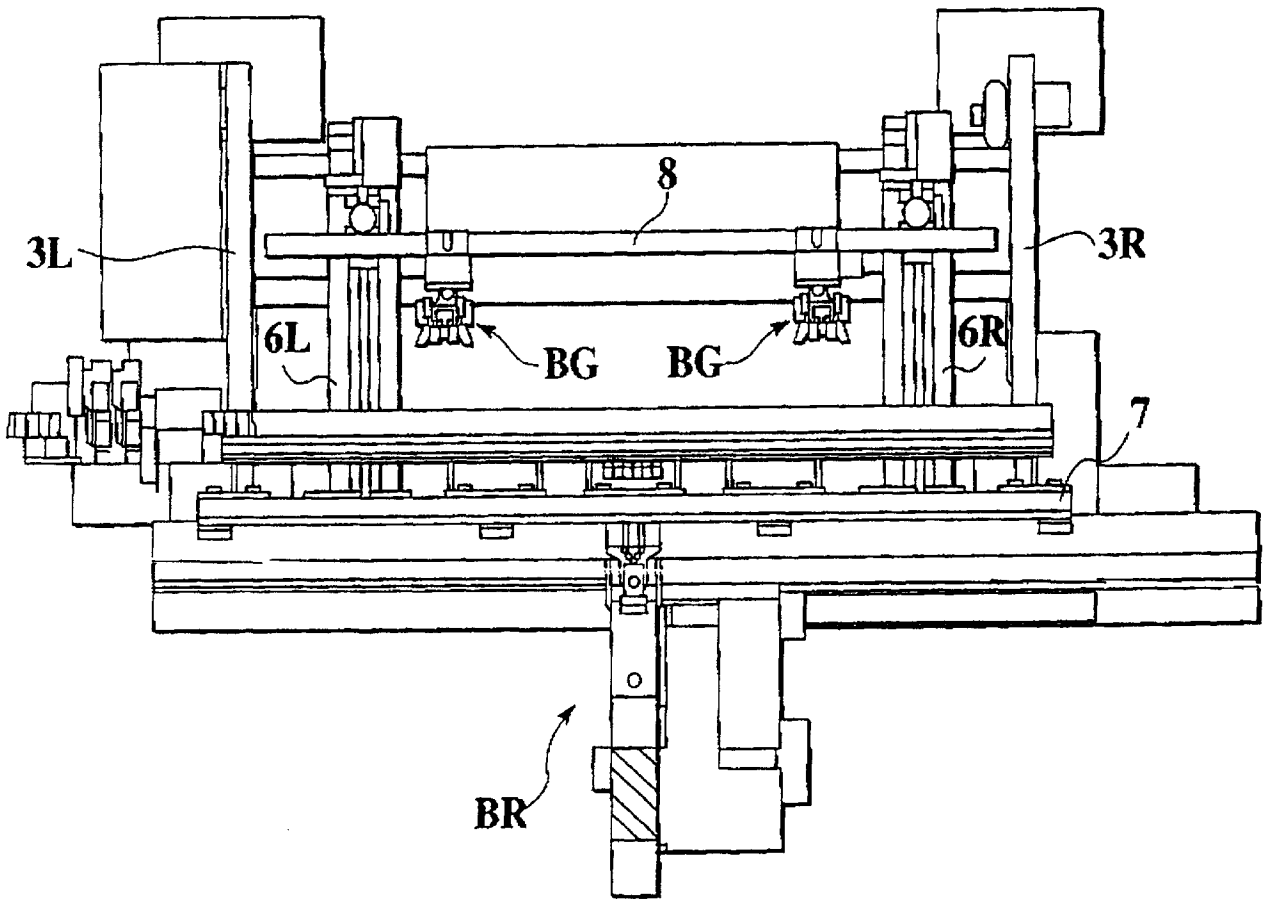
FIG. 2 illustrates the plan view of the press brake of the first embodiment viewed downward from the upper side.

A buck gauge BG (refer FIG. 2) for determining the front and rear direction position of the work in processing the plate form work by the upper and lower tools P, D mounted on the upper and lower tool holders 9, 11, is provided free to move and position in the front and rear direction (up and down direction in FIG. 2). As in common press brakes, this buck gauge is supported free to position in the left-right direction on a stretch 8. The right and left ends of the stretch 8 are supported free to move forward and backward by guides 6L, 6R provided on the back face of the table 7 horizontally in the forward and backward directions. As the support structure of the buck gauge is well known, details will be omitted.

Also in the front face of the lower table 7, a bending robot BR free to move in the left-right direction in order to supply and position the work automatically in between the upper and lower tools P, D mounted on a plurality of positions when the work is being bent. As the structure of the bending robot BR is already well known, details will be omitted.

Also on the front face of the upper table 5, a temporary work hold 10 is provided to hold the bent work temporarily. This temporary work hold 10 is provided with an upper and lower clamp jaw 10J to clamp and hold the work and an actuator 10A, such as a fluid pressure cylinder, for the upper and lower clamp jaws 10J and an elevation actuator 10B, such as a fluid cylinder, to move the work temporary hold 10 up and down.

This temporary work hold 10 may hold the work temporarily when the work held on the bending robot BR is changed, and by hold of the work temporarily by this temporary work hold 10, the bending robot BR may change hold of the work after reversing the front and back and/the upward and downward sides of the work. Thereby unmanned bending process of works in which the work is reversed may be realized easily.

Figure 6:
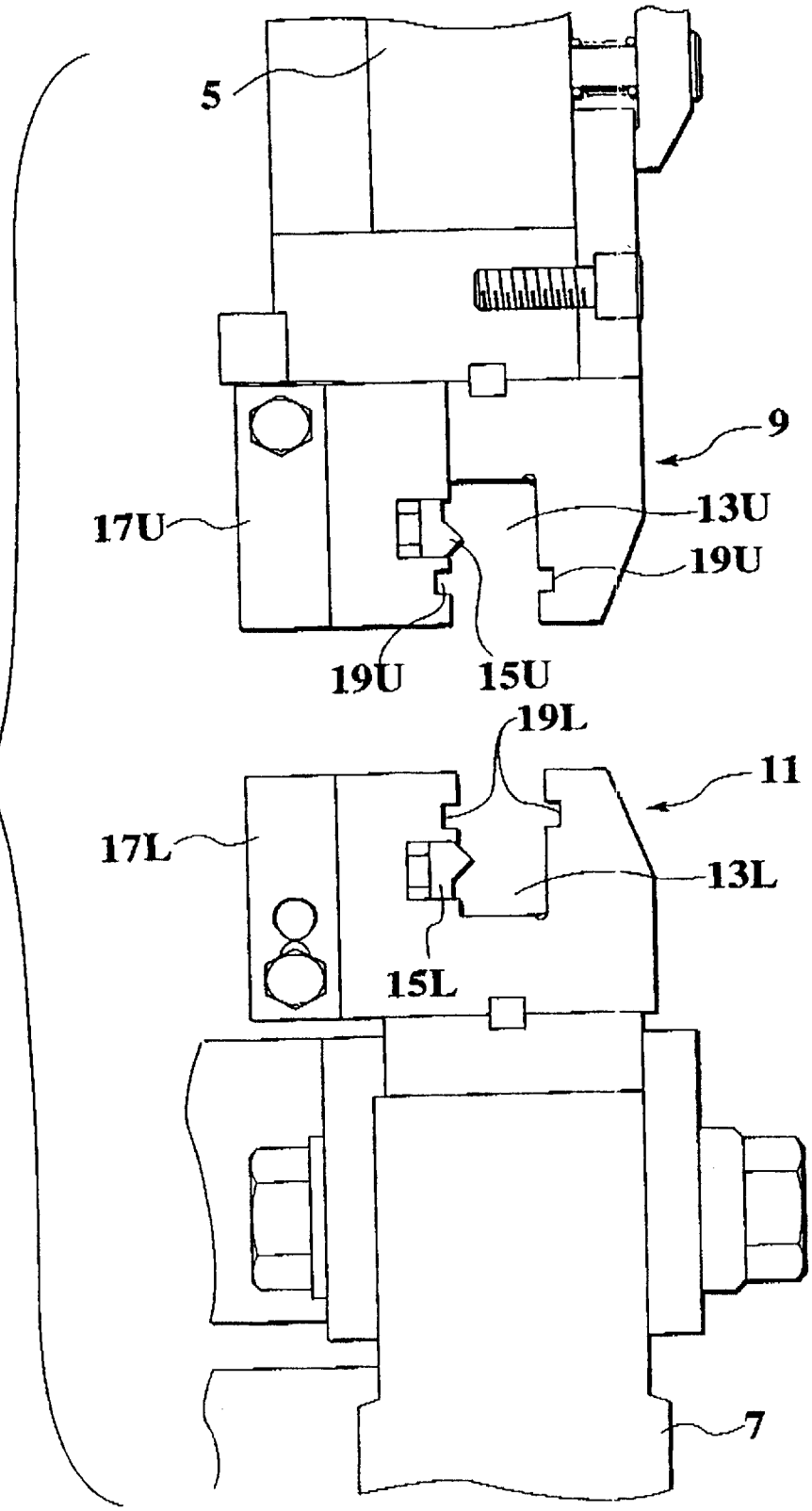
FIG. 6 is a detailed illustration of the upper and lower tool holders.

As shown in FIG. 6, on the tool holders 9, 11, long mounting grooves 13U, 13L are formed in the left-right directions (in FIG. 6 the directions perpendicular to the page face) to mount and dismount the upper and lower divided tools P, D (not shown in FIG. 6) freely. On one side of the walls in front or rear of the mounting grooves 13U, 13L, long lock pieces 15U, 15L are provided in the left-right directions so as to protrude and retract freely. Actuators 17U, 17L such as fluid pressure cylinders are provided as lock piece actuators to let the look piece 15 protrude and retract. Also on the walls front and rear of the mounting grooves 13U, 13L, long engage grooves 19U, 19L are formed in the left-right direction.

The upper and lower divided tools P, D which may be exchanged freely by mounting-dismounting to the upper and lower tool holders 9, 11 are arranged as follows. Here as the upper and lower divided tools differ only in the shape of the work processing part for processing the work, and as the arrangement of the shank part which acts as the mounting section to mount and dismount to the tool section 9, 11 is similar, the arrangement of the upper divided tools P will be described and the description of the divided lower tool D will be omitted.

Figure 7:
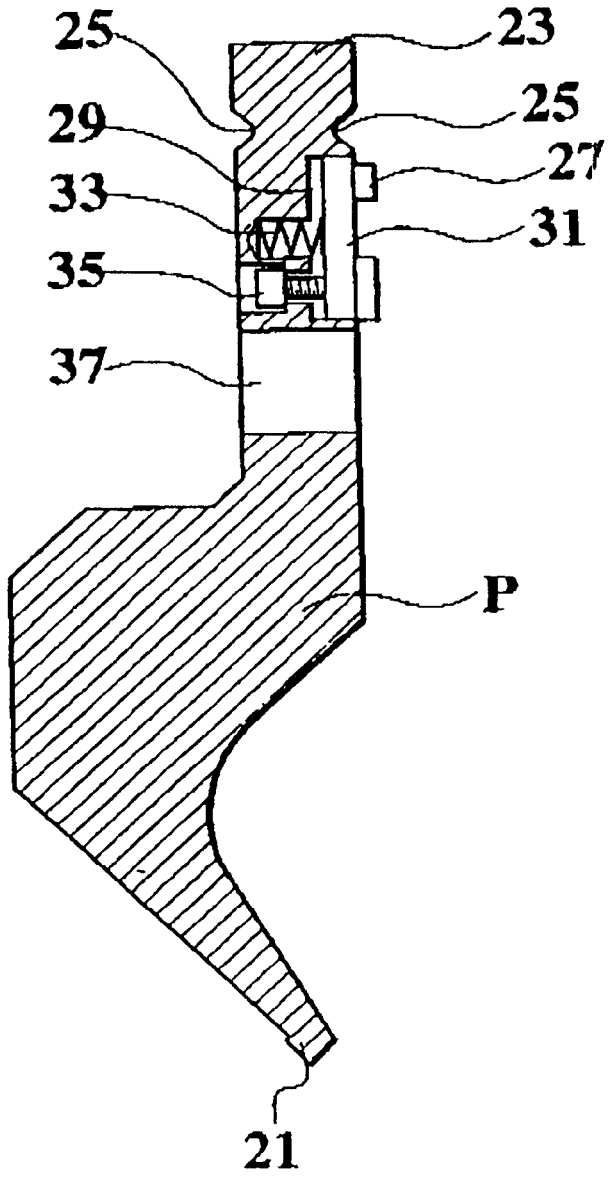
FIG. 7 illustrates the cross sectional view which shows the structure of the divided tool.

Now, as shown in FIG. 7, the divided upper tool P is provided with a work processing section 21 to process the work and a shank part 23 which may be freely engaged or disengaged, that is mounted or dismounted, from the mounting groove 13U of the tool holder 9. On the front and back faces of this shank part 23, a groove shaped concave engage part 25 free to engage the lock piece 15U is formed in the left-right direction (direction perpendicular to the page face in FIG. 7).

Also in the shank part 23 of the divided tool P, an engage piece (engage section) 27 which may be freely engaged onto and disengaged from the engage groove 19U formed on the wall of the mount groove 13U of the tool holder 9 so as to protrude and retract is provided. In more detail, a concave housing section 29 is formed on the front face or the back face of the shank part 23 and in this concave housing section 29, an engagement operating member 31 provided with the engage section (engage piece) 27 is inlayed free to move in the direction of the protrusion and retraction of the engage piece. And in between the engagement-operating member 31 and the bottom part of the concave housing section 29, an elastic member 33 like a spring is provided. With this material 33, the engagement operating part 31 is biased to the protruded direction. It is prevented from falling out of the concave housing section 29 by a stopper 35 provided on the engagement-operating member 31. Also, a passage hole 37 for letting the tool exchange device (not shown in the figure) pass through is bored through the shank part 23 of the divided tool P in the front to back direction.

With the arrangement, the shank part 23 of the upper and lower divided tools P, D are inserted in the mounting grooves 13U, 13L of the upper and lower tool holders, and the engage piece 27 provided on the shank part 23 is engaged with the engage grooves 19U, 19L of the mounting grooves 13U, 13L, and the lock pieces 15U, 15L are engaged with the concave engagement section 25 formed on the shank part, and the lock pieces 15U, 15L is pressed firmly by actuators 17U, 17L, so that the upper and lower divided tools P, D may be fixed on the mounting grooves 13U, 13L of the upper and lower tool holders 9, 11.

By pushing in the lock pieces 15U, 15L from the walls of the mounting grooves 13U, 13L by action of the actuators 17U, 17L, the locked upper and lower divided tools P, D (lock state) will be released. Thus, in this state the divided tools P, D may be moved in the left-right directions along the mounting grooves 13U, 13L. Next, by moving against the elastic force of the elastic member 33 the operational member 31 and releasing the engaged state of the engagement piece 27 and the engage grooves 19U, 19L of the mount grooves 13U, 13L, the upper and lower divided tools P, D can be mounted and dismounted from the mount grooves 13U, 13L in the upper and lower directions and interchanged with other divided tools P, D.

As understood already, the upper and lower divided tools P, D may be moved in the left-right directions in the engaged state of the shank part (mount part) 23 on the mounting groove 13U, 13L, and may be fixed and released from the mount groove 13U, 13L in the up and down directions.

In order to attach and detach a plurality of upper and lower divided tools P, D relative to the upper and lower tool holder 9, 11, an exchange tool support which detachably supports a plurality of upper and lower divided tools P, D is provided.

Figure 3:
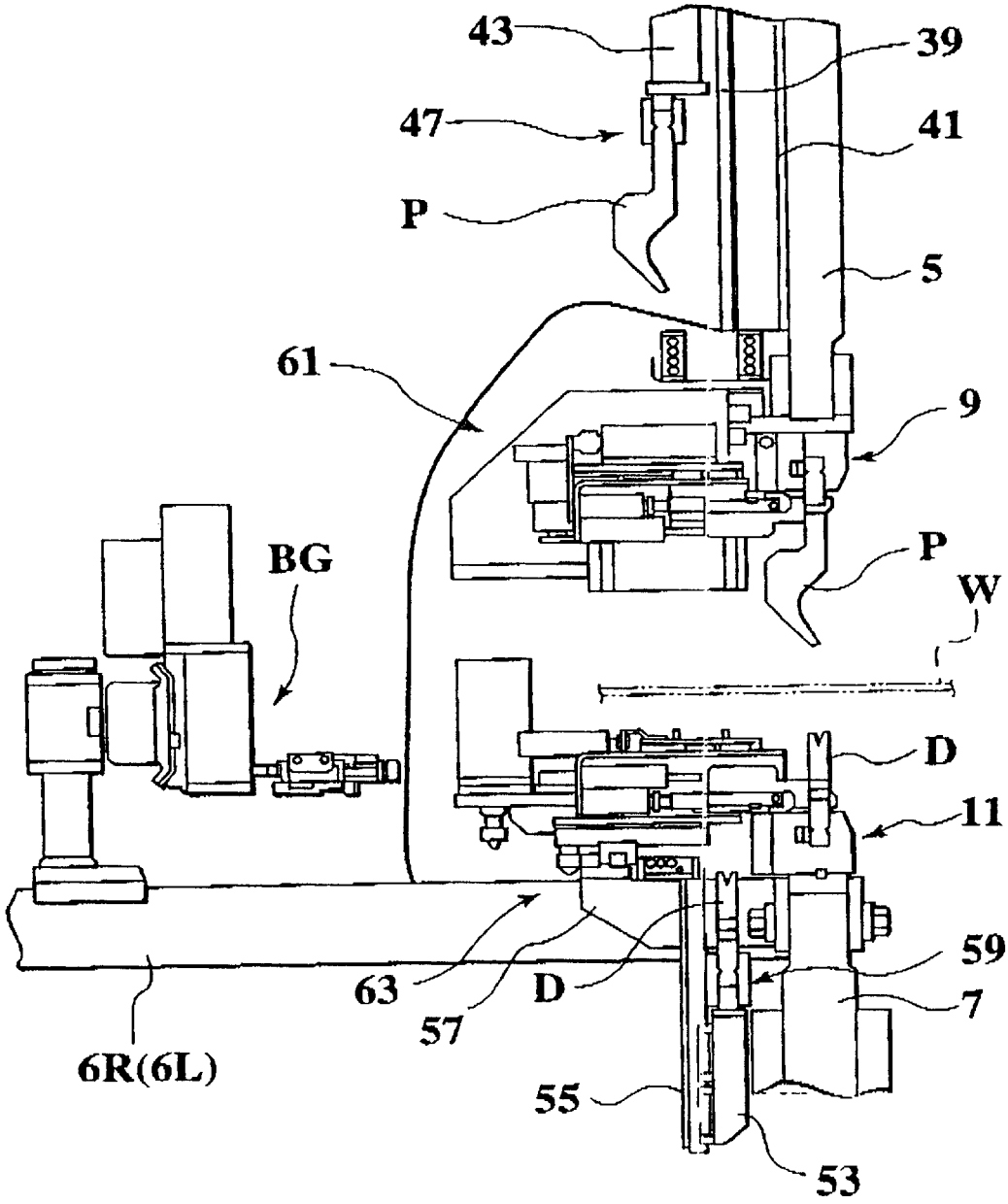
FIG. 3 illustrates the left side view of the upper and lower tables near the tool holder.
Figure 4:
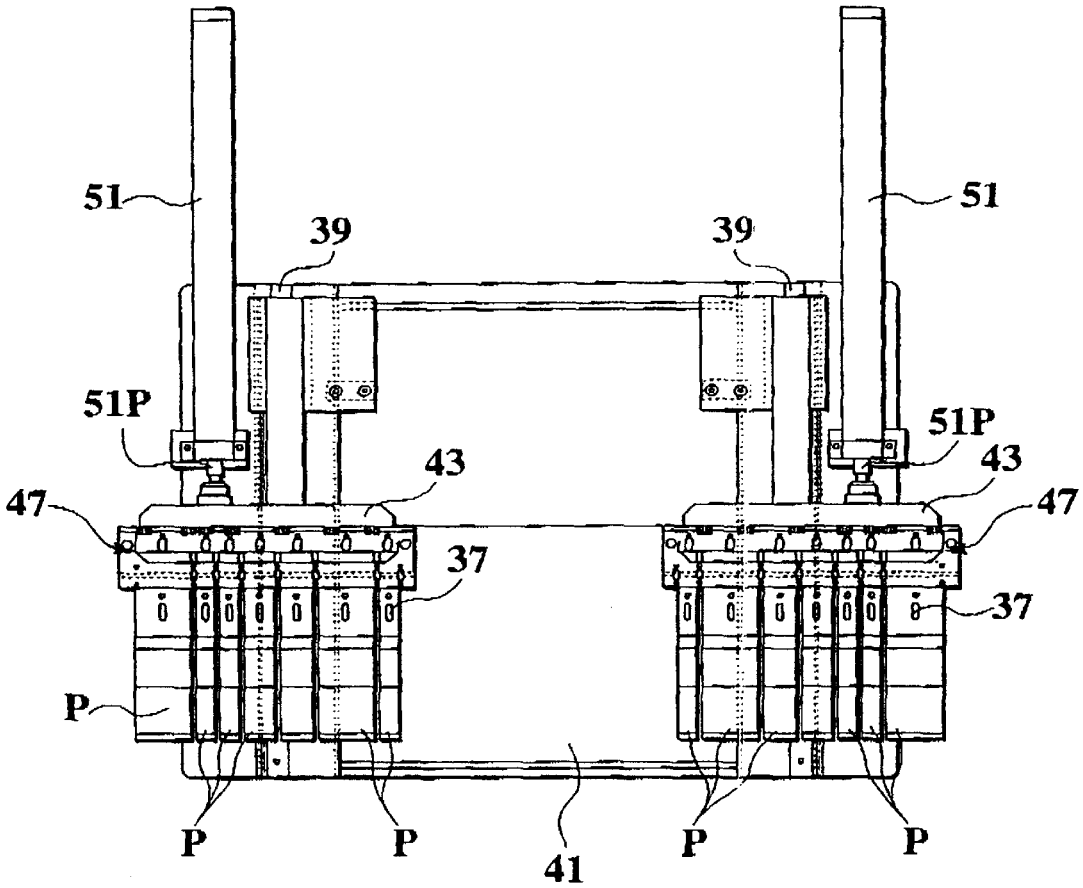
FIG. 4 illustrates the rear view of the exchange upper tool support.
Figure 5:
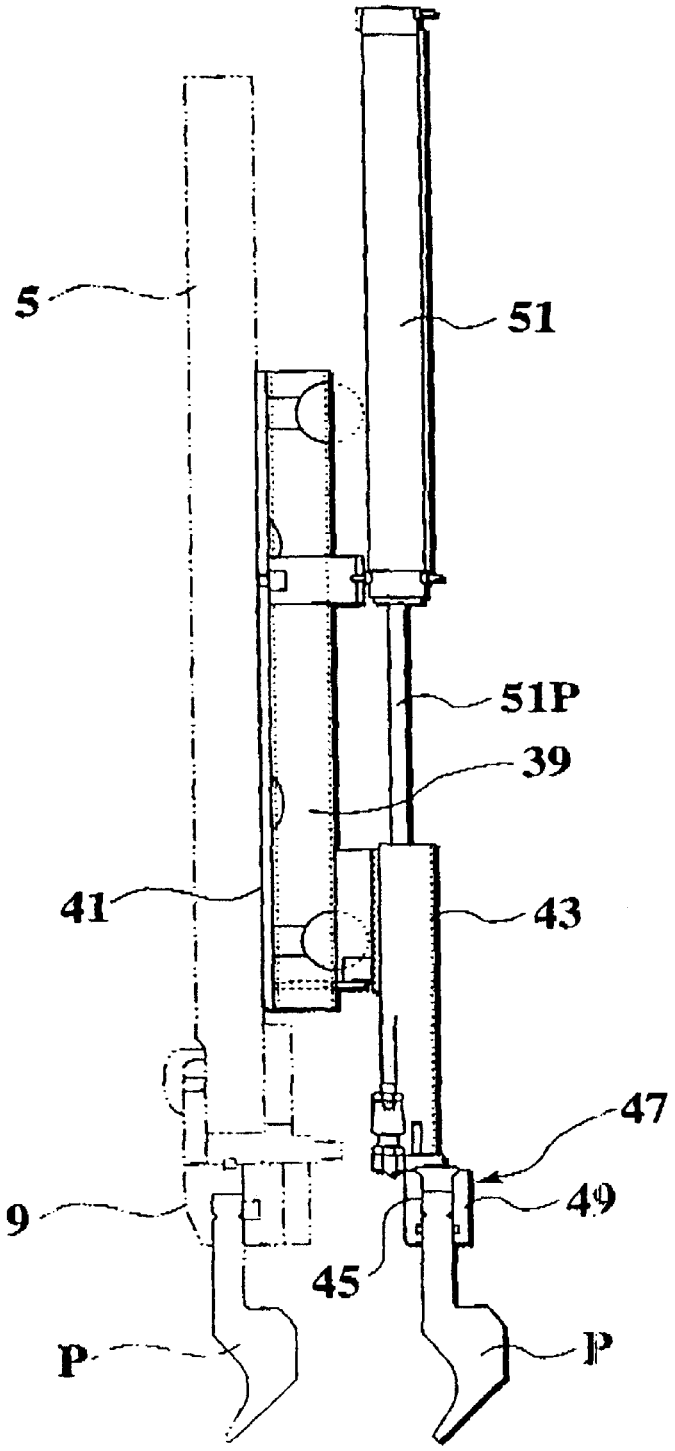
FIG. 5 illustrates the right side view of the exchange upper tool support.

In more detail, a base plate 41 with a guide rail 39 extending in the upward and downward direction is integrally attached to the back face of the upper table (in FIG. 3 the left side face, in FIG. 5 the right side face). And on the guide rail 39, an exchange upper tool support (exchange tool support) 43 that detachably supports a plurality of divided upper tools P, is supported free to move upwards and downwards.

In more detail, on the exchange upper tool support 43, as in the mounting groove 13U of the upper tool holder 9, a tool holder 47 provided with a tool holder groove 45 that supports a plurality of divided tools is integrally provided. Here an engagement groove 49 similar to the engagement groove 19U is formed. However, a structure that corresponds to the lock piece 15U is omitted so that the divided tool P may be attached or detached easily from the tool holder groove 45. In order to move the exchange upper tool support 43 upwards and downwards along the guide rail 39, an up-down actuator 51 in provided and an up-down movement member 51P such as a piston rod is connected to the exchange upper tool support 43.

With the arrangement, by operating the up-down actuator 51, the exchange upper tool support 43 may be moved up and down and, as shown in FIG. 3, when moving upwards, it will be positioned higher than the upper tool holder 9 of the upper table 5, and as shown in FIG. 5. when moving downwards, the position of the upper tool holder 9 of the upper table 5 and the tool holder 47 of the exchange upper tool support 43 will be at about the same height, and thereby facilitate the mount and dismount exchange operation between the upper tool holder 9 and the tool holder 47.

In order to exchange a plurality of divided lower tools D mounted on the lower tool holder 11, an exchange lower tool support (exchange tool support) 53 (see FIG. 3) which detachably supports a plurality of divided lower tools D is provided free to move upwards and downwards on the rear side of the table 7. In more detail, a guide rail 55 extending in the up-down direction is attached on the rear side of the lower table 7 by a bracket 57 and the exchange lower tool support 53 is supported free to move upwards and downwards on this guide rail 55. And on the upper part of this exchange lower tool support 53, there is provided a tool holder 59 that is symmetric to the tool holder 47 in the up and down direction. On the tool holder 59, a plural number of divided lower tools D are arranged neighboring each other in the left-right directions and supported detachably.

Now the upward and downward motion of the exchange lower tool support 53 is made by an ascend-descend actuator (not shown in the figure) such as a fluid pressure cylinder acting as an upward and downward operation device. And when descended, it will be positioned below the lower tool holder on the lower table 7 and when ascended, the height of the tool holder 59 will be approximately at the height of the lower tool holder 11 so that the attachment-detachment exchange operation between the tool holder 59 and the lower tool holder 11 may be made readily.

In order to perform the attach-detach exchange operation of the divided upper tool P between the upper tool holder 9 on the upper table 5 and the tool holder 47 of the exchange upper tool support 43 automatically, an upper tool exchange device 61 is provided on the rear side of the upper table 5. Also in order to perform attach-detach exchange operation of the divided lower tool D between the lower tool holder 11 on the lower table 7 and the tool holder 59 of the exchange lower tool support 53 automatically, a lower tool exchange device 63 is provided on the rear side of the lower table 7.

Figure 8:
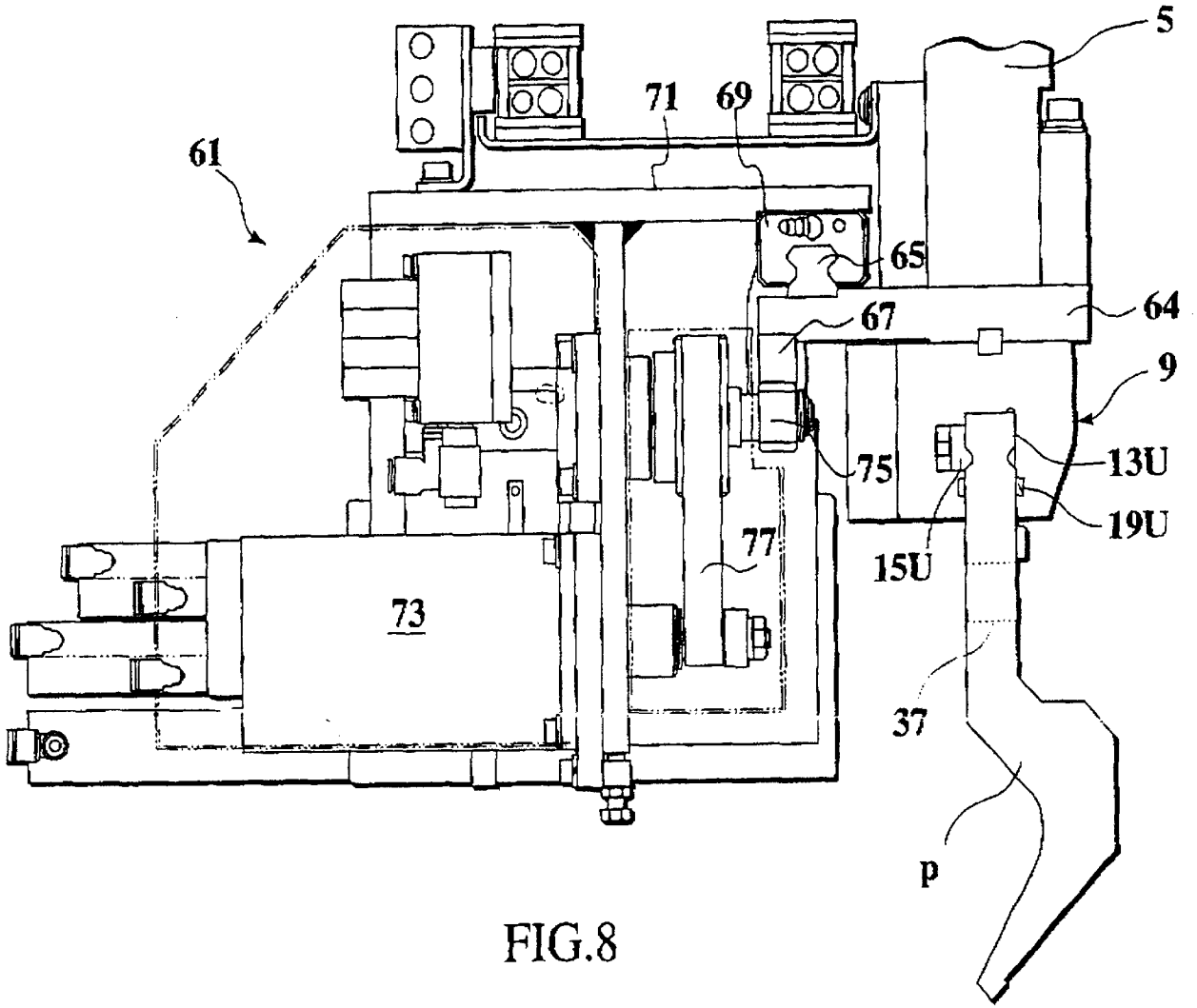
FIG. 8 illustrates the left side detail view of the upper tool exchange device.
Figure 10:
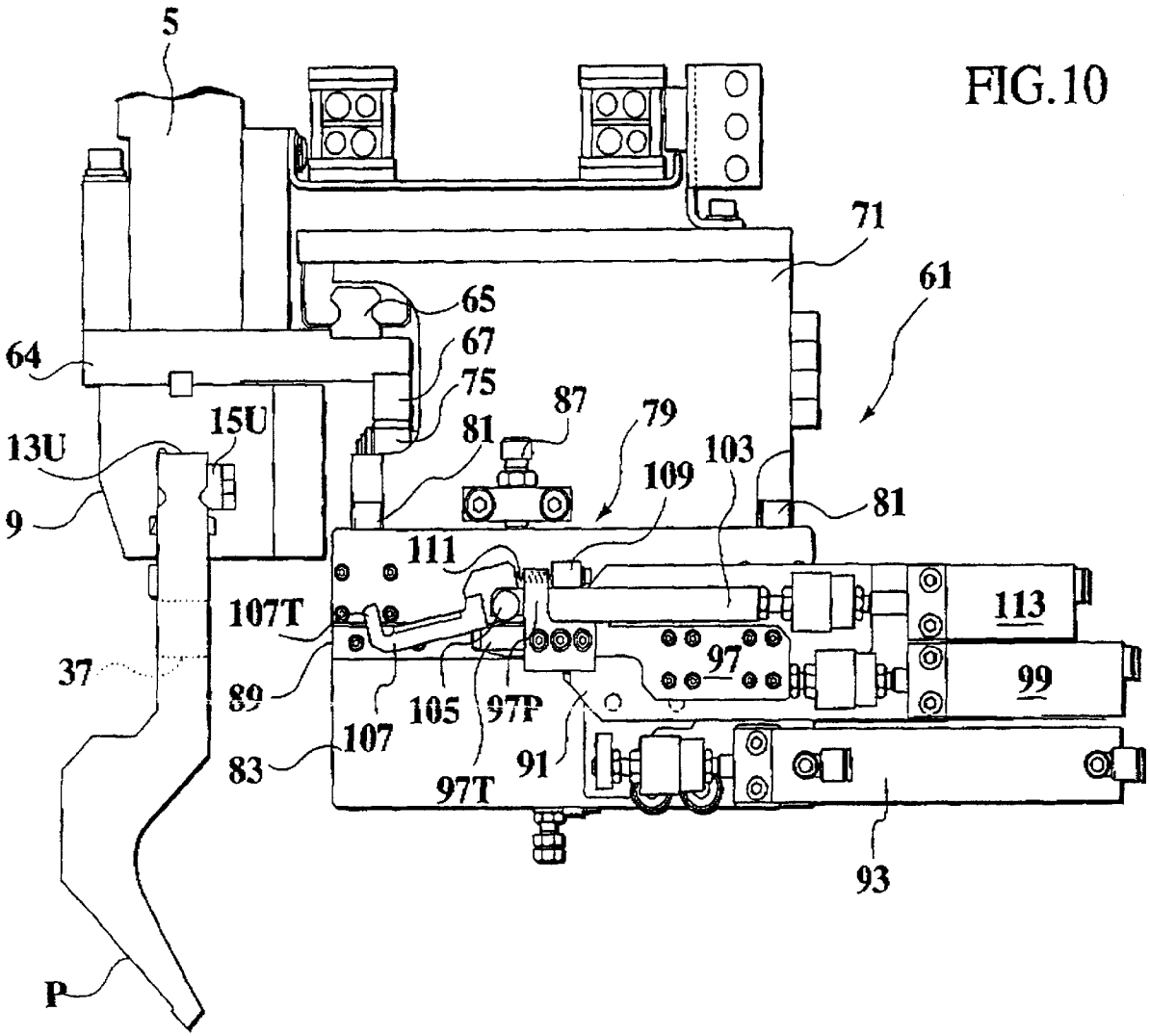
FIG. 10 illustrates the right side detail view of the upper tool exchange device.

In more detail, as shown in FIG. 8, FIG. 10, the upper tool exchange device (tool exchange device) 61 is supported on the upper table so that it may move freely in the left-right directions (direction perpendicular to the drawings in FIGS. 8, 10). That is, on the upper table 5, a guide base 64 elongated in the left-right directions is attached and a guide 65 and a rack 67 elongated in the left-right directions are attached to this guide base 64. And on the guide 65, a left-right slider 71 is supported free to move in the left-right directions by a plurality of slide member 69.

On the left-right slider 71, a servomotor 73 provided with a position detection sensor and a pulse encoder as a moving speed detection sensor is provided, and a pinion 75 engaged to the rack 67 is supported free to rotate. Also the servomotor 73 and the pinion 75 are geared together by a timing belt 77.

Thus by adequate controlled rotation of the servomotor 73, the left-right slider 71 may be moved along the guide 67 and positioned.

Also on the left-right slider 71, an attachment-detachment device 79 is provided to attach and detach and exchange the divided upper tool P from the mount groove 13U of the upper tool holder 9.

Figure 9:
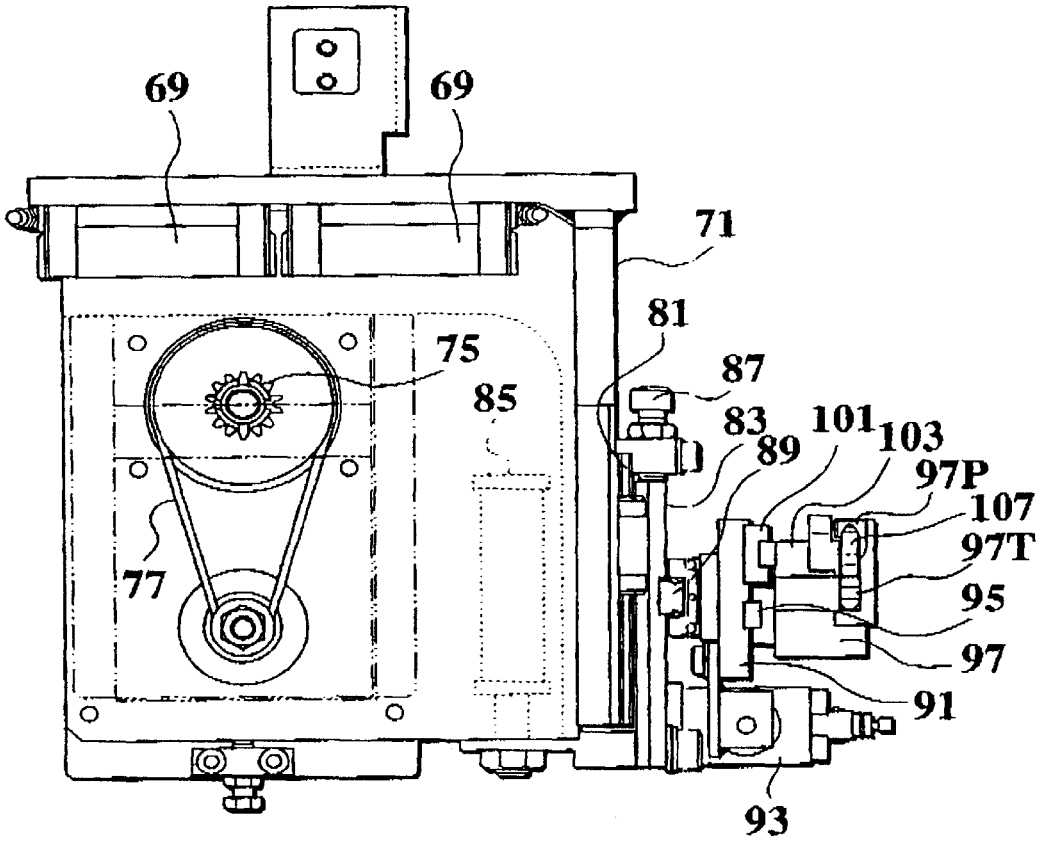
FIG. 9 illustrates the front detail view of the upper tool exchange device in detail.

In more detail, as shown in FIGS. 9, 10, guide members 81 extending upwards and downwards are provided on the side of the left-right slider 71 and on the guide members 81 an upward-downward slider 83 is supported free to ascend and descend. This upward-downward slider 83 may be made to ascend or descend by an up-down movement actuator 85 (see FIG. 9) such as, for example, a fluid pressure cylinder as the ascent-descent movement device mounted on the left-right slider 71. The slider 83 is arranged so that the ascended position may be determined accurately by engaging it with a stopper 81 such as an adjustment bolt, which is provided on the upper and lower sides of the left-right slider 71 so as to be adjustable in the vertical direction.

On the upward-downward slider 83, a guide member 89 extending in the front-rear direction (direction perpendicular to the drawing in FIG. 9 and the left-right direction in FIG.

10) is provided and a front-rear slider 91 to supported on this guide member 89 free to move in the front-rear direction. This front-rear slider 91 is arranged so that it may be moved in the front-rear directions by a front-rear movement actuator 93 such as the fluid pressure cylinder supported by the upward-downward slider 83.

On the front-rear slider 91, a guide member 95 is provided in the front-rear direction, and on the guide member 95 a hook support 97 that may move freely in the front-rear direction is supported. The tip 97T of this hook support 97 may be freely inserted into the insertion hole 37 formed on the divided upper tool P and is formed in a wedge shaped form. Also on the hook support 97, an abut protuberance 97P is provided which abuts one of the front or rear sides of the divided upper tool P when the tip 97T is inserted in the insertion hole 37.

Moreover the forward-rear motion of the hook support 97 is made by a front-rear motion actuator 99 such as a fluid pressure cylinder mounted on the front-rear slider 91.

Furthermore, on the front-rear slider 91, a guide member 101 (see FIG. 9) extending in the front-rear direction is provided near the guide member 95. On this guide member 101, a hook attachment member 103 free to move in the front-rear directions while contacting the upper surface of the hook support 97 to supported free to move in the front-rear directions.

And on the tip of the hook attachment 103, a hook 107 is supported by an axis 105 so as to swing freely upwards and downwards. In between this hook 107 and a spring seat 109, an elastic member 111 is elastically mounted so that the hook 107 is urged to the anticlockwise direction (downwards) in FIG. 10. Thus in the normal state the hook 107 is inclined downwards and abuts to the tip 97T of the hook support 97. The look 107 may be freely inserted in the insertion hole 37 formed on the divided upper tool P. Its tip 107T is curved so that by passing through the insertion hole 37 and pulling, it may freely abuts to other sides in front or rear of the divided upper tool P. Also the hook attachment 103 is arranged so that it may be moved back and forth by an actuator 113 such as the fluid pressure cylinder for hook motion mounted on the back and forth slider 91.

The tip 97T of the hook support 97 and the hook 107 may constitute a tool retention section that retains the divided tool P by engaging the insertion hole 37 of the divided tool P. The abut tip 97P and the tip 107T of the hook 107 may constitute a manipulation section to operate the engagement operation member 31 provided on the divided tool P.

The structure of the main parts of the lower tool exchange device 63 is practically symmetric to the upper tool exchange device 61. Thus as the explanation will be duplicated, detailed description of the structure of the lower tool exchange device 63 will be omitted.

The operation of attach-detach exchange of the divided upper tool P between the upper tool holder 9 of the upper table 5 and the tool holder 47 of the exchange upper tool support 41 by the upper tool exchange device 61 in the structure described above will be explained. As the attach-detach exchange of the divided lower tool D between the lower tool holder 11 on the lower table 7 and the tool holder 59 of the exchange lower tool support 53 by the lower tool exchange device 63 is similar to the attach-detach exchange of the divided upper tool P by the upper tool exchange device 61, explanation of the attach-detach of the divided lower tool D will be omitted.

Figure 11:
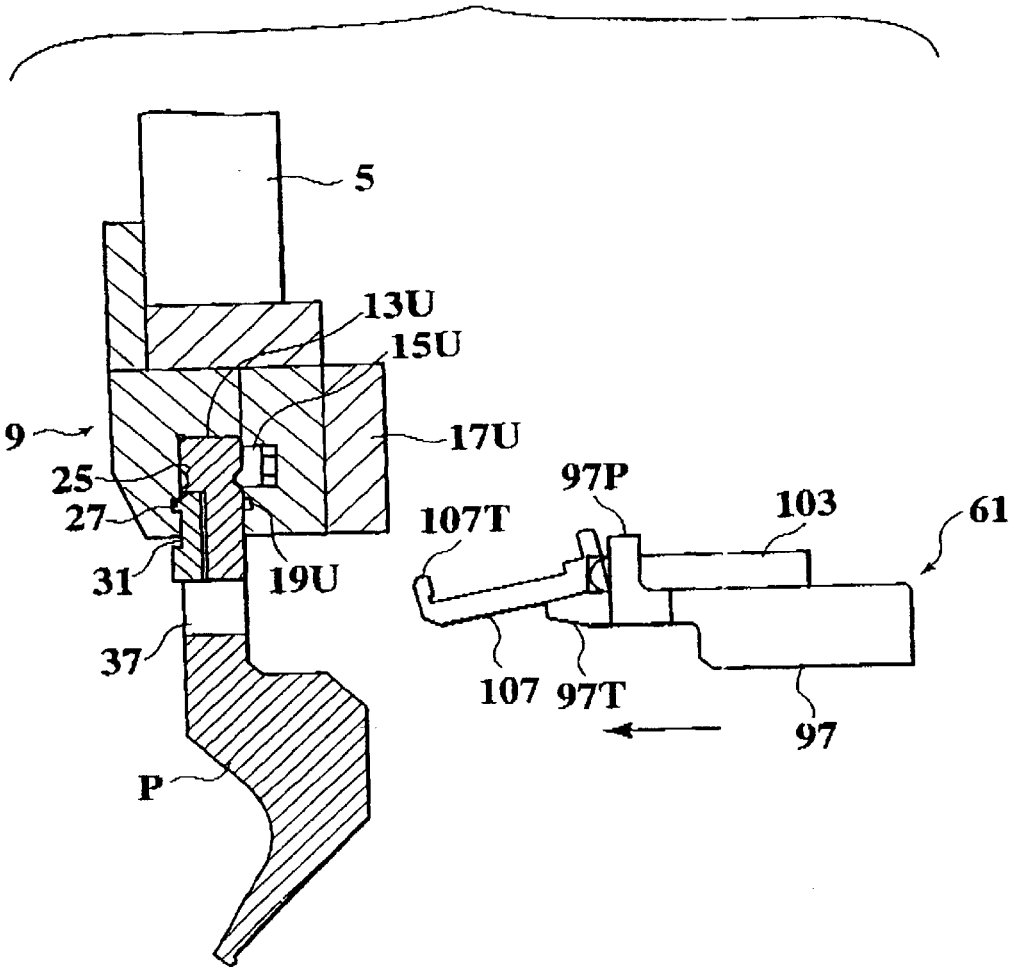
FIG. 11 illustrates the attachment and detachment exchange action by the upper tool exchange device on the upper tool holder.

As shown roughly in FIG. 11, in order to automatically demount the divided upper tool P mounted and fixed on the upper tool holder 9 on the upper table 5, and to move and mount it on the tool holder 47 of the exchange upper tool support 43, firstly, by controlled drive of the servo motor 73, the left-right slider 71 positioned at the origin near the end part of the guide member 65 is moved in the left-right direction along the guide 61 and positioned at the position of the divided upper tool P to be removed.

Figure 12:
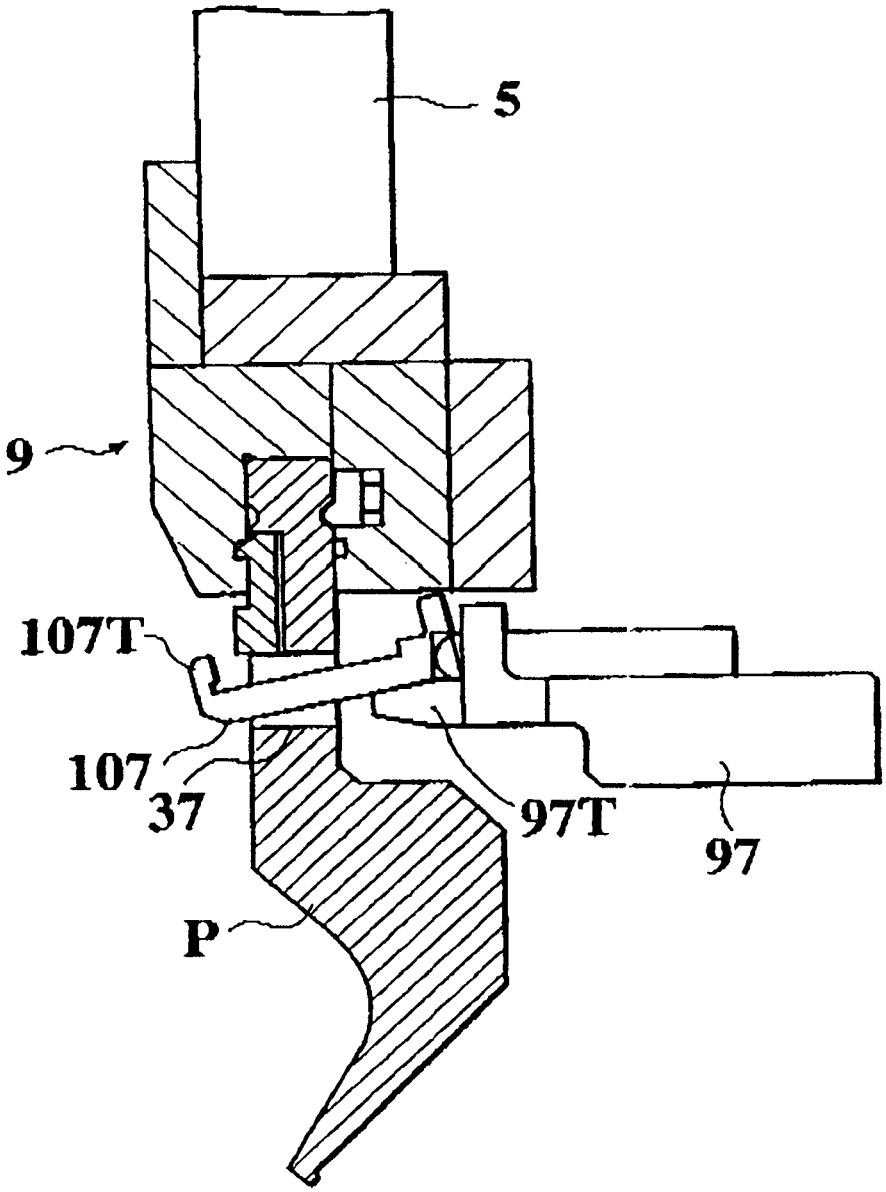
FIG. 12 illustrates the attachment and detachment exchange action by the upper tool exchange device on the upper tool holder.

Next the back and forth actuator 93 is operated and the back and forth slider 91 is moved in the direction (forward direction) to close to the divided upper tool P and the hook 107 is inserted into the insertion hole 37 so that the tip part 107T protrudes from the opposite side (front side) (see FIG. 12).

Figure 13:
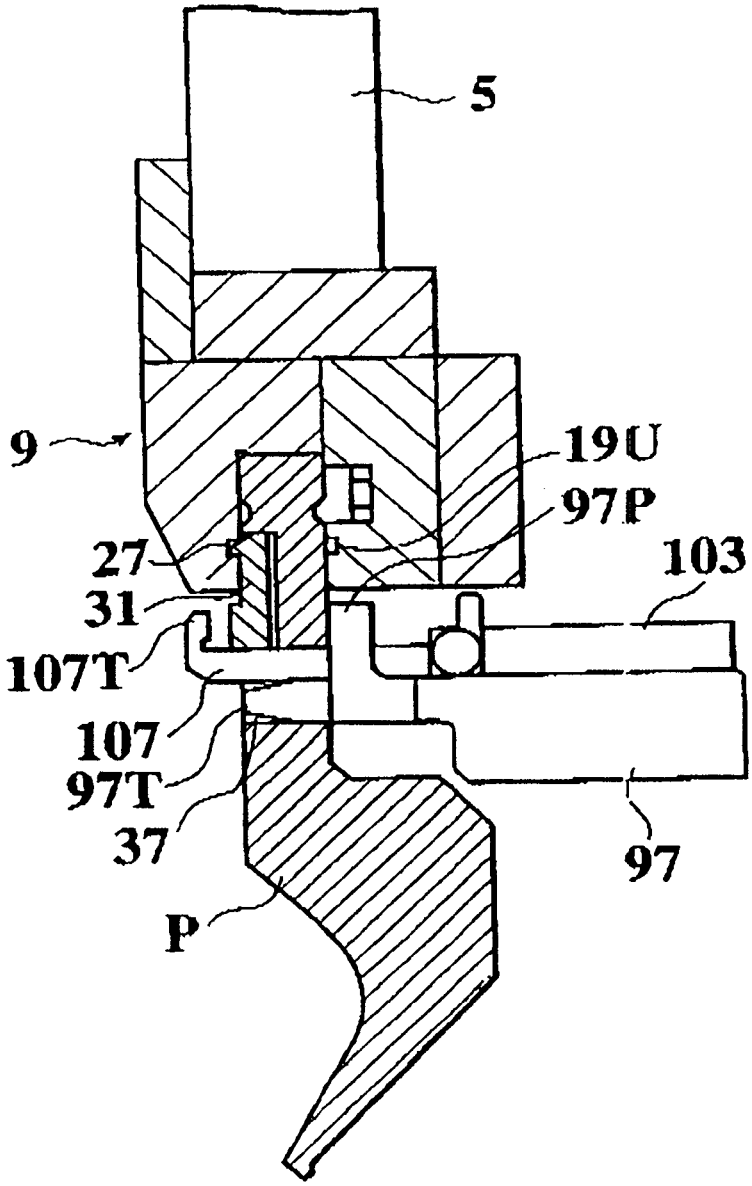
FIG. 13 illustrates the attachment and detachment exchange action by the upper tool exchange device on the upper tool holder.

The actuator 99 is then operated to insert the tip part 97T of the hook support part 97 into the insertion hole 37 and abut the abut tip 97P to one of the front or rear sides of the divided upper tool P (see FIG. 13).

In this way, upon insertion of the tip part 97T of hook support part 97 into the insertion hole 37, both the hook 107 and the tip part 97T will bet positioned at the insertion hole 37, and by engaging them with little play between the insertion hole 37, the divided upper tool P may be held in a retainable state. Thus, when the divided upper tool P is removed from the upper tool holder 9, the divided upper tool P may be retained securely with no sway.

Figure 14:
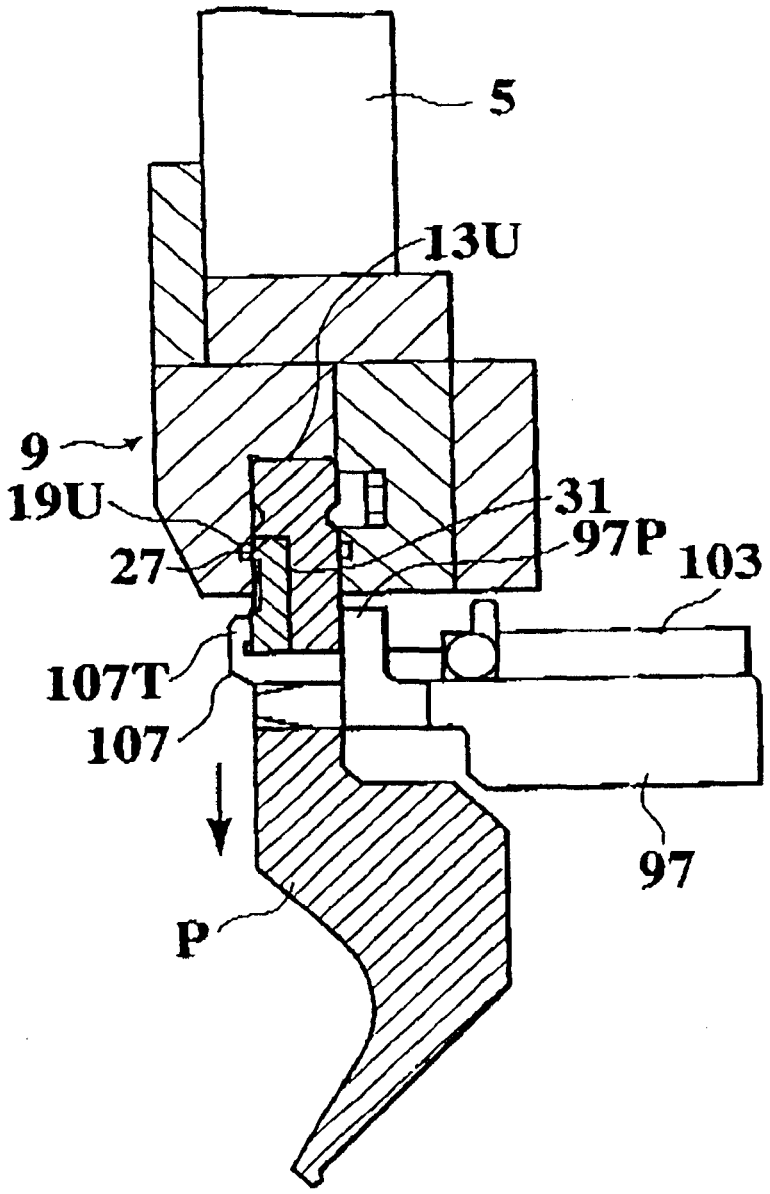
FIG. 14 illustrates the attachment and detachment exchange action by the upper tool exchange device on the upper tool holder.

Next the actuator 113 for the hook movement is operated so that the hook attachment 103 is pulled to the right (to the rear) in FIG. 13. Then, as the tip 107T of the hook 107 will push the engage action part 31 against the elastic member 33, the engagement of the engagement part 27 provided on the engage action part 31 with the engagement groove 19U on the mount groove 13U will be released. And the front and rear sides of the divided tool P is held in between the abut protrusion 97P of the hook part 97 and the tip 107T of the hook (see FIG. 14).

Figure 15:
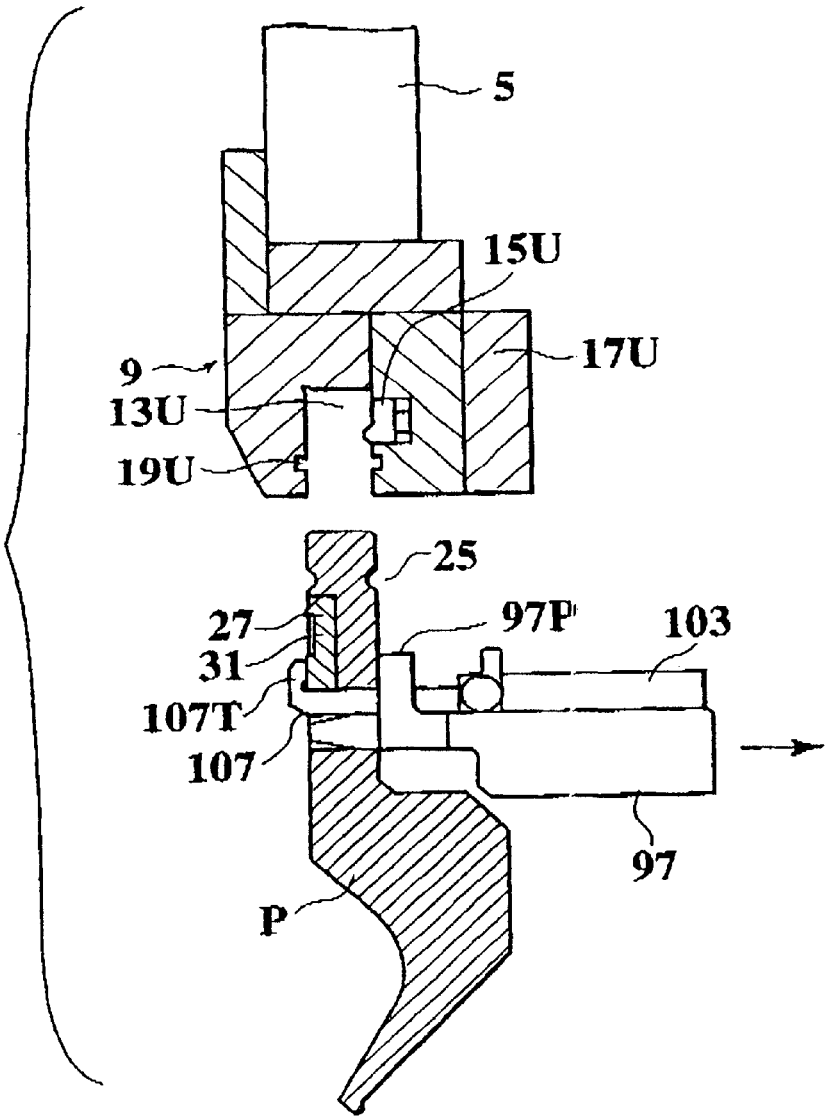
FIG. 15 illustrates the attachment and detachment exchange action by the upper tool exchange device on the upper tool holder.

Thereafter, by retracting the lock piece 15U by operating the actuator 17U, the engagement of the concave engagement part of the divided upper tool P and the lock piece 15U will be released. Then the fixed mount state (locked state) of the divided upper tool P on the mount groove 13U of the upper tool 9 will be released. Then by lowering the up-down slider 83 by operating the up-down actuator 85 of the upper tool exchange device 61, the divided upper tool P may be removed downwards from the mount groove 13U (see FIG. 15).

Figure 16:
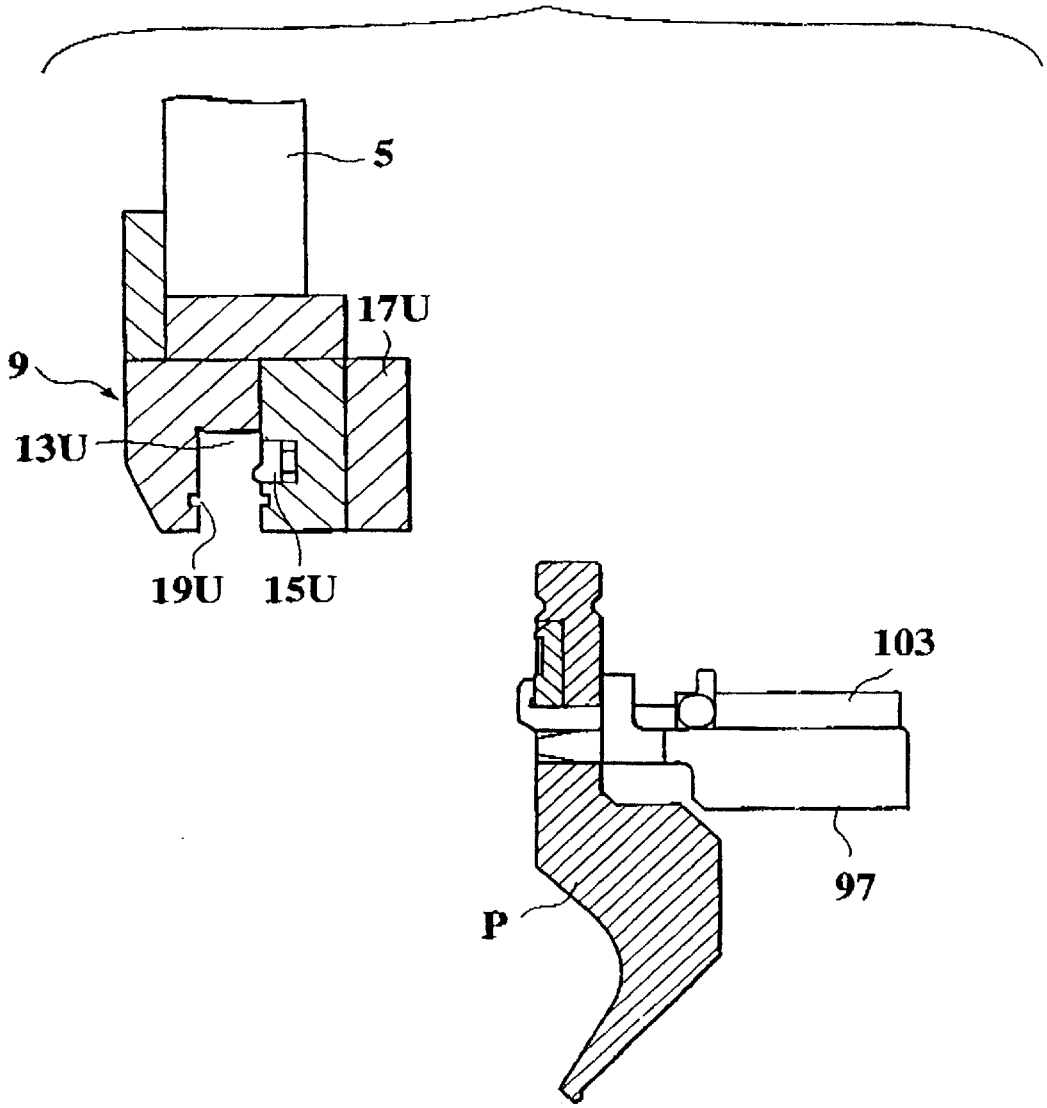
FIG. 16 illustrates the attachment and detachment exchange action by the upper tool exchange device on the upper tool holder.

After removing the divided upper tool P downwards, by moving the front-back slider 91 backwards by operating the front-back movement actuator 93, the divided upper tool P may be moved to the rear side direction of the upper table 5 (see FIG. 16).

Figure 17:
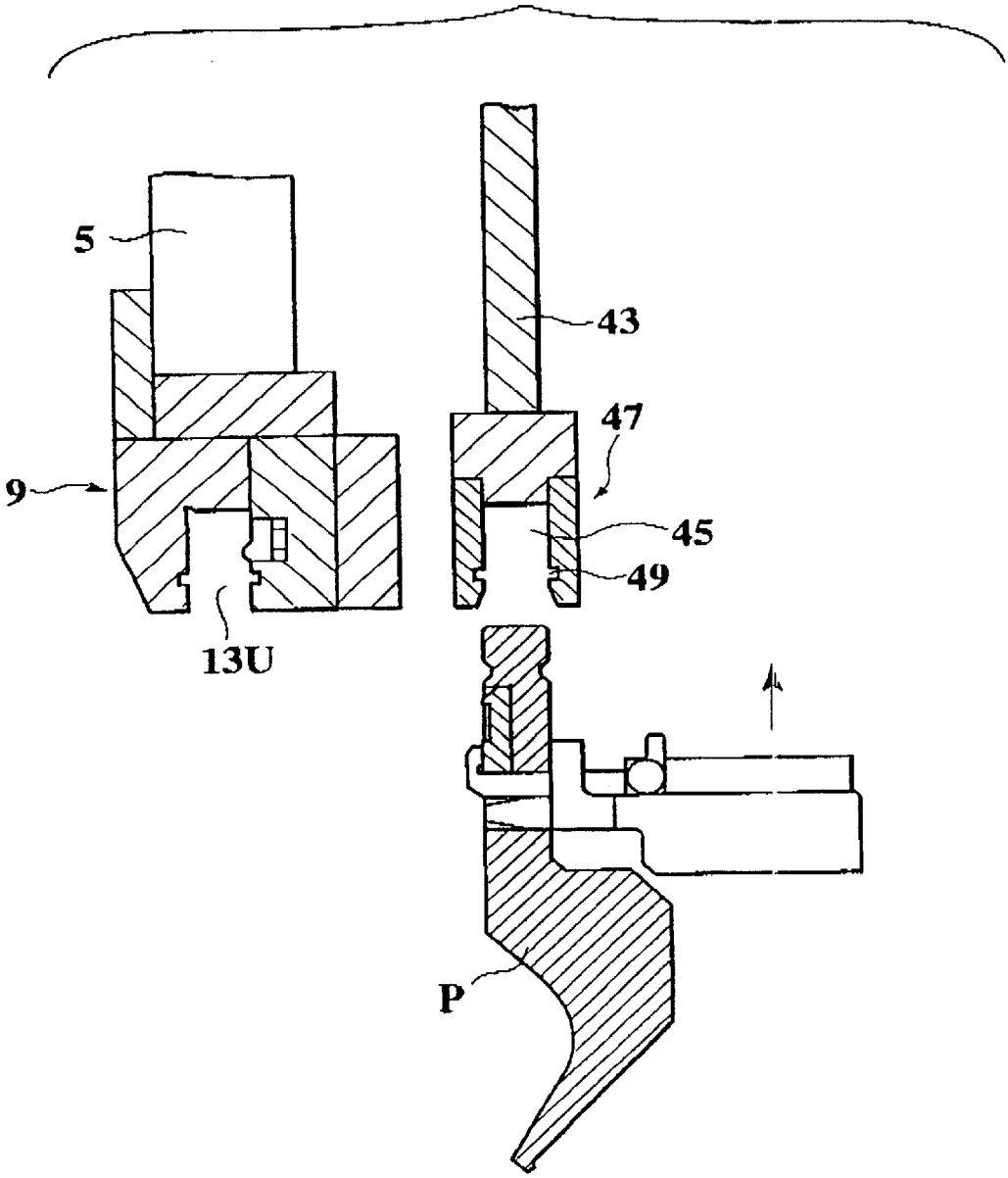
FIG. 17 illustrates the attachment and detachment exchange action by the upper tool exchange device on the upper tool holder.

If together with moving the divided upper tool P backwards on the upper table 5 as described above and also positioning it at the necessary position by moving it in the left-right directions, the exchange upper tool holder 43 is lowered, the tool holder 47 of the exchange upper tool support 43 may be positioned at the same height as the upper tool holder 49 of the upper table 5 and will be brought in a state where the divided upper tool P and the upper tool holder 47 oppose each other upwards and downwards (see FIG. 17).

Figure 18:
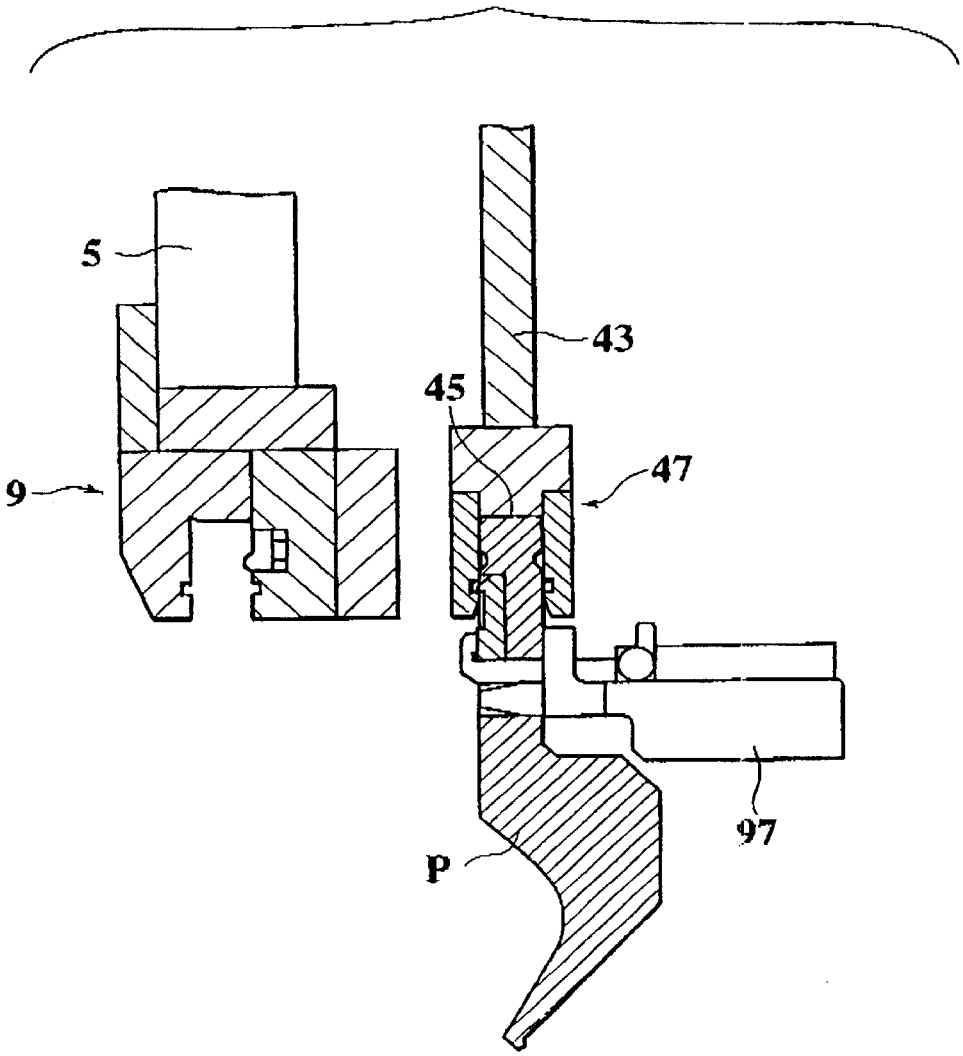
FIG. 18 illustrates the attachment and detachment exchange action by the upper tool exchange device on the upper tool holder.

Thereafter, if the up-down slider 83 is elevated by operating the up-down actuator 85 on the upper tool exchange device 61, the shank part of the divided upper tool P will be engaged to the tool holder groove 45 of the tool holder 47 (see FIG. 18).

Figure 19:
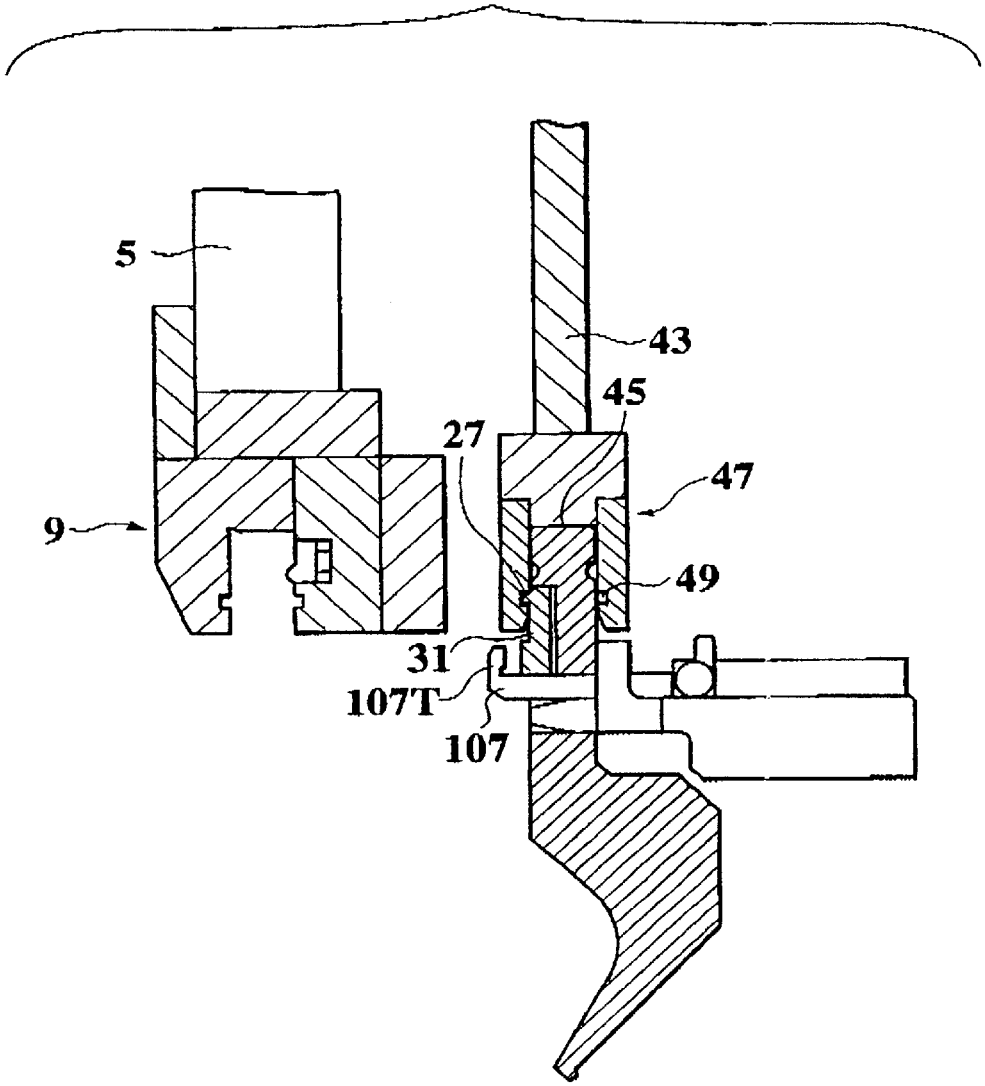
FIG. 19 illustrates the attachment and detachment exchange action by the upper tool exchange device on the upper tool holder.

After engaging the divided upper tool P on the tool mounting groove 45 as described above, when the pressure on the engage action part 31 by the tip 107T of the hook 107 is removed, the engage action part 31 will protrude by the action of the elastic member 33 and the engagement piece 27 provided on the engage action part 31 will engage the engagement groove 49 of the tool holder groove 45 (see FIG. 19).

Figure 20:
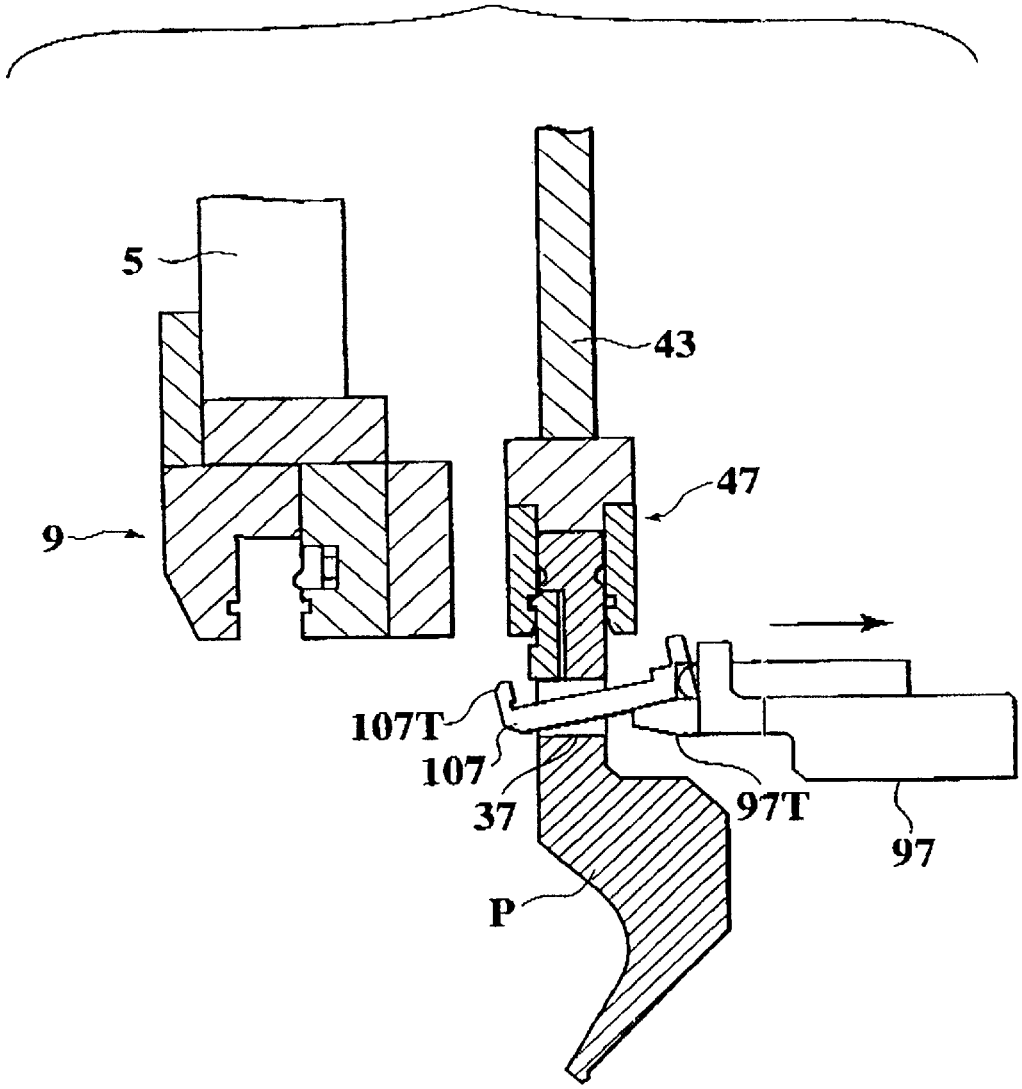
FIG. 20 illustrates the attachment and detachment exchange action by the upper tool exchange device on the upper tool holder.

Next, when the tip 97T of the hook support part 97 is drawn out of the insertion hole 37 of the divided upper tool P, the tip 107T of the hook 107 will be inclined downwards by the action of the elastic member 111 making it possible to draw out the hook 7 from the insertion hole 37 of the divided upper tool (see FIG. 20).

Figure 21:
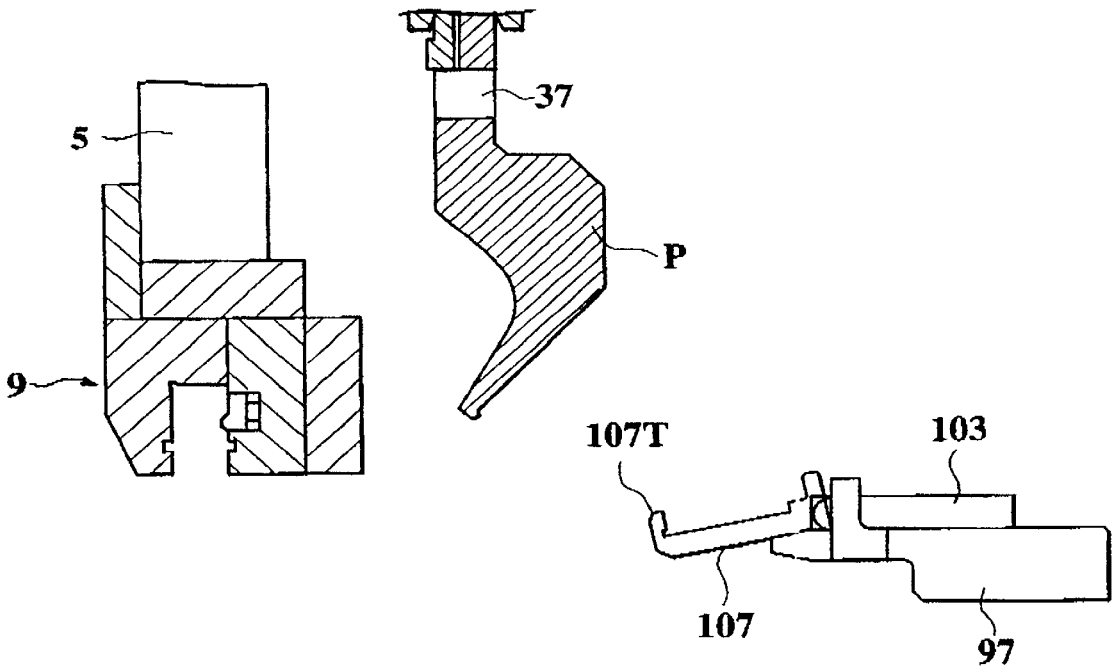
FIG. 21 illustrates the attachment and detachment exchange action by the upper tool exchange device on the upper tool holder.

Thereafter, by extracting the hook 107 from the insertion hole 37 of the divided upper tool P, the exchange upper tool support part 43 may be moved upwards to its original position (refer FIG. 21).

Figure 22:
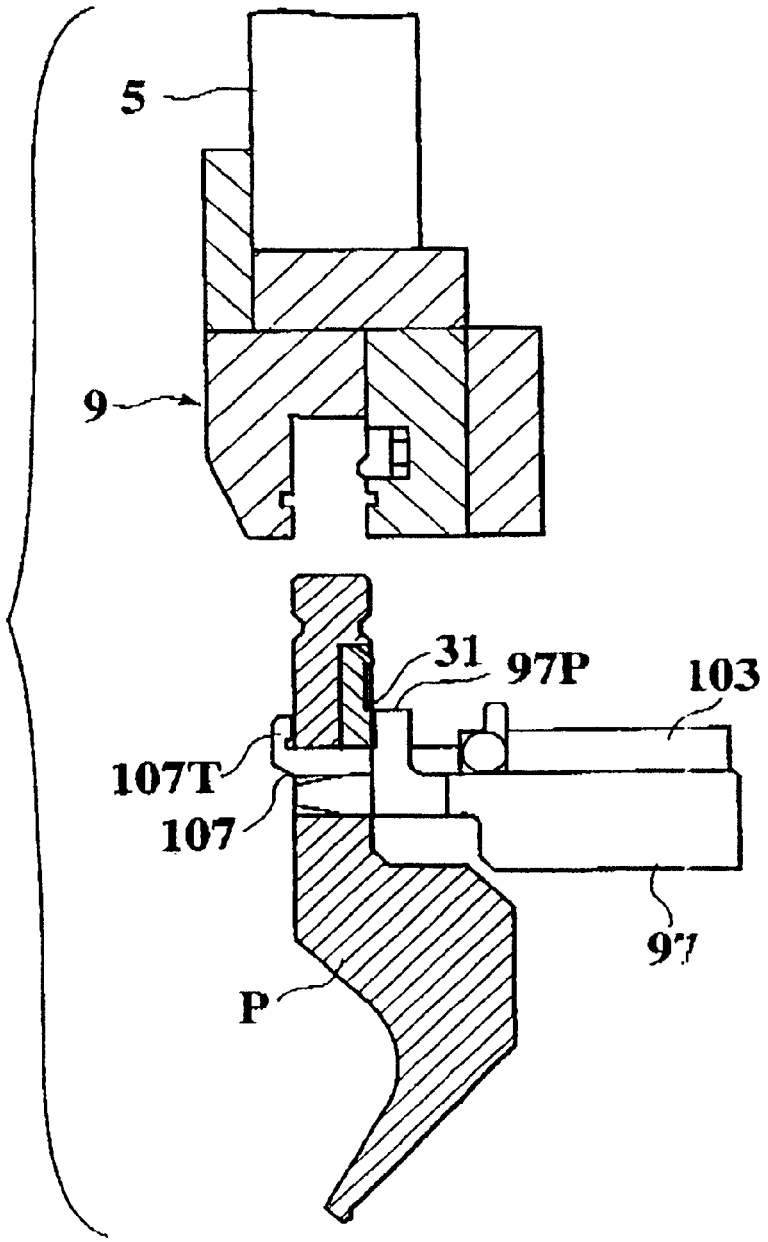
FIG. 22 illustrates the exchange action for the divided tool with its front and rear being reversed.

When mounting the divided upper tool P supported by the exchange upper tool holder 43 onto the upper tool holder 9 of the upper table 5, the divided upper tool P may be mounted and demounted and exchanged between the exchange upper tool support 43 and the upper table 5 by reversing the action described above. Also, as shown in FIG. 22, as the engage action part 31 may be operated by the pressure of the abut protrusion part 97P of the hook support part 97, there is no problem in reversing the front and rear of the divided upper tool P. Also this may also be used for the divided lower tool D.

It in understood already that by the upper tool exchange device 61, the divided upper tool P may be mounted, demounted and exchanged automatically between the upper tool holder 9 of the upper table 5 and the tool holder 47 of the exchange upper tool support 43, and that the divided upper tool P may be mounted on the upper tool holder 9 of the upper table 5 at an arbitrary position in the left and right directions. Similarly by the lower tool exchange device 63, the divided lower tool D may be mounted, demounted and exchanged automatically between the lower tool holder 11 of the lower table 7 and the tool holder 59 of the exchange lower tool support 53 and that the divided lower tool D may be mounted on the lower tool holder 11 of the lower table 7 at an arbitrary position in the left and right directions.

Thus, as shown in FIG. 1, a plurality of upper and lower divided tools P, D may be arranged over a desired length on a plurality of positions in left and right directions of the upper tool holder 9 of the upper table 5 and the lower tool holder 11 of the upper table 7. That is, a plurality of processing stations 115A, 115B, 115C may be provided on a plurality of positions in left and right directions of the upper and lower tables 5, 7, and by an appropriate combination of a plurality of upper and lower divided tools P, D, the length of each processing station 115A, 115B, 115C in the left and right direction may be made to a length which corresponds to the bending line length of the work.

When using a combination of divided tools P, D as described above, as illustrated at the processing stations 115A, 115B, divided tools P, D with small widths in the left-right direction are arranged in between divided tools P, D with large widths in the left-right direction. By arranging the divided tools P, D with small widths in between the divided tools P, D with large widths, trace of the connecting part of the divided tools P, D will not appear on the work and the external appearance of the product will be improved.

Figure 23:
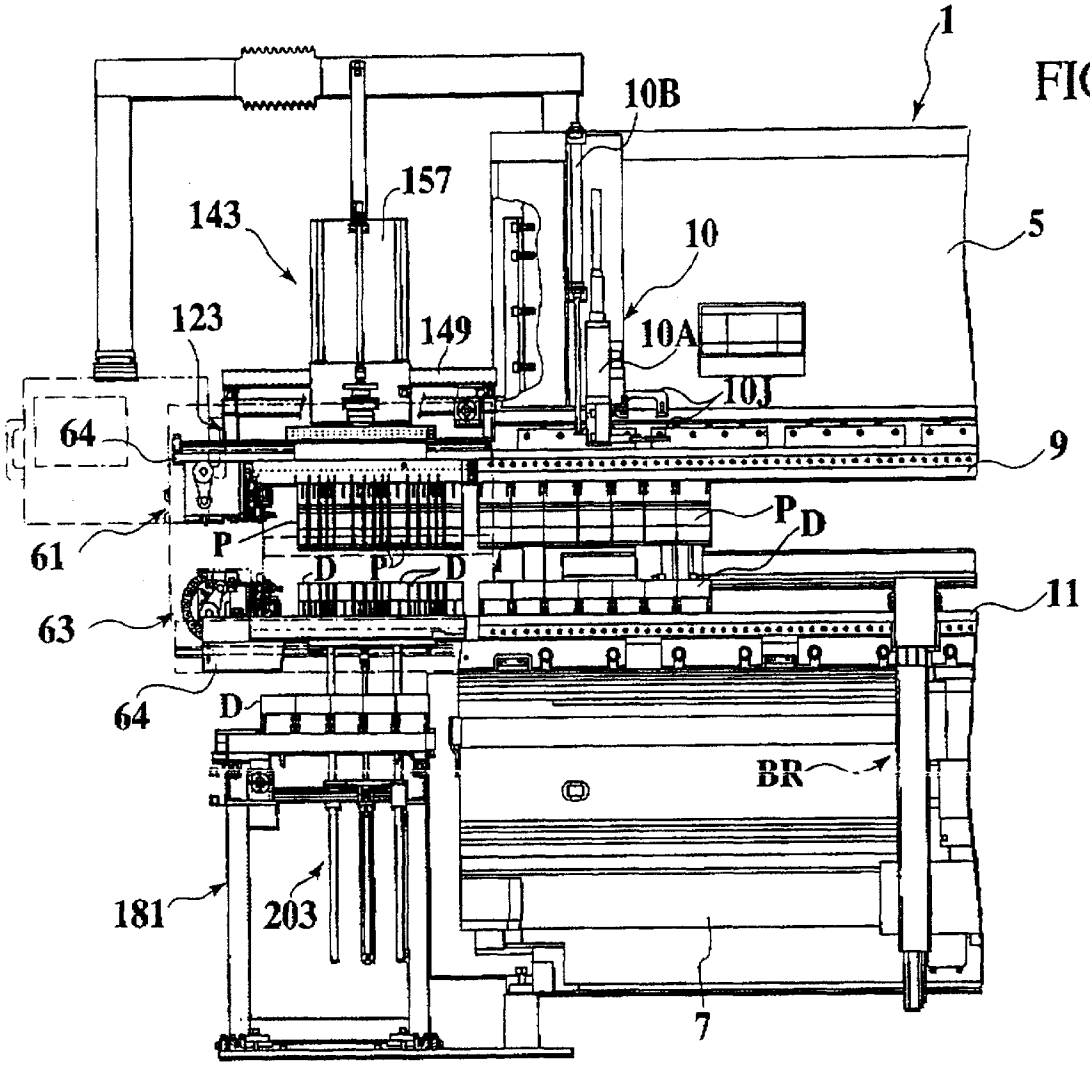
FIG. 23 illustrates the front view of the press brake of the second embodiment where the right side part is omitted.

FIG. 23 shows the press brake of the second embodiment with the right side omitted where same symbols will be used for structural components having the same function as in the first embodiment and explanations will not be duplicated.

In the second embodiment, the upper and lower guide bases 64, guide members 65 and racks 67 for guiding and supporting the upper and lower tool exchange devices 61, 63 are constructed so that they protrude largely from the sides in the left and right directions. Onto this protruded part, holders for a exchange tool support are provided, and on these holders, exchange tool supports that may support a plurality of freely attachable and detachable tools P, D are mounted free to attach-detach and exchange. With this, more divided tools P, D can be attached and detached and exchanged.

Figure 24:
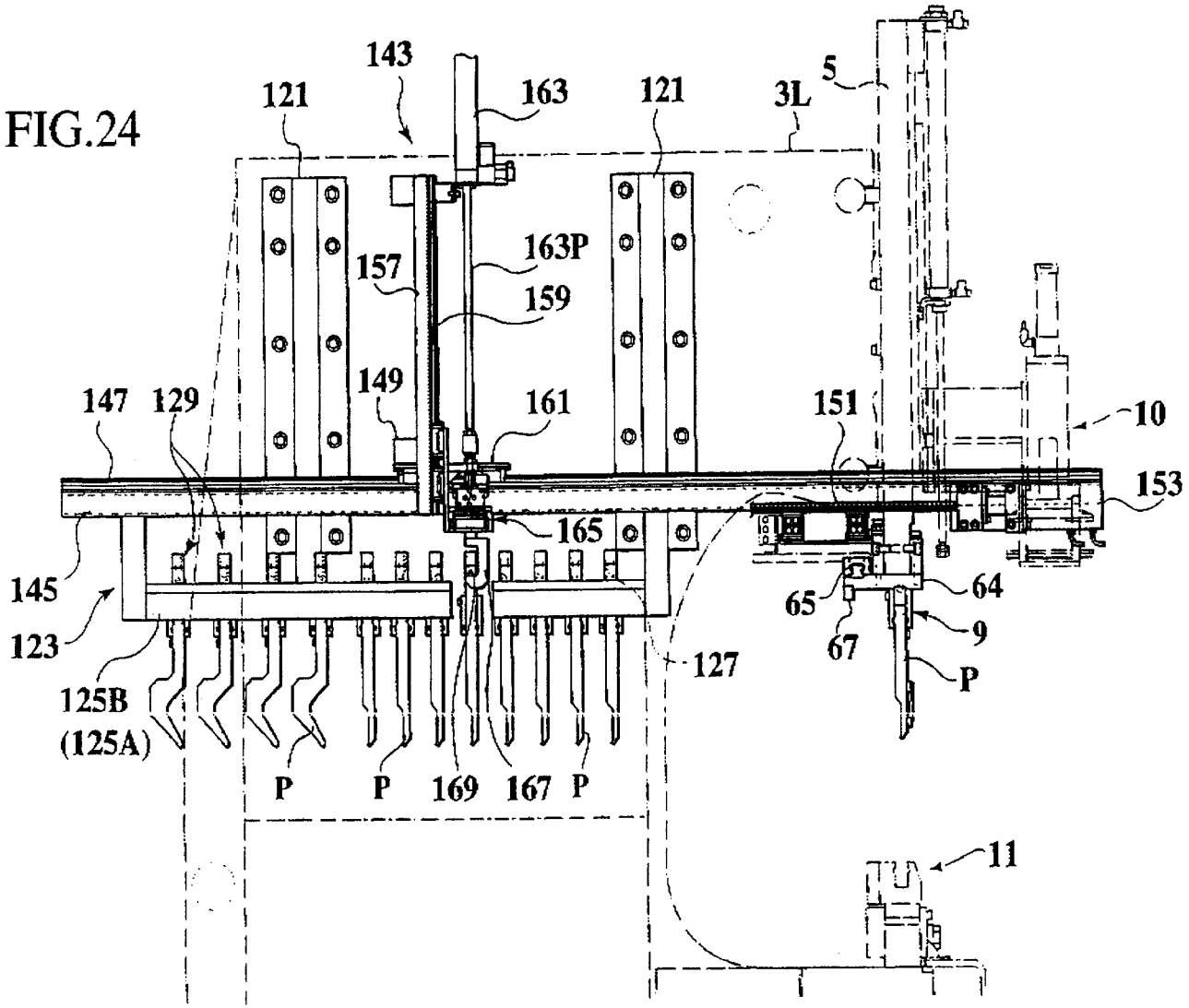
FIG. 24 illustrates the left side view of an important part of the press brake of the second embodiment.
Figure 25:
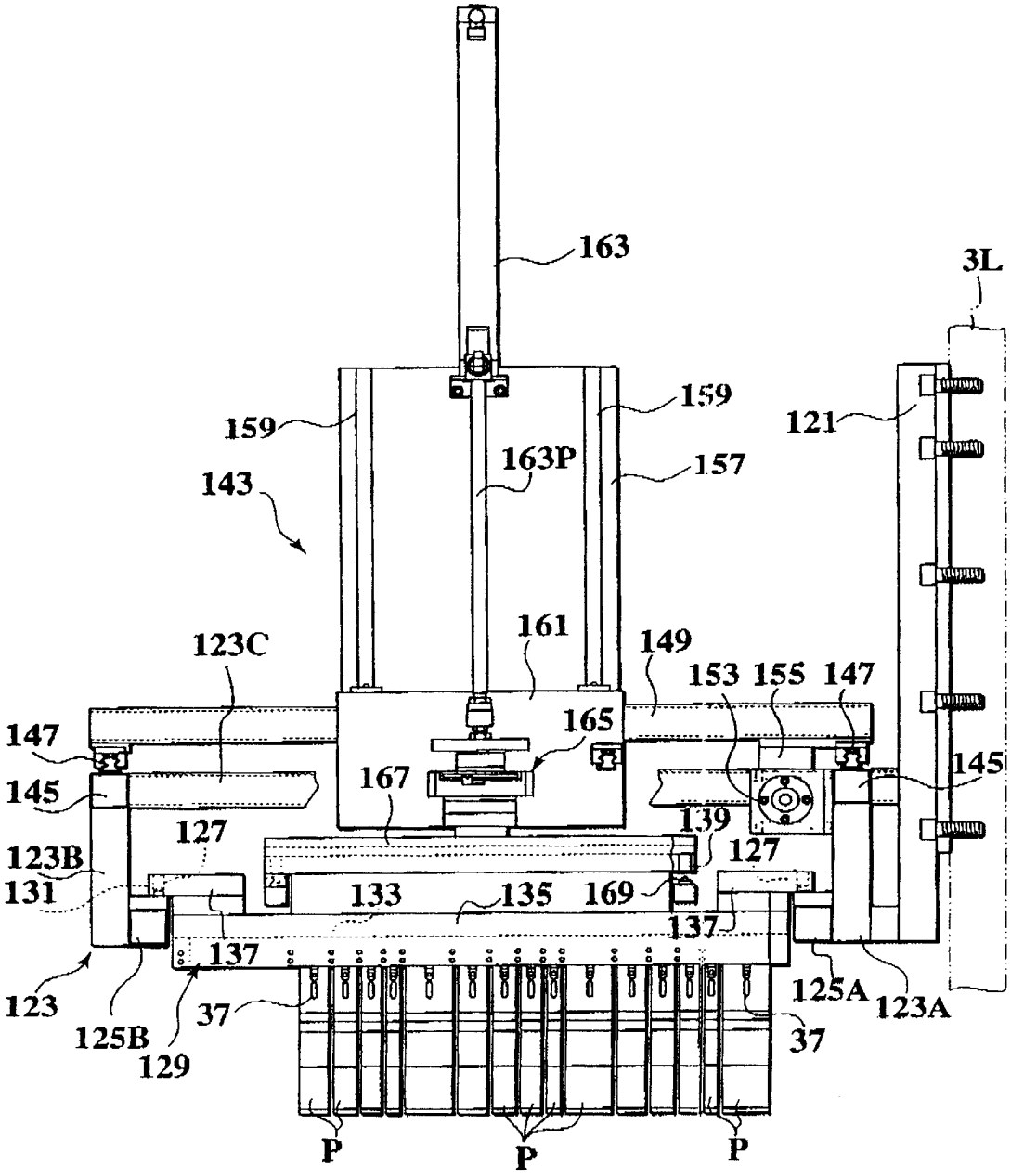
FIG. 25 illustrates the front cross sectional view of the main part of FIG. 24.

In more detail, as shown in FIGS. 24, 25, on the outer side face of the side frame 3L of the press brake 1, a housing frame 123 is provided by the bracket 121. The housing frame 123 acting as an upper tool housing section is formed in a square shaped framework by the left and right side frames 123A, 123B and the connection frame 123C connected to the left and right side frames 123A, 123B. On the upper surface of the long left and right support beams 125A, 125B integrally secured on the lower part of the inner sides of the left-right side frames 123A, 123B, a plurality of positioning pins 127 are provided adequately spaced in the forward and backward direction.

On the positioning pins 127, engagement holes 131 directed in the up and down direction and provided on the left and right edge of the exchange upper tool support 129 which detachably supports a plurality of divided upper tools P, are engaged free to attach or detach. That is, on the housing frame 123, a plurality of exchange upper tool supports 129 arranged in a row in the front to rear direction, are supported free to attach or detach.

Figure 26:
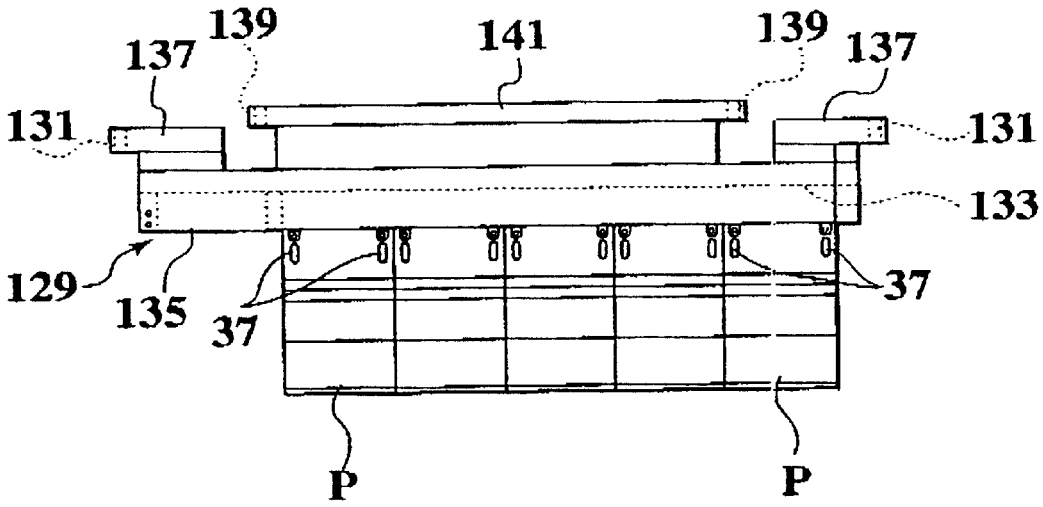
FIG. 26 illustrates the front view of the exchange upper tool support.

As shown in FIG. 26, the exchange upper tool support 129 is provided with a lower support part 135 which is provided with a tool groove 133 which has the same structure as the tool holder groove 45 and which engages and supports a plurality of divided upper tools free to attach and detach. On upper surface of the left and right edges of this lower support part 135, a bracket 137 formed with the engagement hole 131 is attached. And, on the central part of the lower support part 135, a suspension 141 provided with engagement holes 139 on both ends.

There is provided a tool support exchange device 143 to transfer and exchange a plurality of exchange upper tools supports 129 housed and supported by the housing frame 123 to the holder on the protruded part of the guides 65.

In more detail, as shown in FIG. 24, on the upper part of the housing frame 123, left side and right side guide beams 145 which protrude in the forward direction (right direction in FIG. 24) over the protruded part of the guide part 65 are provided, extending in the forward and backward directions. On guide rails 147 provided on these left and right guide beams 145 and extending in the forward and backward direction, a slide beam 149 is supported movable in the front and rear directions. In order to move the slide beam 149 back and forth, a screw 151 elongated in the front to rear directions is rotatably supported on the guide beam 145, and a servomotor 153 is attached on the guide beam 145 to rotate the screw 151. And a nut 155 (see FIG. 25) attached to the slide beam 149 meshes with the screw 151 free to move in the front and rear directions (direction perpendicular to the sheet in FIG. 25).

On the central part of the left-right direction of the slide beam 149, a guide plate 157 is erected, and on the vertical guide 159 attached to the guide plate 157, an up-down slider 161 is supported and guided free to move upwards and downwards. In order to ascend and descend the up-down slider 161, an up-down movement parts 163P such as a piston rod of an up-down movement actuator 163 such a fluid pressure cylinder acting as an up-down movement device, attached to the guide plate 157 is connected to the up-down slider 161.

On the up-down slider 161, a rotation hook 167 which may rotate horizontally by a rotating device 165 is supported. The rotation hook 167 is provided with engagement pins 169 which may be inserted from the lower side of the engagement hole 139 formed on the exchange upper tool support 129.

The rotating device 165 is provided with a worm wheel (omitted in the figures) that may rotate horizontally by engaging with the worm rotated by a motor (omitted in the figure). The device 165 is provided with a sensor such as a limit switch that detect a half turn of the worm wheel and is organized so that the rotation will be stopped when the rotating hook 167 half turns horizontally.

With this arrangement, the guide plate 157 may be moved in the front-rear directions along the guide rail 147 by rotating the screw 151 by driving the servo motor 153, and may be positioned at a position corresponding to the desired position of the exchange upper tool support 129 supported in the housing frame 123. And by operating the up-down movement actuator 163, the up-down slider 161 may be moved up and down, and brings the rotating hook 167 supported by the up-down slider 161 down to the position of the hang part 141 and inserts the engagement pin 169 provided on the rotating hook 167 into the engaging hole 139 formed on the hang part 141 from below.

That is, together with suitable controlled operation of the servomotor 153, by suitable controlled operation of the up-down movement actuator 163 the exchange upper tool support 129 supported in the housing frame 123 at an arbitrary position may be hanged up by the rotating hook 167. And the exchange upper tool support 129 may be moved to the mounting position of the protruded part of the guides 65 and the like. Also by rotating the rotating lifter 167 by the rotating device 165, front and rear sides of the divided upper tool P may be reversed while transporting the exchange upper tool support 129.

Figure 27:
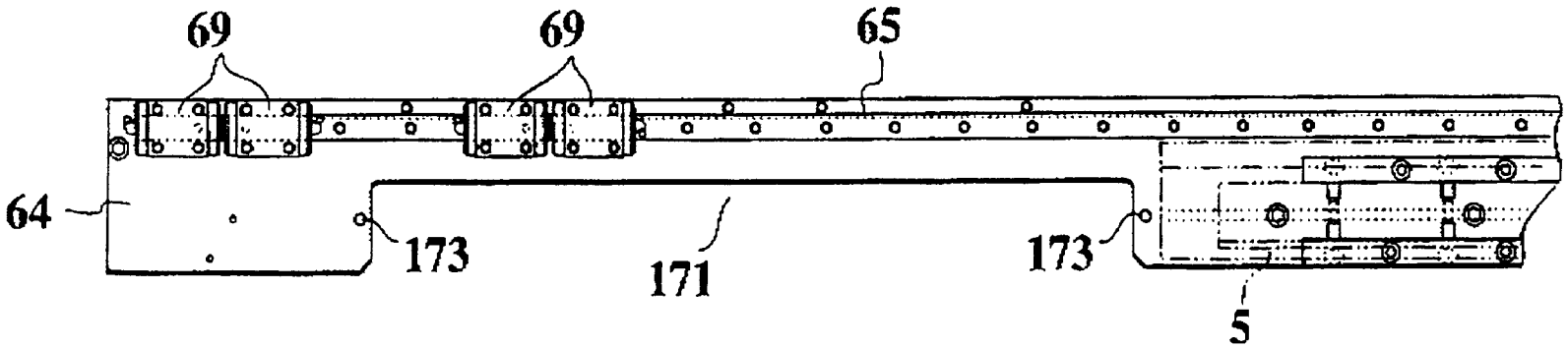
FIG. 27 illustrate a part of the guide base protruding from the press brake.
Figure 28:
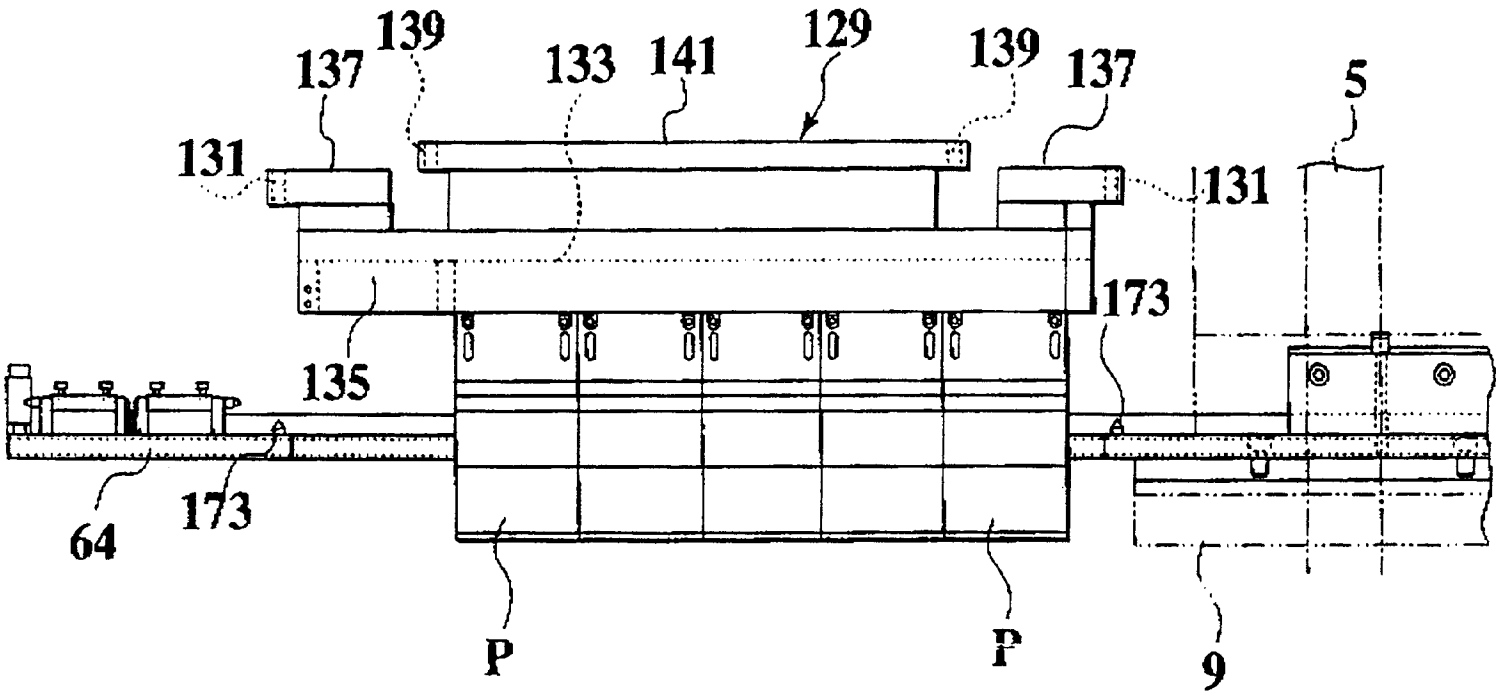
FIG. 28 illustrates the action of installing the exchange upper tool support onto the protruded part.

As shown in FIG. 27, on the part where the guide base 64 is protruded largely sidewards from the upper table 5, a hollow part 171 is formed to mount the exchange upper tool support 129 free to attach and detach. In the present embodiment, this hollow part 171 is formed in the form of a concave notch. And on both left and right side parts, a positioning pin 173 that is free to engage the engagement hole 131 provided on the exchange upper tool support 129 is provided protruding upwards.

Figure 29:
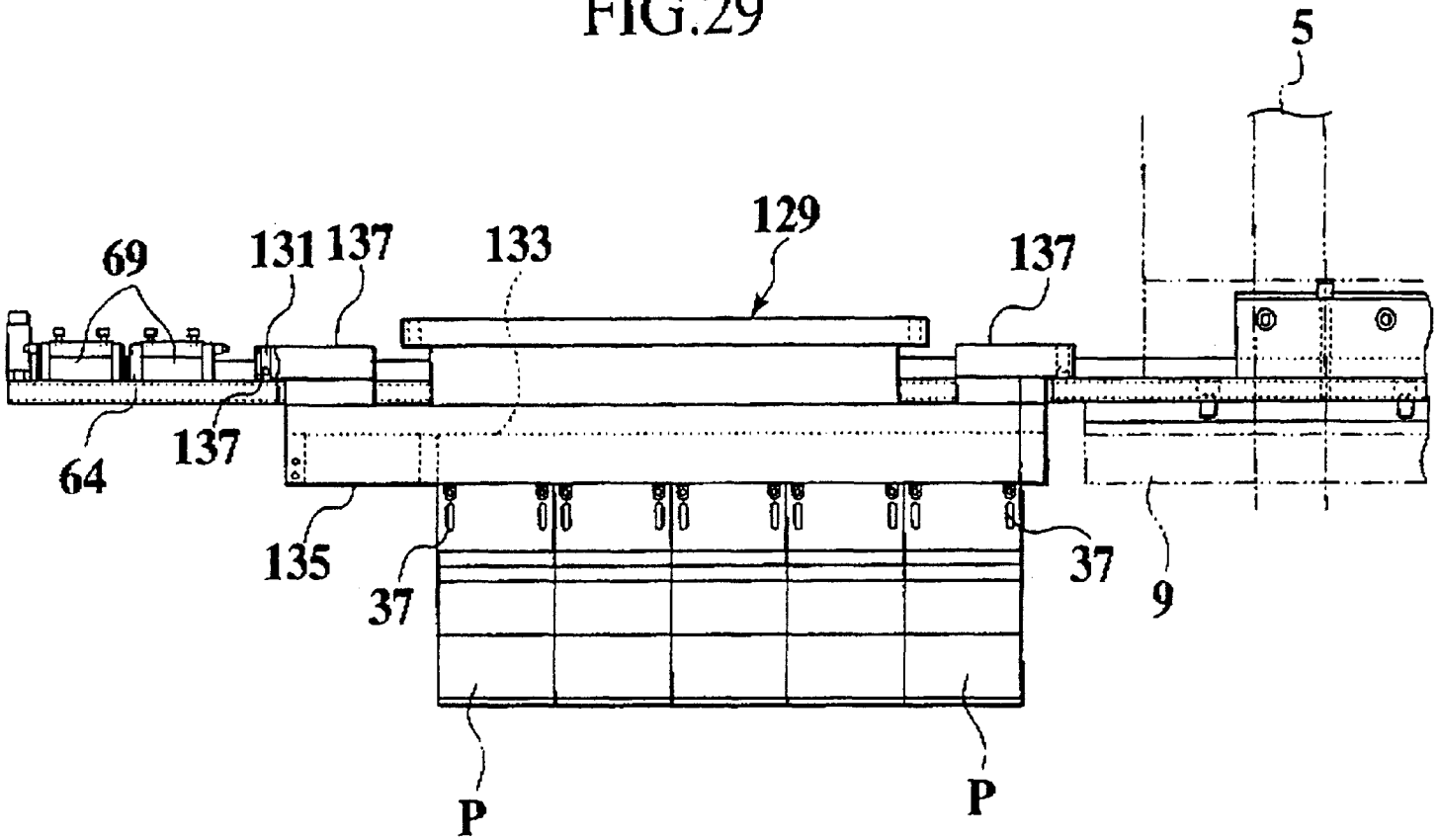
FIG. 29 illustrates the action of installing the exchange upper tool support on to the protruded part.

By positioning the exchange upper tool 129 in the hollow part 171 and engaging the engagement hole 131 with the positioning pin 173, the bracket 1269 137 provided with the engagement hole 131 will be supported by the guide base 64, and the lower support part 135 of the exchange upper tool support 129 will be placed at the same height as the upper tool holder 9 on the upper table 5 (see FIG. 29). Thus, the divided upper tool P may be moved directly onto the mount groove 13U of the upper mount 9 by moving the tool P in the left-right direction on the tool holder groove 133 formed on the lower support 135.

Figure 30:
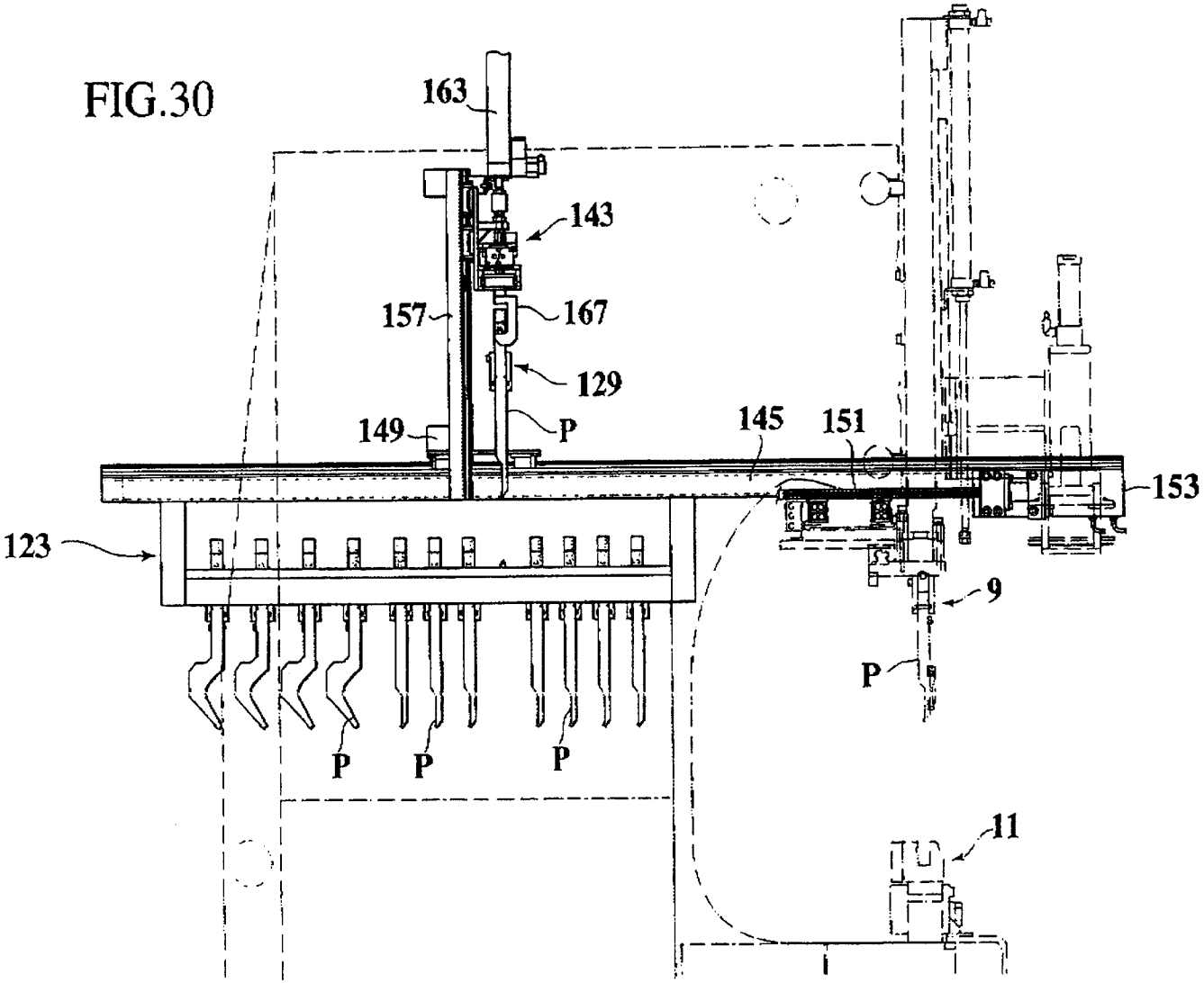
FIG. 30 illustrates the action of moving the exchange upper tool support.
Figure 31:
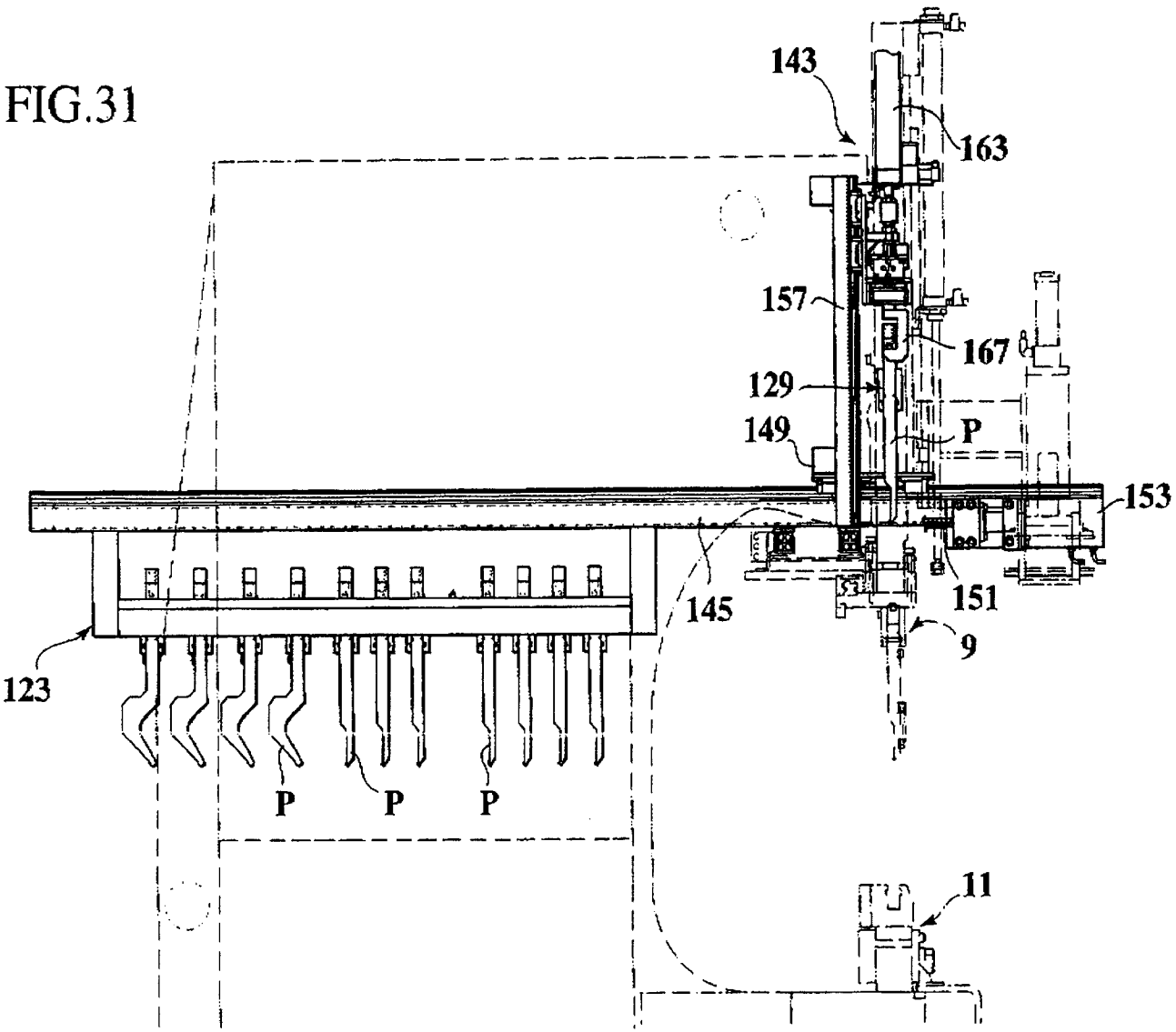
FIG. 31 illustrates the action of moving the exchange upper tool support.
Figure 32:
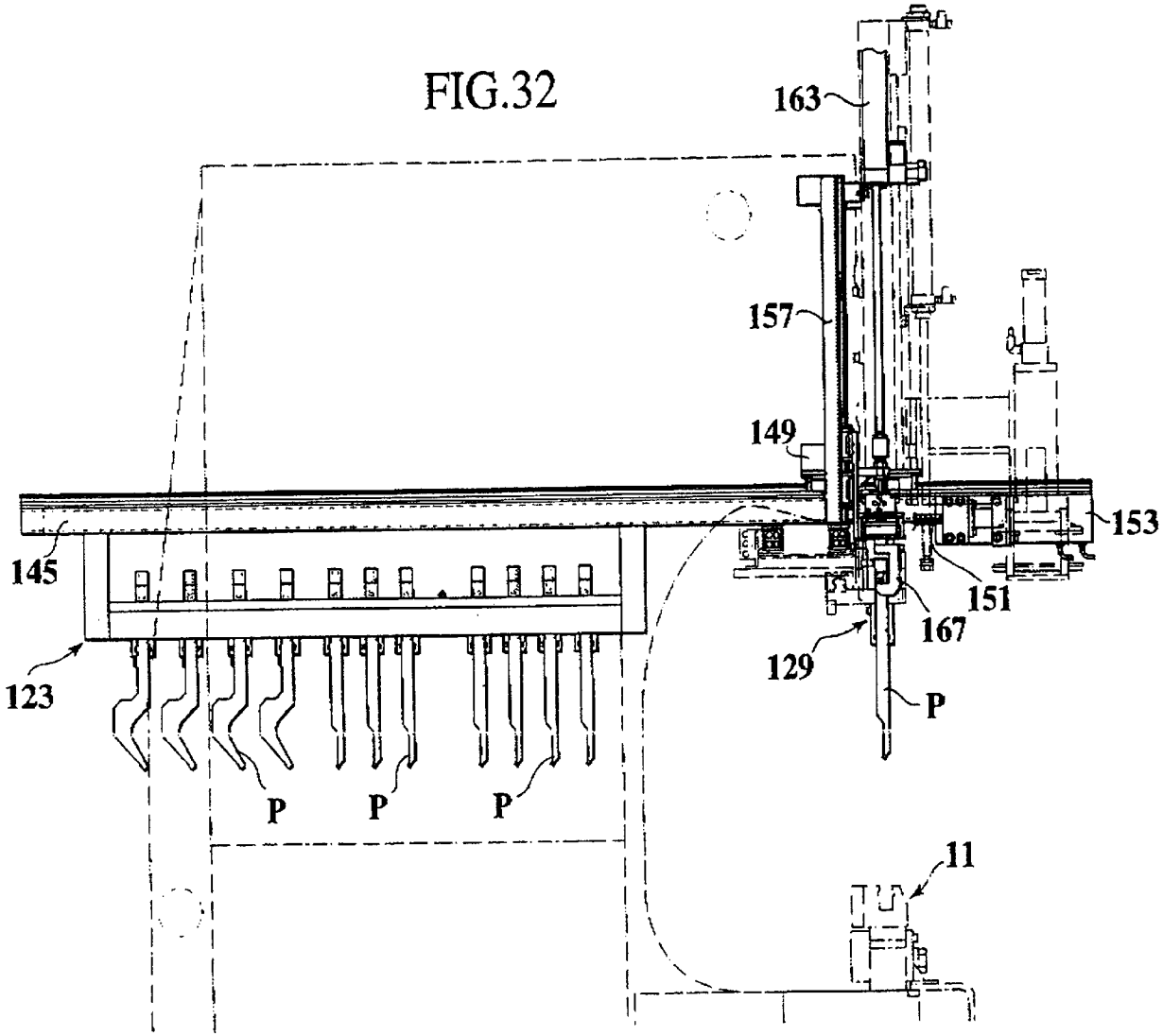
FIG. 32 illustrates the action of moving the exchange upper tool support.

With this arrangement, after positioning the rotating hook 167 above a desired exchange upper tool support 129 as shown in FIG. 24, by raising the rotating hook as shown in FIG. 30, the desired exchange upper tool support 129 may be lifted up from the housings frame 123. Thereafter, by moving the slide beam 149 forwards as shown in FIG. 31, the exchange upper tool support 129 may be positioned at the position that corresponds to the hollow part 171 acting as the mount part of the guide base 64.

Also, when reversal of the front and rear of the divided upper tool P is necessary, after lowering the rotation hook 167 in between the housing frame 123 and the protruded part of the guide base 64 and bringing it to a state where it does not interfere with other structure parts, the front and rear of the divided upper tool P may be reversed by rotating and reversing the rotation hook 167 horizontally by operating the rotation device 165.

As mentioned above, after positioning the exchange upper tool support 129 at the hollow space 171 acting as the mount section of the guide base 64, when the rotating hook 167 is lowered, the positioning pin 173 and the engagement hole 131 of the exchange upper tool support 129 will engage with each other, as shown in FIG. 29, so that the exchange upper tool support 129 will be positioned.

Thereafter, by inserting the tip 97T of the hook support 97 of the upper exchange device 61 into the insertion hole 37 of the divided upper tool P on the leftmost side in FIG. 29, and by moving the upper tool exchange device 61 along the guide part 65 to the right direction, a plurality of divided upper tools P supported on the exchange upper tool support 129 are moved sidewards to the mount groove 13U of the upper tool holder 9 on the upper table all at once, thereby the efficiency of moving the upper tool P may be expedited. Also, as described before, the divided upper tools P may be moved one at a time by the upper tool exchange device 61. With the arrangement, a plurality of exchange upper tool support parts 129, which are housed and supported in housing frame 123 acting as the upper tool housing section, may be transported and mounted by the tool support exchange device 143 to the hollow part 171 acting as the mount section, so that the attachment detachment exchange of the divided upper tools P onto the upper tool holder 9 of the upper table 5 may be performed. Thus divided upper tools P with various forms and sizes may be attached and detached automatically in accordance with the bending process of the work.

Figure 33:
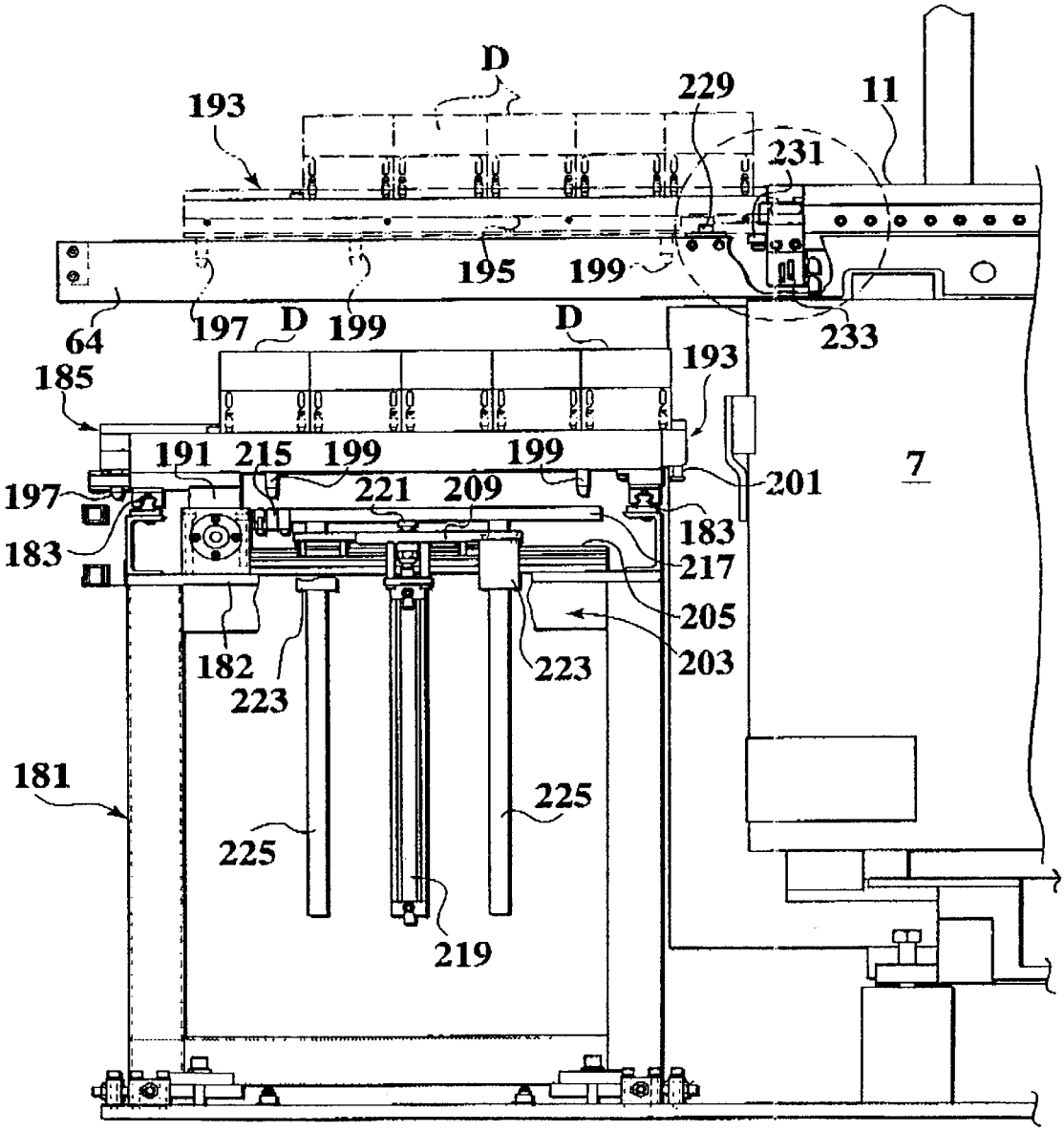
FIG. 33 illustrates the front view of the housing section of the exchange lower tool support.

As shown in FIG. 33, at the lower position of the lower guide base 64 which protrudes largely in the left direction from the left edge of the lower tool holder 11 on the lower table 7, a framework structured base frame 181 is provided. On the upper part of this base frame 181, a guide rail 183 extending in the forward and backward directions (direction perpendicular to the sheet of FIG. 33) is provided. And on this guide rail 183, a square framework shaped slide frame 185 is supported free to move forward and backwards. To move this slide frame 185 back and forth, on the base frame 181, a screw 187 (see FIG. 34) extending in the forward and backward direction (up and down direction in FIG. 34) is supported free to rotate, and a servomotor 189 is mounted to rotate this screw 187. And a nut 191 (see FIG. 33) furnished on the slide frame 185 is screwed onto the screw 187 free to move in the forward backward directions.

Thus, by adequate controlled rotation of the servomotor 189, the slide frame 185 may be moved back and forth along the guide rail 183.

On the slide frame 185 acting as the lower tool housing section, a plurality of exchange lower tool supports 193 that support a plural number of divided lower tools D free to attach and detach is supported free to attach and detach. The exchange lower tool support 193 is provided with a tool holder groove 195 which is formed in up and down symmetry with the tool groove 133 of the exchange upper tool support 129. A plurality of divided lower tools D is mounted on this tool holder groove 195 free to attach and detach and also free to move in the left and right directions.

On the lower part of one side of the exchange lower tool support 193, a positioning pin 197 is provided which may be freely engaged or disengaged from the positioning hole (not shown in the figure) provided on the slide frame 185, and at adequate positions, a plurality of control pins 199 protruding downwards are provided. Also on the lower part of the other side edge of the exchange lower tool support 193, an engagement pin 201 is provided.

Figure 34:
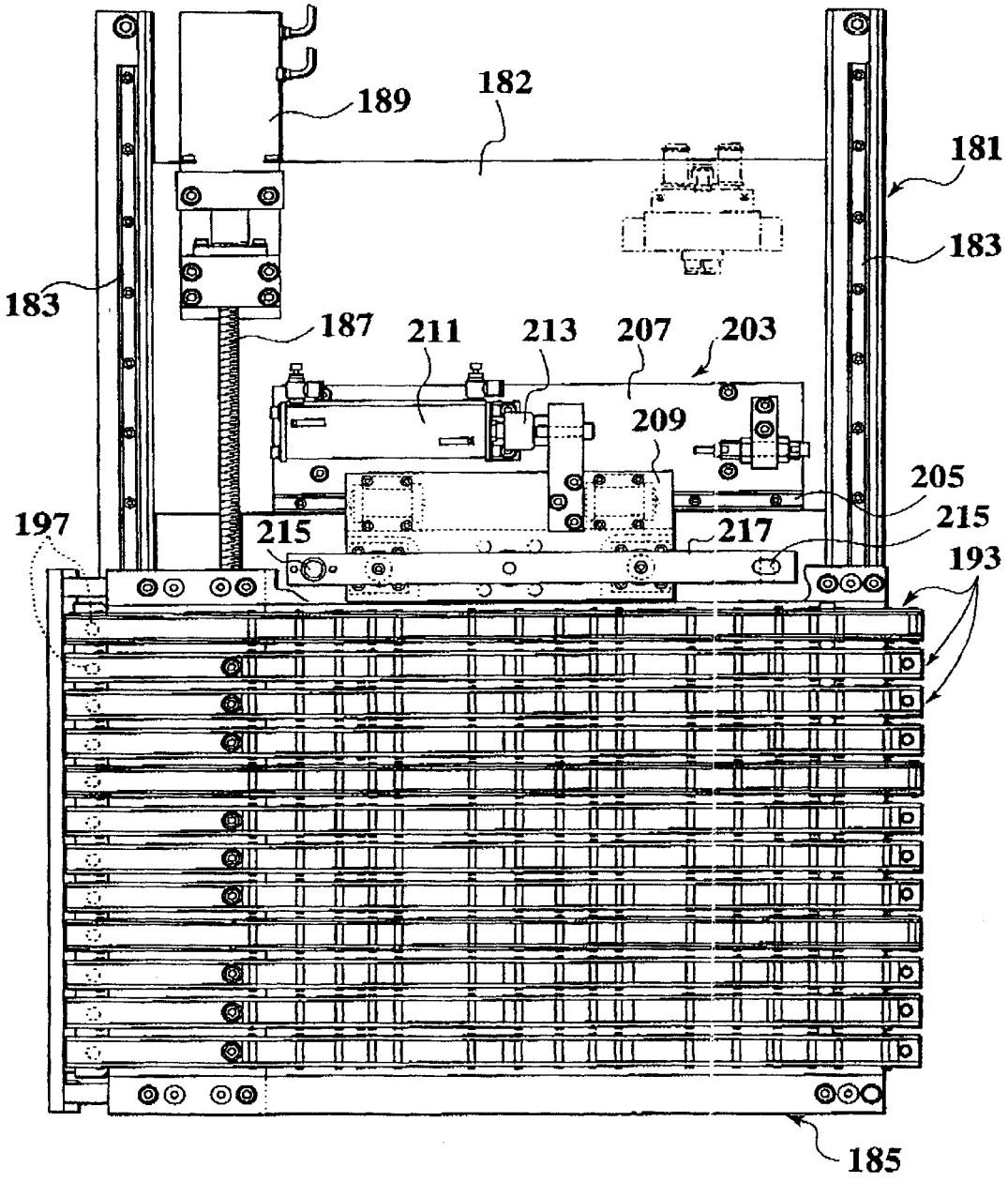
FIG. 34 illustrates the plan view of the housing section of the exchange lower tool support.

A plurality of exchange lower tool supports 193 are mounted in parallel adequately spaced in the front and rear directions on the slide frame 185 as shown in FIG. 34, and by moving the slide frame 185 forward and backwards as described before, each exchange lower tool support 193 may be indexed and positioned at the lower position of the mount section on the protruded part of the lower guide base 64.

An exchange lower tool support elevator 203 is provided to push up freely the exchange lower tool support 193, indexed and positioned as described above, up to the position of mount section on the protruded part of the lower guide base 64.

In more detail, as shown in FIG. 34, a guide plate 207 provided with a guide rail 205 in the left-right directions is provided on the support plate 182 provided on the base frame 181. A slide plate 209 free to move in the left-right directions is supported on this guide rail 205. In order to move the slide plate 209 in the left-right directions, a left-right movement actuator 211 such as a fluid pressure cylinder is mounted on the guide plate 207, and a left-right drive member 213 such as a piston rod of the left-right movement actuator 211 is connected to the slide plate 209 via a bracket.

Thus the slide plate 209 may be moved in the left-right directions along the guide rail 205 by the left-right movement actuator 211.

Figure 35:
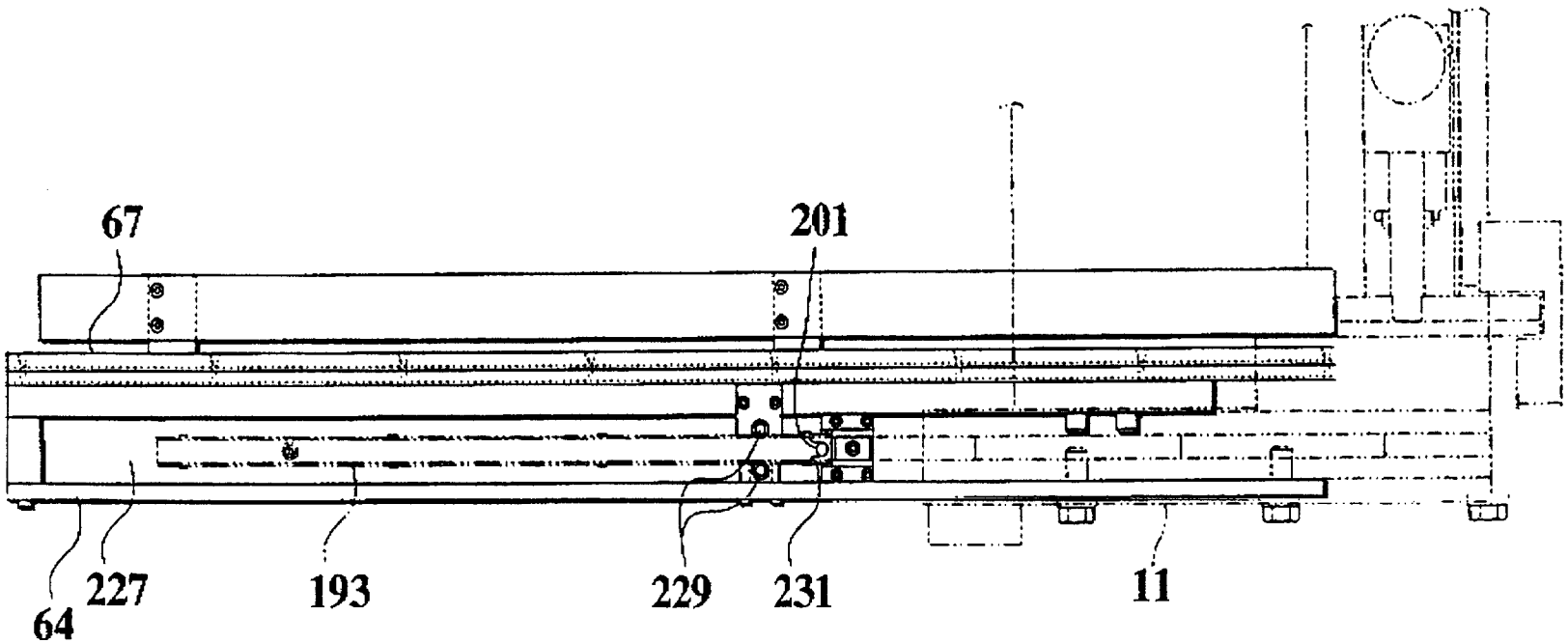
FIG. 35 illustrates the plan view of a part of the lower guide base protruding sideways from the press brake.

On the slide plate 209, a booster member 217, provided with engagement holes 215 on both edges which engage with the control pins 199 arranged on the exchange lower tool support 193, is provided free to move up and down. That is, on the lower part of the slide plate 209, up-down actuator 219 such as a fluid pressure cylinder (see FIG. 33) is provided, and an up-down drive member 221 such as a piston rod is connected to the booster member 217. Also on both edges of the booster member 217, a guide rod 225 is provided which is guided upwards and downwards by the up-down guide 223 provided on the slide plate 209. As shown in FIG. 35, on the protruded part of the lower guide base 64, together with a lower guide member elongated in the left-right direction provided to guide the lower tool exchange device 63 in the left-right directions, a rack 67 is provided. Also a hollow space 227 is formed as a mount section free to position the exchange lower tool holder 193 when it is pushed up. And in front and rear of this hollow space 227, a front-rear guide roller 229 which clamps the exchange lower tool holder 193 from the front and rear and guides it in the left-right directions is provided free to rotate. Further on the edge of the lower tool holder 11 side, an engage positioning member 231, which determines the position by engagement with the engagement pin 201, is provided free to be moved up and down by the up-down cylinder 233.

Figure 36:
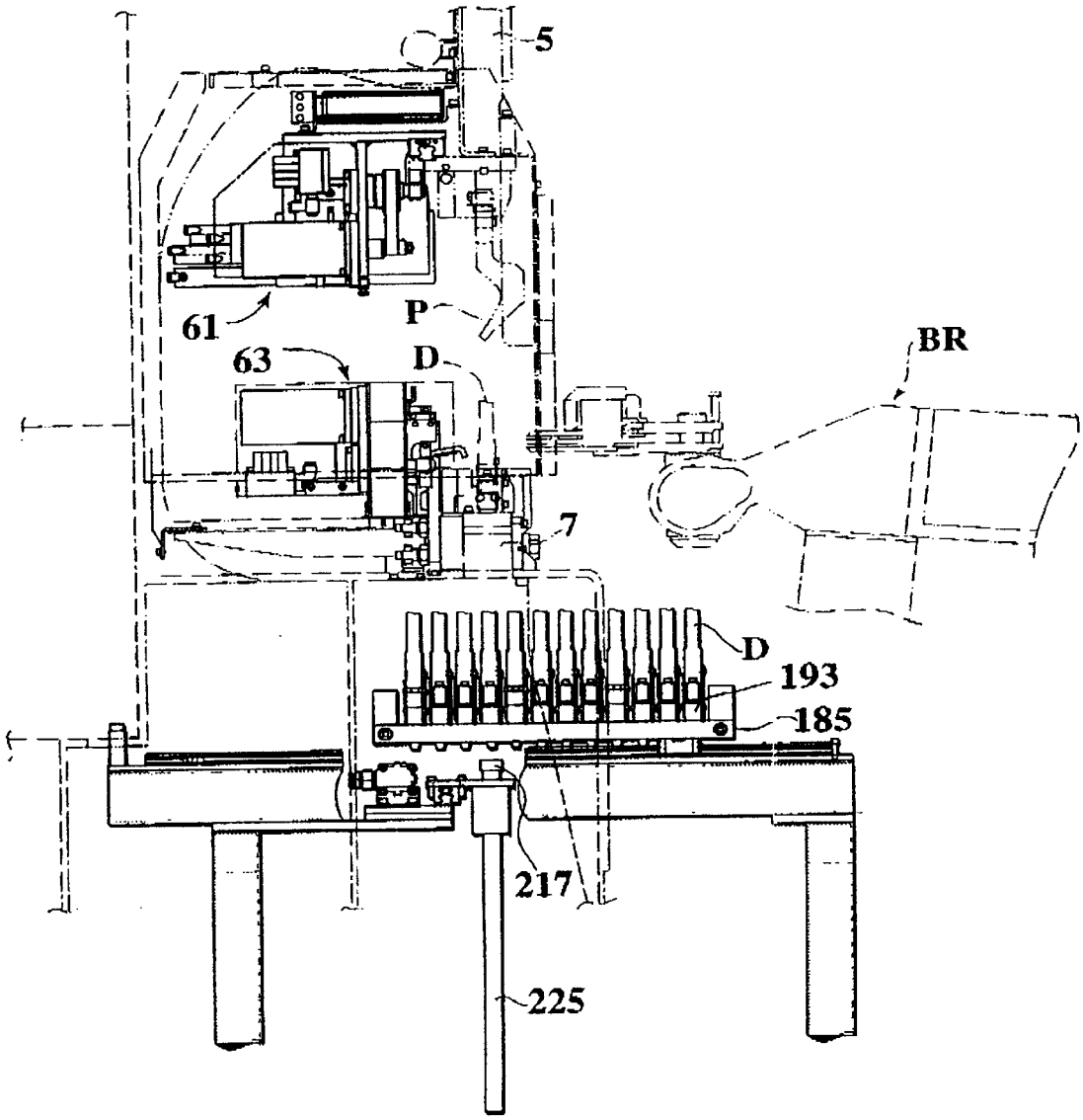
FIG. 36 illustrates the action of moving the exchange lower tool support.
Figure 37:
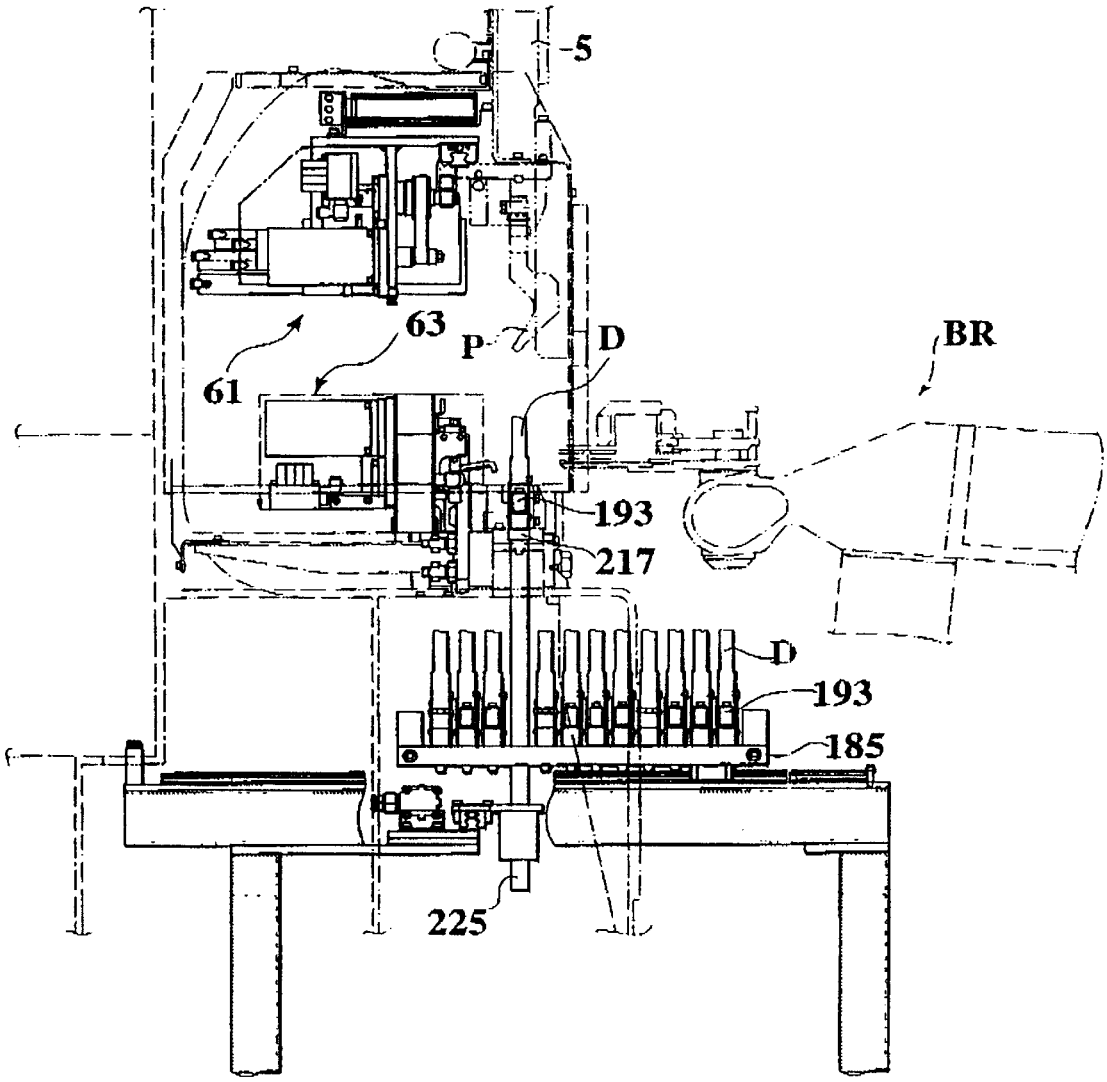
FIG. 37 illustrates the action of moving the exchange lower tool support.

In the arrangement described, as shown in FIG. 36, after moving the slider frame 185 forward and backward (left-right movement in FIG. 36) and indexing and positioning a desired exchange lower tool support 193 at a position above the booster 217 and below the hollow space 227 which acts as the mount section of the protruded part of the lower guide base 64, by pushing up the desired exchange lower tool support 193 by the booster 217 as shown in FIG. 37, the exchange lower tool support 193 may be positioned as the mount section inside the hollow space 227.

Subsequently, by operating the left-right movement actuator 211 and moving the slide plate 209 to the lower table 7 side, the engagement pin 201 provided on the exchange lower tool support 193 will be engaged with the engagement positioning section 231 so that the same 193 will be positioned in a state where it will be at the same height as the lower tool holder 11 of the lower table 7 and lined up in the left-right directions.

Thus, with the lower tool exchange device 63, a plurality of divided lower tools D may be, similar to the divided upper tools P, moved onto the lower tool holder 11 simultaneously and, as already understood, the divided lower tools D may be attached and detached one by one and moved and mounted on to the lower tool holder 11.

As already understood, in the second embodiment, more divided tools P, D may be housed in each tool housing section and also by moving a plurality of divided tools P, D simultaneously to the upper and lower tool holders 9, 11 on the tables 5, 7, the efficiency of tool mounting may be improved and, if necessary, the divided tools P, D may be moved and mounted on the upper and lower mounts 9, 11 one by one.

The third embodiment of this invention is a bending press system that comprises a bending press system that is provided with a bending press 1 having at least one bending station to mount a plurality of divided tools, and tool housing devices 65, 123 to house the divided tools for the bending press, and tool exchange devices 61, 123 which move the divided metals between the tool housing devices and the bending station; and a bending press system support management device 401 (FIG. 38) which supports and manages the bending press system so as to support set up or exchange of the divided tools relative to the bending stations.

Here the tool housing devices 65, 123 are provided with a first housing section (or the standby station) 65 acting as an upper guide part 65, which protrudes largely in the left-right directions from the sides of the upper table, positioned on the extension of the line of the bending axis of the bending station, and a second housing section 123 provided with a tool support part 129 which supports a plurality of divided tools with the same cross-sectional shapes.

Also the tool exchange device is provided with a first tool exchange means 61 which moves each divided tool freely between the first housing section and the bending station, and a second tool exchange means 143 which moves freely a plurality of divided tools with the same cross section shape altogether between the first housing section and the second housing section.

Figure 38:
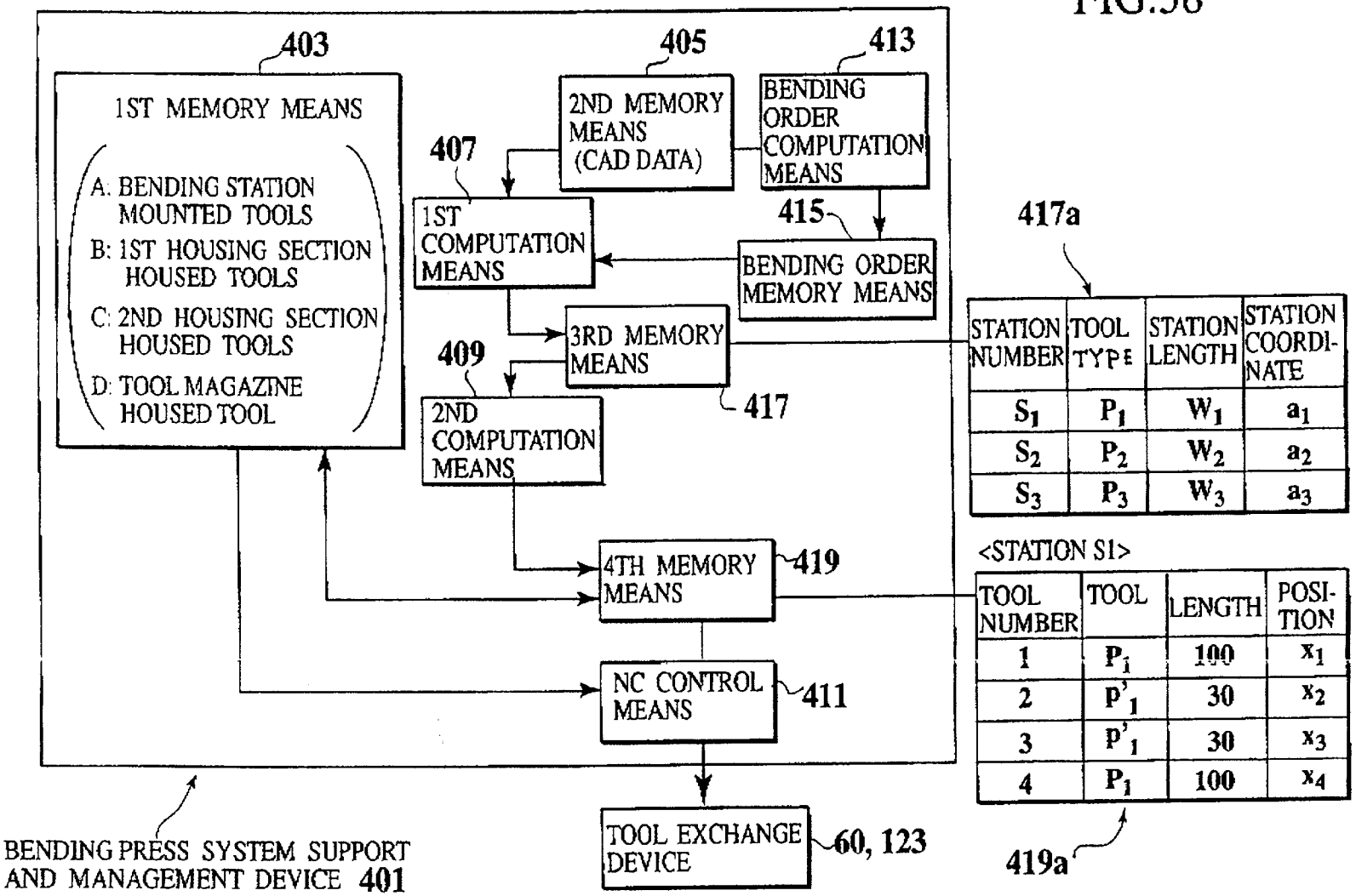
FIG. 38 is a block diagram of the support management device of the bending press system shown in FIG. 1–FIG. 37.

FIG. 38 shows the composition of the bending press system support management device 401.

As shown in FIG. 38, the bending press system support management device 401 consists of a first memory means 403 which store the housing positions of the divided tools housed in the housing device 65, 123, and a second memory means which store the bending line length, the flange length and the bending angle of the bending part of the bent product, and a first calculation means 407 to calculate the tool type of the divided tool to be set on the bending station and the length of the bending station based on the bending line length, flange length and the bending angle, and a second calculation means 409 to determine the arrangement of each divided tool on the bending station based on the tool type and the length of the bending station, and an NC control means 411 which controls the tool exchange device 61, 143 so that each divided tool is moved from the housed positions of the housing section 65, 123 to the determined arrangement positions.

A more detailed description is given below.

In the first memory means 403, as shown in FIG. 38, besides divided tools stored in the first housing section 65 and the second housing section 123 acting as housing devices, the mount positions of the divided tools mounted on the banding station and the housed positions of divided tools housed in the tool magazine (not shown in the figure) provided outside the bending press (and hence not accessible by the tool exchange device) are also stored.

FIG. 39 shows the data of the divided tools (standard size or long size tools) stored in the first memory means 403 in a tabular form.

As shown in FIG. 39, on the column 403*a* which shows the tool types, identifiers D1 to D15 of the divided tools are inputted, and on the column 403*b* which shows the state of the divided tools, the mount position or the housing position of each divided tool it inputted for each identifier of the divided tool. In column 403*b*, for example A1 indicates that the tool D1 is present on the first bending station and A2 indicates that the tool D2 is present on the second bending station. Also B indicates that tools D1 to D15 are present in the standby station acting as the first housing section (the upper guide member provided protruding largely from the upper table side parts in the left-right directions) 65.

The data in column 403*c* shows a more detailed position of each divided tool D1 to D15. Thus, for example, tool D1 is positioned −50 mm from the press center 0 (see FIG. 40(*a*)), and the divided tool D2 is positioned +50 mm from the left-right direction center of the bending press.

Also when the divided tool is in the first housing section (or the standby station) 65, the numbers 1–5 in column 403*c* indicate which number place from the left side position each divided tool is placed in the housing section 65. For example, as shown in FIG. 40(*b*), when divided tools D11–D15 are arranged in order from the left side, as shown in FIG. 39, numbers 1–5 are inputted in the row which correspond to the tools D11–D15.

For divided tools housed in the second housing section 123 and for divided tools housed in the tool magazine outside of the bending press, signs C, D which indicate the second housing section or the tool magazine is inputted in column 403*b* of the state column. And on the column 403*c*, the numbers 1–5 and the like are inputted which indicate the order of arrangement in each housing section or magazine similar to the case of the divided tools housed in the first housing section 65.

Figure 41:
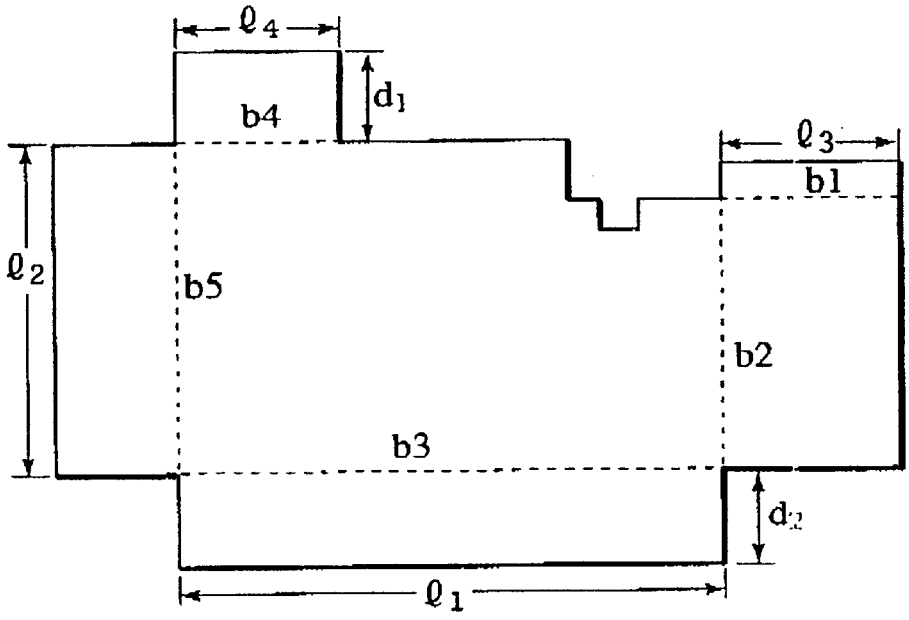
FIG. 41 shows the CAD data of the bent product.

In the second memory means 405, the CAD data for the bent product shown in FIG. 41 and the bending line length L1–L4. flange length d1–d2 and the bending angle and the bending direction of the bent part b1–b5 included in the CAD data, are stored.

Here bending direction data is a data that indicates whether the bent part is bent downwards or upwards.

Referring again to FIG. 38, the bending press system support management device 401 includes the bending order calculation means 413 to determine the order of the bending process of the bending section b1–b2 based on the bending line length, flange length, bending angle stored in the second memory means 405.

The bending order calculated by the bending order calculation means 413 will be stored in the bending order memory means 415.

In this embodiment, the bending order may also be determined manually.

The first computation means 407 computes the tool type, the length of the bending station, the number of bending stations and coordinates and the like to be set on the bending station on the basis of the bending line length, flange length, bending angle and bending direction inputted from the second memory means 405.

Figure 42:
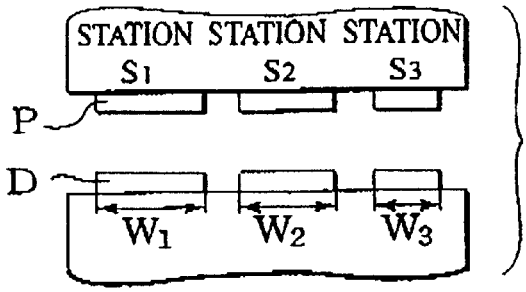
FIG. 42 shows the bending stations of the bending press.
Figure 43:
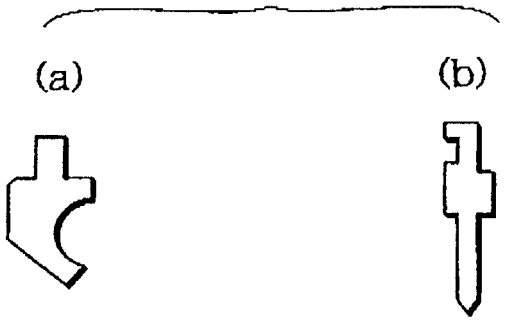
FIG. 43 shows the cross section shapes of the divided tools mounted on the bending station.

FIG. 42 and FIG. 43 show the lengths W1, W2, W3 and the divided tool types of the bending stations S1, S2, S3 calculated by the first computation means.

Figure 44:
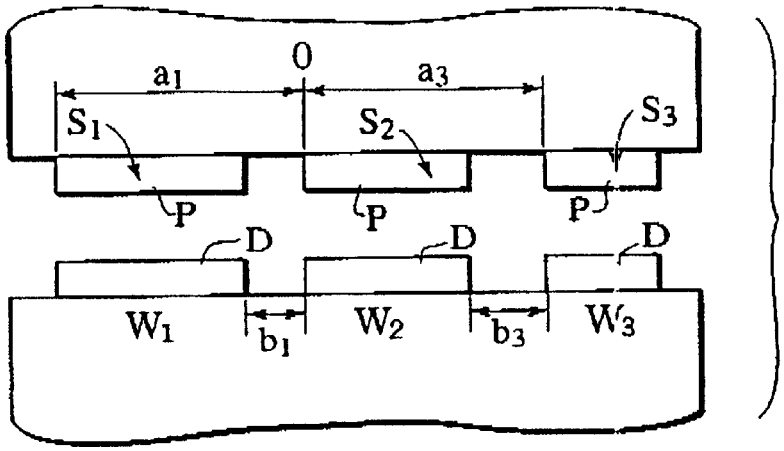
FIG. 44 shows the arrangement of the bending station on the bending press

FIG. 44 shows the station coordinates a1, O, a3 of the bending stations S1–S3 determined by the first computation means 407. By this first computation means 407, the coordinates of each station S1, S2, S3 are computed an the distance a1, O, a3 from the machine center (that is the center of the bending press in the left-right direction) O to the left edge of each tool station. Now, in FIG. 44, it is assumed that the center of station s2 coincides with the machine center O.

Now when the center of station s2 coincides with as the machine center O, the coordinates of the stations s1, s3 may be given by the distance b1, b3 between the station s2 and the stations (FIG. 44).

Figure 45:
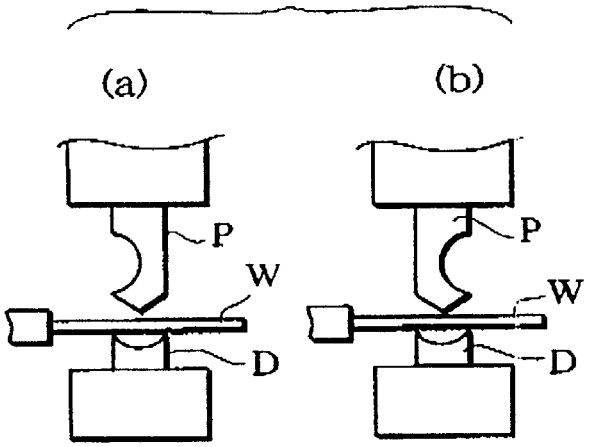
FIG. 45 shows the face side attached tool and the reverse side attached tool mounted on the bending station.

As shown in FIG. 45, the first computation means 407 also computes whether each divided tool is arranged on each station to face forward (see FIG. 45(*a*) or rearward (FIG. 45(*b*)).

The number of the bending stations, the coordinates of the bending stations, and the type of the divided tools to be arranged on each bending station and the data of the number, length, coordinate and the forward or rear face mount of the tool of each bending station computed by the computation means 407 will be stored in the 3rd memory means 417.

The table 417*a* in FIG. 38 shows stored contents of the bending station data stored in the 3rd memory means 417. That is, in the memory means 417, as the banding station data, the tool type P1, P2, P3, the station length W1, W2, W3 and the station coordinates a1, a2, a3 are stored for each station number 1, 2, 3.

The second computation means 409 computes, based on the data from the 3rd memory means 417, the arrangement of each divided tool on each bending station.

Figure 46:
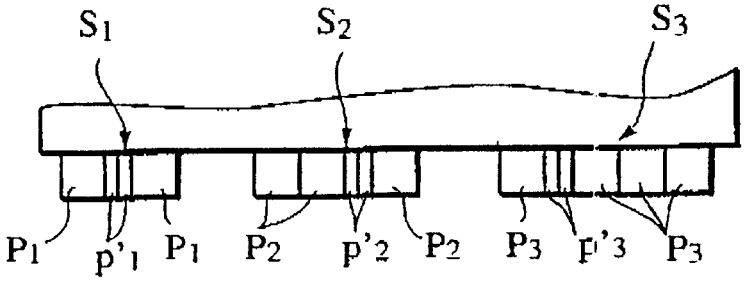
FIG. 46 shows the arrangement of each divided tool on each bending station.

FIG. 46 shows the arrangement of divided tools on the bending stations s1, s2, s3 computed by the second computation means 419. Here the sizes of each divided tool are for long size (standard size) 100 mm, for short tools 15 mm or 20 mm or 25 mm or 30 mm.

In determining the arrangement of divided tools on each station s1, s2, and s3, long divided tools are selected preferentially as shown in FIG. 46. That is, the station lengths W1–W3 are divided by the length of the long tools and a number of long divided tools equal to the quotient are selected first and the remaining length is filled up with short tools. Also, when a combination of tool lengths that matches the station length W1–W3 does not exist according to this method, the number of the long tools may be reduced by one and the remaining length is filled up by a combination of short tools.

The divided tools may be mounted on the bending station quickly this way.

Also, in determining the arrangement of divided tools on the each station, as shown in FIG. 46, the second computation means 409 determines if possible, the arrangement where long tools P1, P2, P3 are arranged on both edges of each station s1, s2, s3 and the short tools p1, p2, p3 arranged in between the long tools P1, P2, P3.

By this way, creation of scratches on the bent part may be prevented.

When only one long tool is used on one station, short tools are arranged on the sides of the long tools.

Also, the second computation means 409, with reference to the data of the first memory means 403. checks whether the divided tool arrangement (for instance as shown in FIG. 46) determined on basis of the data of the 3rd memory means 417 may be realized by usable or available tools (existing in the factory and the like). The usable tools include divided tools already present on the bending station, and divided tools housed in the first housing section 65, and divided tools housed in the second housing section 123, and tools housed in the tool magazine outside the bending press 1.

The second computation means 409 will rearrange the tool arrangement if, after the arrangement of divided tools has been determined, divided tools determined do not exist in the usable tools or when there is shortage of the divided tools. For instance, if there is shortage of long tools, the shortage will be complemented by short tools.

The second computation means 409 also investigates whether by changing the bending order computed by the bending order computation means 413, the number of the bending stations or the length of the bending station may be changed so as to create an arrangement of the bending station for manufacturing the bent products using the usable divided tools.

The second computation means 409 will send out an alarm signal if a divided tool arrangement using usable tools cannot be determined.

The arrangement of each divided tool on each bending station computed by the second computation means 409 will be stored in the 4th memory means 419 (refer FIG. 38).

Table 409*a* of FIG. 38 shows the arrangement data of each divided tool on each bending station stored in the 4th memory means 419. That is, in the memory means 419, for each tool identification number 1–5. respectively, tool type P1 or p1 and lengths 100, 30 and positions x1–x5 and the like are stored. Here the positions x1–x5 of the each tool indicate the distance between the machine center O and the left sides of each tools. The table 409*a* shows the arrangement data of tools arranged on station s1 of FIG. 46 but arrangement data of tools arranged on other stations are similar.

The NC control means 411 controls, on basis of the data stored in the first memory means 403 of divided tools stored in the tool housing device 65, 123 and on basis of data stored in the 4th memory means 419 which shows arrangement of the divided tools, the tool exchange device 61, 143 to transfer each divided tool from the housed position of the housing device 65, 123 to the determined arrangement positions on the bending station.

Figure 47:
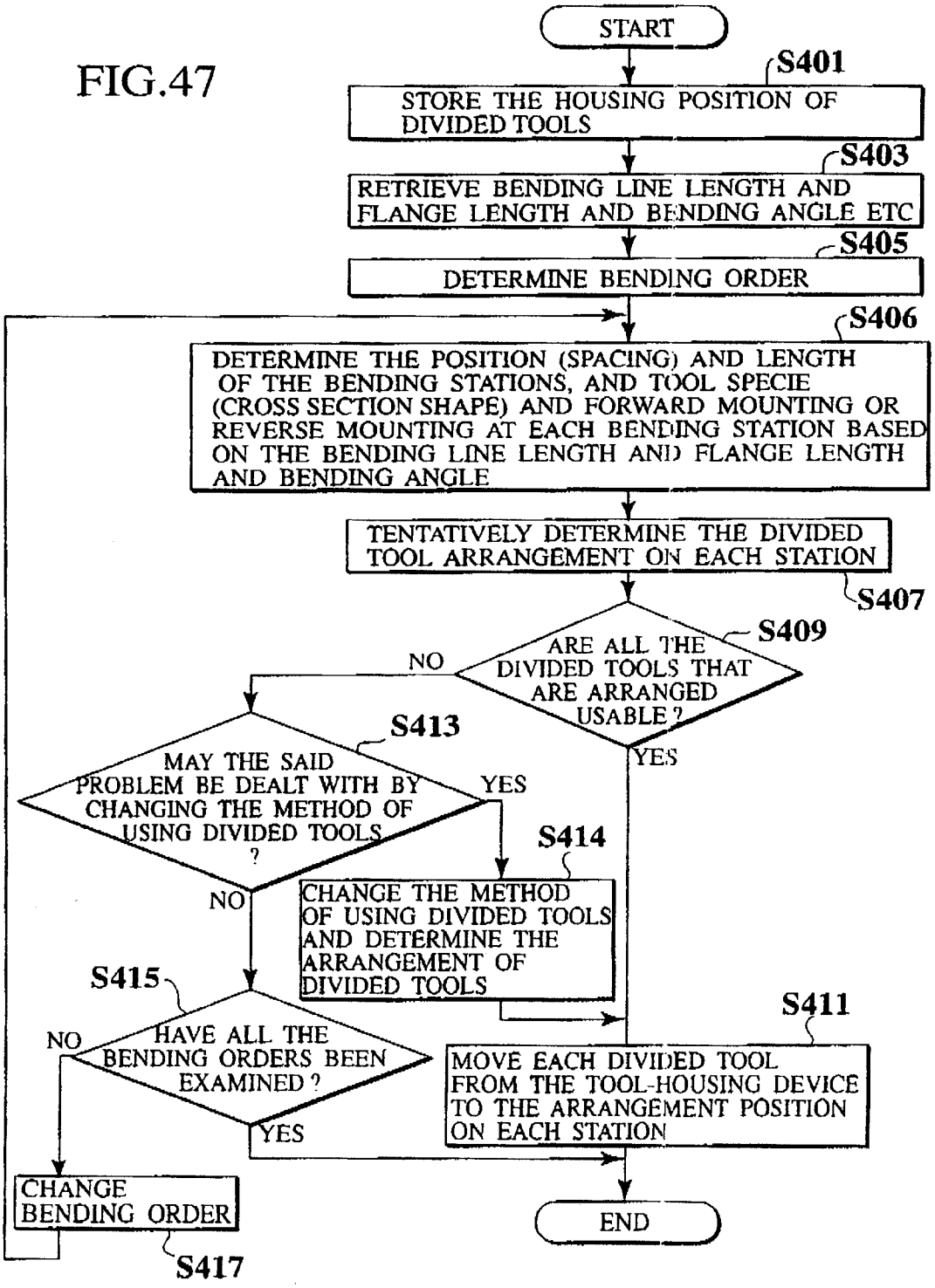
FIG. 47 is a flow chart that shows the method to move and mount the divided tools from the tool housing device to the bending station by the support management device.

FIG. 47 is a flow chart which shows the method of mounting the divided tool onto the bending station of the bending press, based on the CAD data shown in FIG. 41, in the bending press system provided with the support management device 401.

As shown in FIG. 47, instep S401, the housed position of each divided tool housed in the tool housing device 65, 123 including the first housing section 65 and the second housing section 123 and the divided tools presently mounted on the bending station and divided tools housed in the tool magazine outside the bending press 1 will be stored in the first memory means 403.

In step S403, data on the bending line length of the bent section and the flange length and the bending angle or the bending direction and the like of the bent product are retrieved from the CAD data on bent products stored in the second memory means 405. Here the bending direction data is a data that shows whether the bending part is bent upwards conically or downwards like a trough.

In step S405, the bending order of the bent part b1–b5 is determined based on data of the bending line length and flange length, bending angle and the bending direction and the like (see FIG. 41). In the product shown in FIG. 41, the bending part will be, for example, bent in the order b1, b2, b3, b4, and b5.

In step S406, based on the bending line length and flange length, bending angle, bending direction and bending order and the like, the number and coordinates of the bending stations to be provided on the bending press and the tool type (that is the cross section shape) of the divided tools to be provided on the bending station, and the length of each bending station and the forward or rearward facing of the tools to be mounted on each bending station, is determined.

As already mentioned, FIG. 42 shows the number and length of the bending station determined in step S406, FIGS. 43(*a*), (*b*) show an example of the tool types of the divided tools arranged on the bending station, FIG. 44 shows the coordinates a1, O, a3 of the bending stations and FIGS. 45(*a*), (*b*) show the divided tools arranged on each station facing forward and rearward. In FIG. 45, the left side is the front side (that is forward) of the machine where the work W is inserted.

Also in the step 406, the coordinates a1, O, a3 (FIG. 44) of the stations s1, s2, and s3 are determined so that the tools and works on each station do not interfere with each other during processing. This will prevent interference between the works and the tools on each station.

In step 407, based on the determined results of the step S406 (that is data on the tool type of the divided tools to be arranged on the bending station and the length of the bending station) provisional determination of a detailed arrangement of the divided tools on each bending stations s1–s3 will be made.

FIG. 46 shows the arrangement of the divided tools P1, p1, P2, p2, P3, p3 on each station s1, s2, s3 determined in step S407. As shown in FIG. 46, the determination of the detailed arrangement of the divided tools is made so that as many as possible long divided tools P1, P2, P3 are used. Thus, for example on station s2, three long divided tools P2 are used and on station s3, four long divided tools P3 are used. This will allow speedy set up or exchange of divided tools on each station.

Also as shown in FIG. 46, on each station s1, s2, s3, long divided tools P1, P2, P3 are arranged on both sides of each station and short divided tools p1, p2, p3 are arranged in between the long divided tools P1, P2, P3. This will prevent creation of small scratches on the bent part.

Next in stop 409, it is confirmed whether the divided tools allocated to each bending station are included in the usable tools (that it tools already mounted on the bending stations or tools housed in the first housing section or the second housing section or tools housed in the tool magazine).

Then if all the allocated divided tools are included in the usable tools, procedure to step S411 is made to execute the transfer and the mounting of the divided tools to each bending station as will be described below.

In step S409, if there are unusable tools present among the divided tools determined to be arranged, the procedure proceed to step S413, where examination will be made whether the problem may be dealt with by changing the combination of long divided tools and short divided tools on each station. For instance, although in the step S407, it was determined to use long tools as much as possible on each station, if the number of long tools determined to be arranged is smaller than the number of usable long tools, for instance one of the long tools may be replaced by a plural number of short tools.

In stop S413, for example when it is judged that the divided tools determined to be arranged by replacing one of the long divided tools with a designated number of short divided tools are all included in the usable divided tools, the final tool arrangement will be determined by the replacement in step S414, and the procedure will proceed to step S411.

In case it is judged in step S413 that arrangement of divided tools on each station by use of usable tools cannot be made, the procedure will proceed to step S415 where it is Judged whether all the order of bending has been examined. If it is Judged that all the order of bending has been examined in this step, it will be judged that the bending process of the bending product (FIG. 41) may not be made by use of usable tools, and the tool arrangement determination process will be suspended.

In step S415, in case it is judged that all the order of bending has not been examined, process will proceed to step S417 and the bending order will be changed. And the process will be returned to step S406 and the processes of steps 407, S409, S413 and the like will be repeated.

The operation of the steps S407, S409, S413, S415, S417 will all be made by the second computation means 409.

In stop S411, on basis of the arrangement data of the divided tools determined in the step 407 or step S414, each divided tool will be moved from each housing device or magazine or existing bending station to the designated arrangement position by the tool exchange device 61, 143.

In doing so, the tools housed in the tool magazine (not shown in the figure) outside of the bending press 1 will be inserted in the second housing section 123 beforehand.

Also a plurality of divided tools housed in the second housing section 123 will be moved from the second housing section to the first housing section 65 simultaneously by being supported by the tool support 129.

Figure 48:
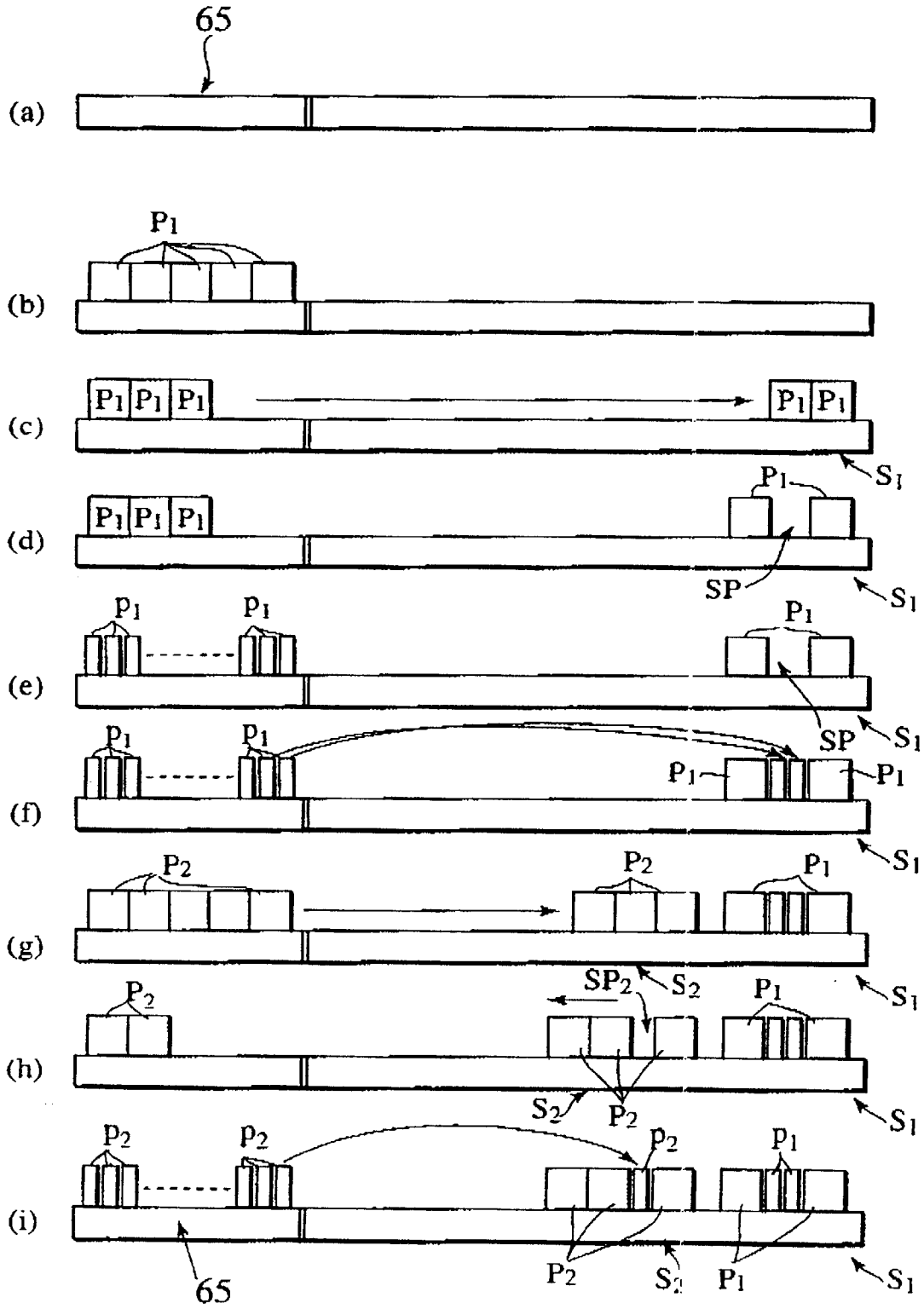
FIG. 48 shows the method to move the divided tools from the first housing section of the tool housing device and mount on the bending station.

FIG. 48 shows the method of moving the divided tools that are housed in or mounted on the first housing section (or the standby station) 65 to the bending stations s1, s2.

FIG. 48(*a*) shows the state where divided tools do not exist on the bending station and in the first housing section 65.

In FIG. 48(*b*), a group of long divided tools P1 is mounted in the first housing section 65 by the tool support 129.

In FIG. 48(*c*), two divided tools P1 on the right-hand side of the long divided tools P1 are moved by the tool exchange device to the position of station s1.

In FIG. 48(*d*), in course of the return of the tool exchange device 61, which moved the divided tool P1 to the station s1, from the station position s1 to the first housing section 65, the tool P1 on the left side of the station s1 is moved slightly to the left and forms a space sp between two divided tools P1 on the station s1.

In FIG. 48(*e*), a group of short divided tools p1 that are the game type as the long tool P1 but shorter are mounted in the first housing section 65.

In FIG. 48(*f*), of a plurality of short tools p1 mounted in the first housing section 65, for example two of the tools on the right end are inserted into the gap sp on the station s1 by the exchange device 61.

In FIG. 48(*g*), among a group of long divided tools P2 that compose station s2 mounted in the first housing section 65, three long divided tools P2 are moved to the position of station s2 by the exchange device 61.

In FIG. 48(*h*), when the exchange device 61 returns from the station s2 to the first housing section 65, it moves two of the station s2 tools P2 on the left side slightly to the left and makes a gap sp2.

In FIG. 48(*i*), short tools p2 with the same cross sectional shape but shorter than the tool P2 are mounted in the first housing section 65 and one of them is inserted into the gap sp on the first station S2 by the exchange device 61 from the first housing section 65.

The moving and mounting of each divided tool from each housing section or magazine or existing bending stations to the prescribed arrangement positions are completed as described above.

Figure 49:
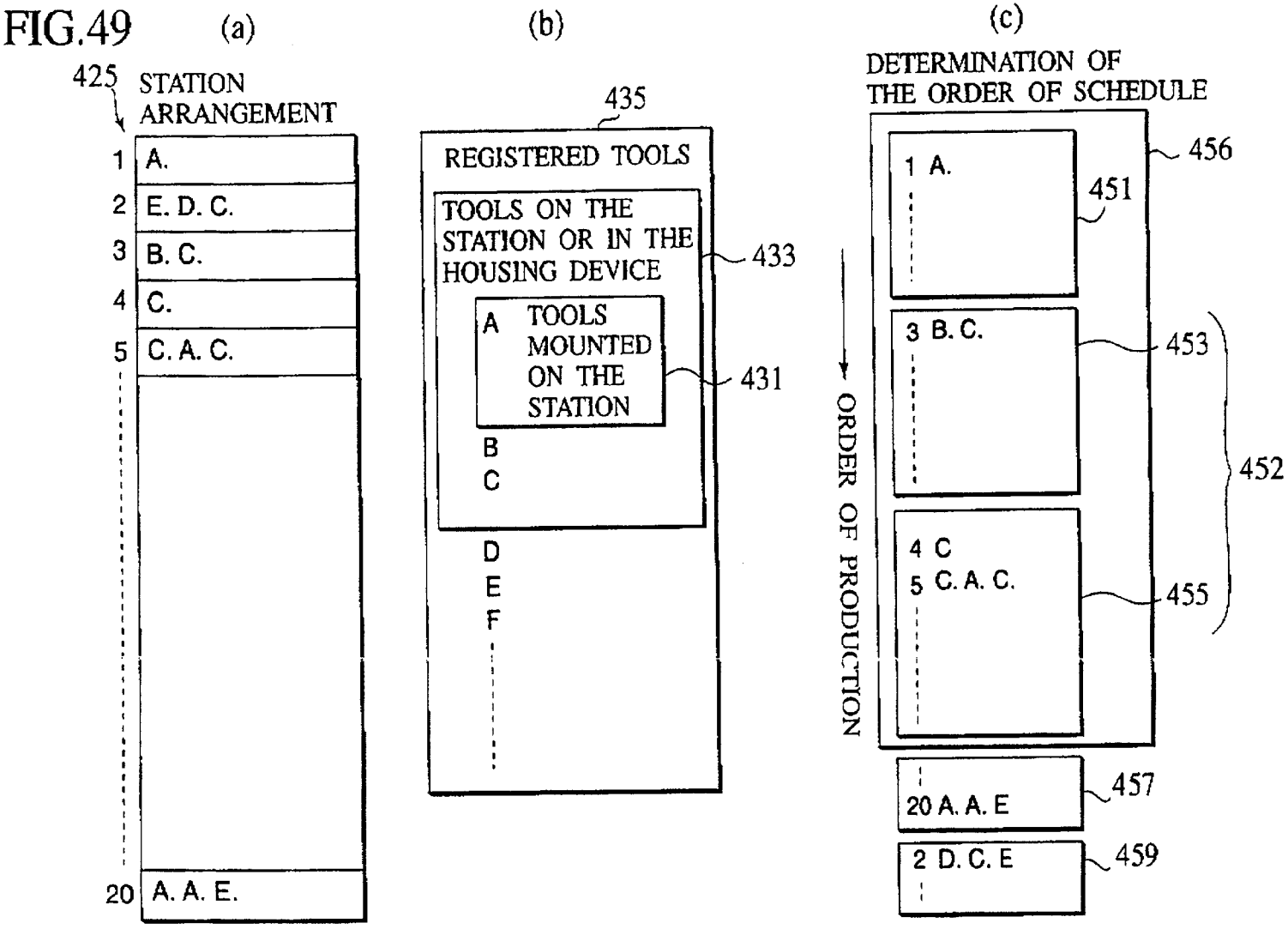
FIG. 49 shows the method to generate order of manufacture data that determines the order of manufacture when a plurality of products is to be manufactured.

FIG. 49 shows a method for preparing a production schedule when a plurality of bent products is produced by the bending press system.

In general, this schedule method for manufacturing a plurality of bent products in a bending press system provided with,

- a bending press having at least one bending station for mounting a plurality of divided tools and,
- a tool housing device (123, 129) to house divided tools for the bending press and,
- a tool exchange device (61, 143) to move the divided tool between the tool housing device and the bending station and to mount the divided tools on the bending station, includes,
- a step to store in the first memory means each tool on the bending station and housed in the housing device and housed in the tool magazine outside the bending press,
- a step to determine the tool types (cross section shape) of the divided tool to be mounted on the bending station and the length of the bending station on basis of the bending line length, flange length, bending angle of the bent section on the bent product, and
- a step to prepare the production order data in order to produce products which use tools mounted on the bending station or tools housed in the tool housing device before producing products which use tools housed in the tool magazine provided outside of the bending press, and in preparing the production order, to group products which use the same tool combinations and prepare the production order so that bent products of the same product group may be processed continuously.

In more detail, as shown in FIG. 49(*a*), first of all, for each product number 425, the type of the divided tool to be mounted on each station and the number of stations thereof and the like are determined. The determination of the tool type and the number of stations and the like will be executed for instance by steps S401–S417 shown in FIG. 47.

In example of FIG. 49(*a*), the number of bending stations to bend, for example, bent product 2 is three, and bending tool type-E tool will be arranged on the first station, type-D tool will be arranged on the second station and type-C tool will be arranged on the third station.

On the other hand, the present positions of the tools to be used in producing the bent products 1–20 are stored in the first memory means as registered data. The tools to be used in producing the bent products 1–20 are therefore classified as shown in FIG. 49(*b*) according to each arranged position or housed position. Thus, as shown in FIG. 49(*b*), for instance type-A divided tools are grouped as the station mounted tools 431, the types-A, -B, -C divided tools are grouped as the station or housing device tool group 433, and together with the types-A, -B, -C, types-D, -E, -F divided tools are grouped as the usable registered tool group 435. Here the types-D, -E, -P divided tools are divided tools housed in the tool magazine (not shown in the figure) outside the press 1.

Next, an shown in FIG. 49(*c*), the bent products 1–20 to be worked on are classified in a plural number of product groups according to the tool to be used. In more detail, bent products that are processed by use of only tool group 431 that are mounted on the bending station are classified as the bent product group 451. Also bent products that are processed by use of only tool group 433 housed in the bending station or the housing device are classified as the bent product group 452. The bent products belonging to the bent product group 452 will be subdivided into groups 453, 455 according to the bending tool used. Here bent products belonging to group 453 are bent products that at least use types-B and -C tools and bent products belonging to group 455 are bent products that at least use type-C bending tools.

Bent products leftover after the classification are products that use types-D, -E, -F tools that belong to the tool magazine outside the bending press. These products are classified as group 457 and 459 according to each bending tool used.

And as shown in FIG. 49(*c*), the order of production of the bent products 1–20 will be determined as follows. Firstly the bent product group 451 which use only the tools already mounted on the bending station will be produced, next bent product groups 453, 455 which use bending tools housed in the housing device 65, 123 besides the bending tools existing in the bending station will be produced, after which bent products 457, 459 which include bent products which use divided tools housed in the tool magazine outside the bending press 1 will be produced.

In short, the order of production is determined so that in bending a plurality of products continuously, the exchange man-hour of the divided tools will be minimized.

With the arrangement, a number of bent products may be produced swiftly.

Figure 50:
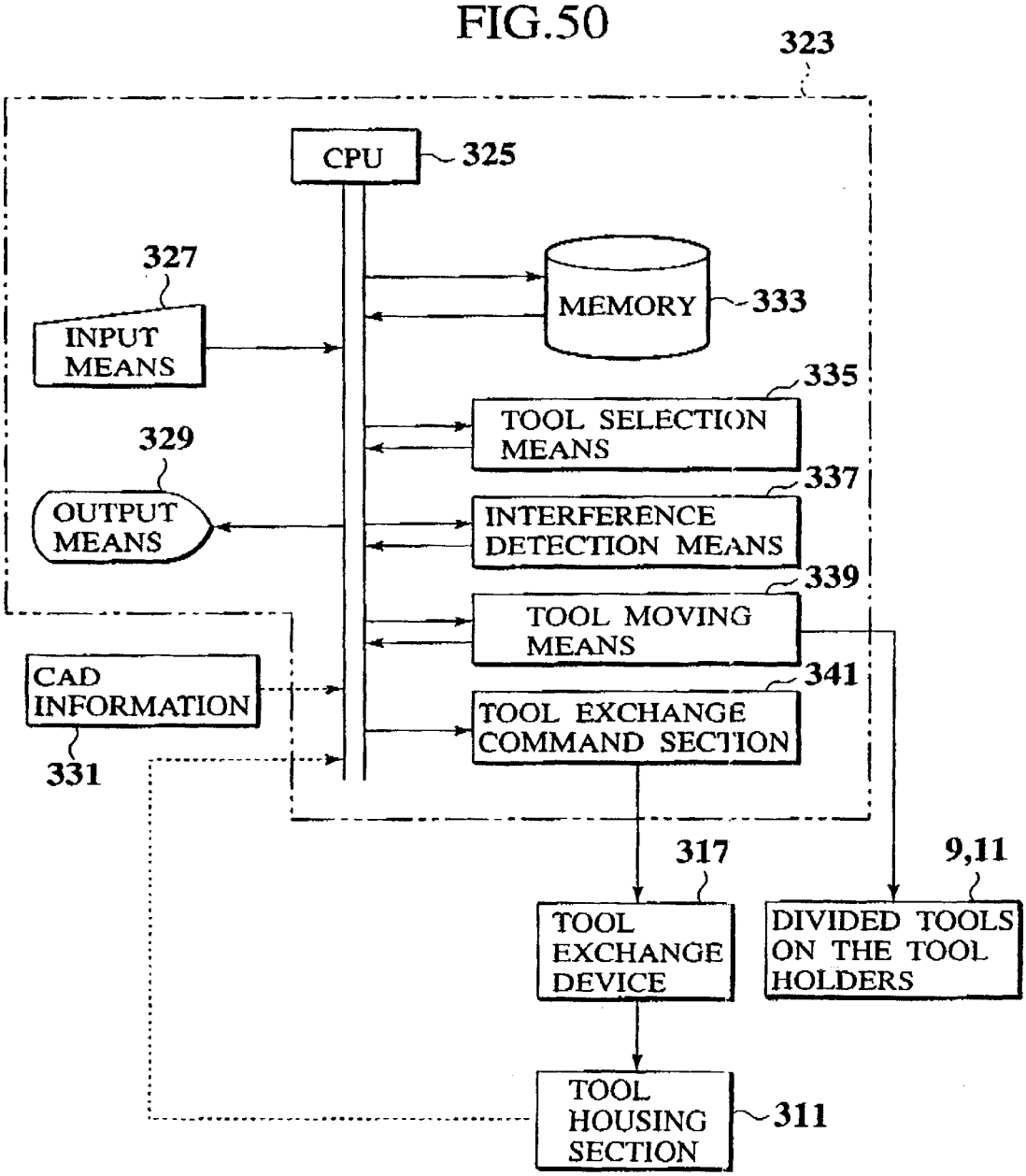
FIG. 50 is a block diagram that illustrates the fourth embodiment of this invention.

FIG. 50 is an explanatory figure explaining the 4th embodiment of the invention.

As shown in FIG. 50, this embodiment includes a support, management device 323 that support, manages the bending press system including the bending press 1. This support, management device 323 is provided with CPU 325 as the central processor. In order to input a variety of data into this CPU 325, an input device such as a keyboard, and in order to display a variety of data, an output device 329 such as a CRT are connected. Also CAD information 331 prepared for CAD may be inputted by use of media such as floppy disc and the like or on line.

Also, onto CPU 325, a memory 333 to store data and the like inputted and a tool selection means 335 which selects, by a method which will be explained in detail later, divided tools P, D to be used, and an interference detection means 37 which detects interference between the selected tools P, D and the work W, are connected. Also a tool movement means 339 that moves divided tools P, D on the tool holders 9, 11 and a tool exchange instruction 341 that operates the tool exchange device 317, are connected.

Also from the tool housing section 311 where the divided tools P, D to be exchanged by the tool exchange device 317 are housed, information as to what kind of divided tools P, D are housed may be inputted.

Figure 51:
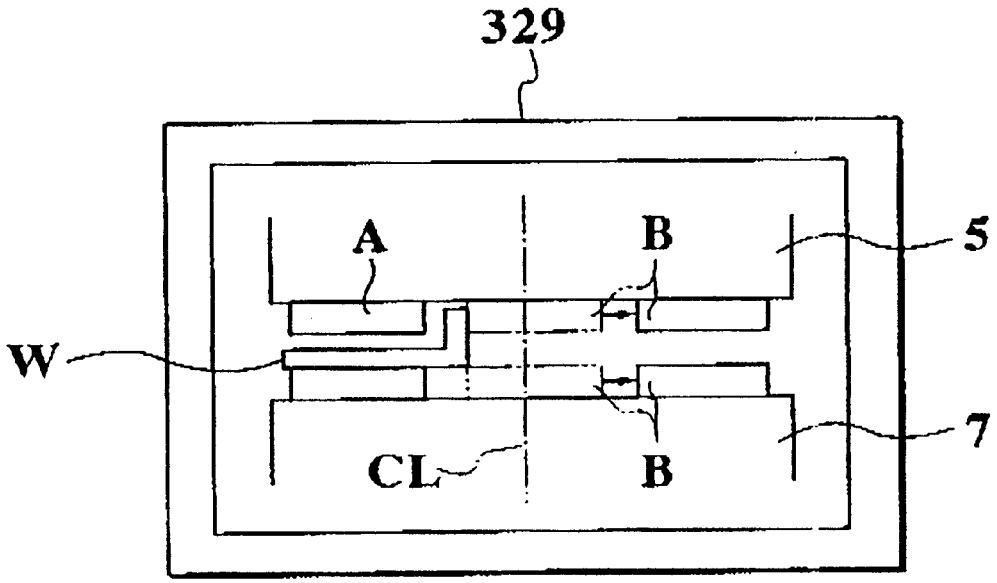
FIG. 51 illustrates the display screen.

Next, the tool mounting method on press brake 1, which forms the working station according to the length of the work W to be worked, will be explained. With reference to FIG. 51, on basis of the bending line of the unfolded figure in CAD information 331, the tool selection means 335 will select tools A, B that have lengths necessary for bending. And as the work W to be processed will be arranged and displayed simultaneously with the arrangement of the selected tools on the output means 329 (hereafter "CRT screen"), judgment may be made by the interference detector 337 or by eyesight of the operator whether the work and the neighboring tool B interfere or not.

In there is interference, the neighboring tool B may be moved by observing the movement on the CRT screen 329, and the moved position of the tools A, B may be registered as, for instance, how many mm from the machine center in the memory 333. Or a neighboring tool may be picked up on the CRT screen 329 and dragged to the position to be moved and registered automatically. Next, having determined the tool type (here "A", "B") and the mounting position of the tools as described, which divided tool housed in the press brake 1 should be used to construct a tool length (one station) will be determined.

Figure 52:
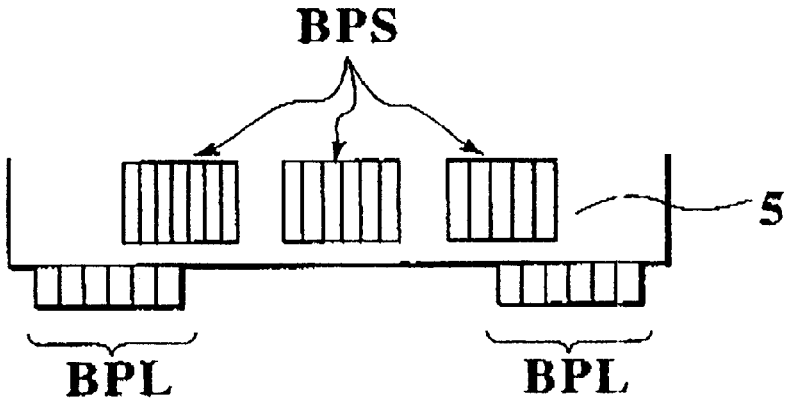
FIG. 52 illustrates an example of arrangement of the divided upper tools.

For example, referring to FIG. 52, on the lower edge of the upper table 5, long divided tools BPL (for example about 20 pieces of 100 mm long tools) are mounted and onto the upper table 5, short divided tools BPS (for example, 15 mm, 20 mm, 25 mm, 30 mm, 50 mm long tools) are mounted. To expedite description, explanation will be made only for punch P but the same conception may be applied to die D.

Short divided tools BPS are housed in the tool housing section 311 and are mounted and demounted to be exchanged on the tool attachment face of the upper table 5, and the long divided tools BPL are mounted free to move in the long direction of the tool holder 9 on the upper table 5.

Thus when, for example, tools are to be arranged 415 mm long for one station, the combination of tools to arrange the designated length (here 415 mm) is determined on basis of the following flow in the tool selection means 335 of the NC device 323 that determines the tool and prepares the layout.

Figure 53:
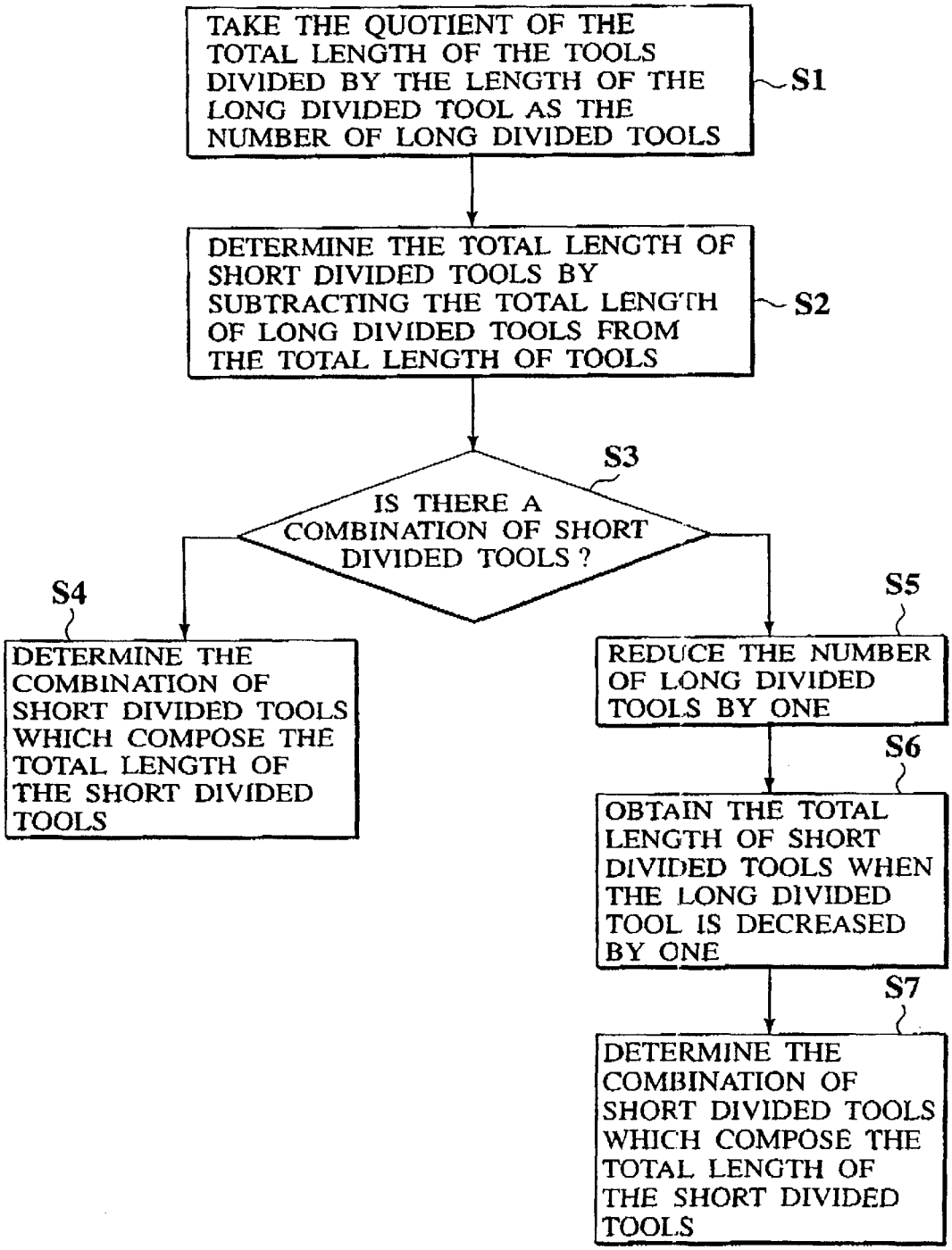
FIG. 53 is a flow chart.
Figure 54:
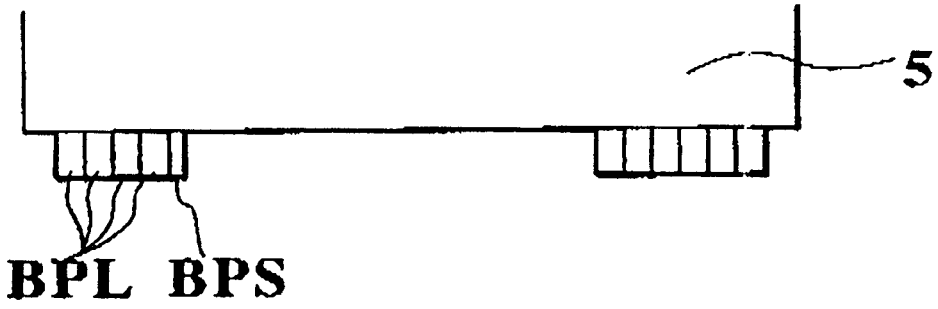
FIG. 54 illustrates an example of arrangement of the divided upper tools.

Referring to FIG. 53 and FIG. 54, firstly the total length (here for example 415 mm) is divided by the length of the long divided tool BPL (here 100 mm) and the quotient is taken as the number of long divided tools BPL (step S1). As 415/100=4, four long divided tools will be used.

Next the total length of the long divided tools BPL will be subtracted from the total tool length to obtain the total length of the short divided tools BPS. That is, when four long divided tools arc used, the remaining length will be 415−(4*100)=15 mm (step S2).

It is then judged whether short divided tools BPS which will compose the total length of the short divided tools exist or not (step S3), and as in this case a short divided tool 15 mm long is in hand, one 15 mm long short divided tool will be used (step S4) and the tool to be used will be selected and the tool layout will be prepared.

Thus, as shown in FIG. 54, to set up the total length 415 mm station on the left side of the upper table 5, 4 long divided tools BPL are left on the left side of the upper table 5 and other long divided tools BPL are moved to a non-interfering position by the tool movement means 339, and the 15 mm long short divided tool BPS housed in the rear side of the upper table is, for example, attached to the long divided tool BPL attached to the tool holder 9 of the upper table 5.

Now, it is needless to say that the attachment position of the short divided tool BPS is not limited to the right side of the long divided tool BPL as shown in the figure and that it will be attached according to the tool layout (for example so and so mm to the left side of the machine center CL). On the other hand, when the total length of the tools is 405 mm, four long divided tools BPL may be used as in the previous case but as the remaining length will be 5 mm, there are no corresponding short divided tools BLS, so that in step S3 it will be judged that there are no combinations of short divided tools BPS.

The number of long divided tools BPL will thus be decreased by one (step S5) and changed to three and as the total length of the short divided tools BPS obtained (step S6) will become 405 mm−(3*100)=105 mm, a combination of short divided tools BPS arranged over this length 105 mm will be determined (step S7). In the present case, as 50 mm+30 mm+25 mm=105 mm, one 50 mm long, one 30 mm long and one 25 mm long short divided tools BPS may be used.

By this result, a plurality of types of divided tools P, D maybe combined automatically and tool station with desired tool lengths may be exchanged and mounted automatically. Also, as the installation position may be set arbitrary, operation efficiency may be improved.

As explained, by the divided tool exchange method on the press brake, the total length of the tool station may be determined by the bending length in the product figure information, and the divided tools may be selected by combining the divided tools mounted on the tool holder and the divided tools housed in the tool housing section so that the combined length is equal to the total length, and by displaying the selected tool station on a screen display, divided tools which interfere with the work may be moved to a non-interfering position by the screen display, and as the selected divided tools will be mounted by the tool exchange device, a tool station with a desired length may be composed automatically by use of a plurality of types of divided tools.

Also, in the divided tool exchange device on the press brake, the total length of the tool station will be determined from the bending length in the product figure information, and the tool selection means will select divided tools so that the combination of the divided tools mounted on the tool holder and the divided tools housed in the tool housing section, will be equal to the total length, and by displaying the selected tool station on a screen, the interference detection means will detect from the displayed screen, divided tools which interfere with the work, and as the selected divided tools will be mounted on the tool holder by the tool exchange device after the detected interfering divided tools are moved to a non-interfering position by the tool transfer means, a tool station with the desired length using a plurality of tool types may be organized and mounted automatically.

Also, in the divided metal exchange device of the press brake, the tool selection means will first divide the total length of the tool station, determined on the basis of the figure information, by the length of the longest divided tool and the quotient will be taken as the number of the longest divided tools. Next as the divided tools will be determined so that divided tools housed in the tool housing section will be arranged on the remaining length comprising the total length of the tool station, a tool station with the desired length may be arranged automatically by use of a plurality of divided tool types.

Also, in the divided tool exchange device, the tool selection means will first obtain the number of the longest divided tool by dividing the total length of the tool station determined on basis of the figure information, but if divided tools housed in the tool housing station may not be composed on the remaining length which comprises the total length of the tool station, the number of longest divided tools will be decreased by 1 and divided tools will be selected so that the remaining length comprising the total length of the tool station may be arranged by divided tools housed in the tool housing section, thereby a tool station with the desired length using a plurality of divided tools types may be composed automatically.

What is claimed is:

1. A method for mounting divided tools with desired lengths onto a tool holder on an upper table and a lower table of a press brake using a tool exchange device, comprising the steps of:

(a) mounting first divided tools on the tool holder;

(b) housing second divided tools in a tool housing section;

(c) automatically, via a tool selection means, selecting divided tools from the first and second divided tools which constitute a tool station which has a total length corresponding to a bending length of the product;

(d) displaying each selected divided tool on a screen together with a workpiece;

(e) moving the divided tools which interfere with the workpiece to a non-interfering position; and (f) mounting the selected divided tools on the tool holder with the tool exchange device, wherein the step of selecting divided tools comprises:

(g) the step of automatically calculating a quotient of a total length of the tool station divided by a length of a longest of the first and second divided tools divided tool as a number of the longest divided tools; and (h) arranging a combination of other shorter divided tools on a difference of the total length of the tool station and the total length of the longest divided tools.

2. The method of claim 1, wherein the step of selecting divided tools further comprises:

when a combination of the other divided tools cannot be arranged on the difference of the total length of the tool station and the total length of the longest divided tools in the step (h), taking one subtracted from the number of the longest divided tools calculated in step (g) as the number of the longest divided tools;

arranging a combination of other tools on the difference of the total length of the tool station and the total length of the longest divided tools.

3. The method of claim 1 wherein lengths of the second divided tools housed in the tool housing are shorter than lengths of the first divided tools mounted on the tool holder.

* * * * *